US012628896B2

(12) United States Patent
Baryudin

(10) Patent No.: US 12,628,896 B2
(45) Date of Patent: May 19, 2026

(54) CYCLING HELMET WITH AN ENERGY DIVERTING LAYER

(71) Applicant: TREK BICYCLE CORPORATION, Waterloo, WI (US)

(72) Inventor: Alan Baryudin, Madison, WI (US)

(73) Assignee: TREK BICYCLE CORPORATION, Waterloo, WI (US)

( * ) Notice: Subject to any disclaimer, the term of this patent is extended or adjusted under 35 U.S.C. 154(b) by 0 days.

(21) Appl. No.: 18/742,177

(22) Filed: Jun. 13, 2024

(65) Prior Publication Data

US 2024/0415225 A1 Dec. 19, 2024

Related U.S. Application Data

(60) Provisional application No. 63/644,972, filed on May 9, 2024, provisional application No. 63/521,157, filed on Jun. 15, 2023.

(51) Int. Cl.
*A42B 3/06* (2006.01)
*A42B 3/04* (2006.01)

(52) U.S. Cl.
CPC ..... *A42B 3/066* (2013.01); *A42B 3/0406* (2013.01); *A42B 3/064* (2013.01)

(58) Field of Classification Search
CPC ..... A42B 3/066; A42B 3/069; A42B 3/063; A42B 3/06
USPC ..... 2/411
See application file for complete search history.

(56) References Cited

U.S. PATENT DOCUMENTS 4,307,471 A 12/1981 Lovell
6,658,671 B1 12/2003 von Holst et al.
6,766,537 B1 7/2004 Maki et al.
8,015,624 B2 9/2011 Baldackin et al.
8,615,817 B2 12/2013 Phillips
9,072,330 B2 7/2015 Yoon
9,545,125 B2 1/2017 Yoon et al.
9,687,037 B1 * 6/2017 Colello ..... A42B 3/069
10,779,601 B2 9/2020 Lanner et al.
11,147,335 B2 10/2021 Pomering et al.
11,304,470 B2 4/2022 Kele et al.
11,678,709 B2 6/2023 Halldin et al.
2004/0250340 A1 12/2004 Piper et al.

(Continued)

FOREIGN PATENT DOCUMENTS

WO 2011139224 A1 11/2011
WO 2018177791 A1 10/2018

OTHER PUBLICATIONS

International Search Report and Written Opinion in International Patent Application No. PCT/US24/33747 dated Nov. 18, 2024, 17 pages.

*Primary Examiner* — Timothy K Trieu
(74) *Attorney, Agent, or Firm* — Bell & Manning, LLC

(57) ABSTRACT

A helmet includes an energy absorbing layer. The energy absorbing layer includes a secondary magnetic material that is at least partially embedded in the energy absorbing layer. The helmet also includes a slidable energy diverting layer that acts as an external shell of the helmet. A pocket is mounted to an interior surface of the slidable energy diverting layer, where the pocket includes a primary magnetic material. An attraction between the primary magnetic material and the secondary magnetic material secures the slidable energy diverting layer to the energy absorbing layer during normal use of the helmet.

20 Claims, 40 Drawing Sheets

(56) References Cited

U.S. PATENT DOCUMENTS

| | | | | |
|---|---|---|---|---|
| 2010/0115686 | A1 | 5/2010 | Halldin | |
| 2014/0223641 | A1* | 8/2014 | Henderson | A42B 3/065 2/411 |
| 2016/0113347 | A1* | 4/2016 | Halldin | A42B 3/066 2/411 |
| 2020/0029644 | A1 | 1/2020 | Kele et al. | |
| 2022/0232924 | A1 | 7/2022 | Cook et al. | |
| 2022/0232928 | A1* | 7/2022 | Reddy | A43B 13/42 |
| 2024/0277095 | A1* | 8/2024 | Vos | A42B 3/125 |

* cited by examiner

CYCLING HELMET WITH AN ENERGY DIVERTING LAYER

CROSS-REFERENCE TO RELATED APPLICATIONS

The present applications claims the priority benefit of both U.S. Provisional Patent App. No. 63/521,157 filed on Jun. 15, 2023 and U.S. Provisional Patent App. No. 63/644,972 filed on May 9, 2024, the entire disclosures of which are incorporated by reference herein.

BACKGROUND

A cycling helmet is often worn by bicyclists as a safety precaution to help prevent injury in the event of a cycling accident. Traditional cycling helmets come in a large variety of different shapes and can be composed of numerous different materials. Many traditional helmets include a layer of stiff foam material (e.g., expanded polystyrene) that is surrounded by a rigid outer shell. In such helmets, the outer shell is generally glued or otherwise attached to the layer of stiff foam material to ensure that the layers do not separate in the event of an impact to the helmet.

SUMMARY

An illustrative helmet includes an energy absorbing layer. The energy absorbing layer can include a secondary magnetic material that can be at least partially embedded in the energy absorbing layer. The helmet also includes a slidable energy diverting layer that acts as an external shell of the helmet. A pocket is mounted to an interior surface of the slidable energy diverting layer or formed as a part of the interior surface of the slidable energy diverting layer, where the pocket can include a primary magnetic material. An attraction between the primary magnetic material and the secondary magnetic material can at least partially secure the slidable energy diverting layer to the energy absorbing layer during normal use of the helmet.

In an illustrative embodiment, the energy absorbing layer can include a cavity positioned adjacent to the secondary magnetic material, where the cavity can be sized to receive the pocket on the interior surface of the slidable energy diverting layer. In another embodiment, the helmet can include an intermediate layer mounted to the energy absorbing layer, where the intermediate layer can include a cavity that is positioned over the secondary magnetic material. The cavity can be sized to receive the pocket on the interior surface of the slidable energy diverting layer. In one embodiment, the intermediate layer is made from the same materials as the slidable energy diverting layer.

In an illustrative embodiment, the attraction between the primary magnetic material and the secondary magnetic material releases upon an impact to the helmet such that the slidable energy diverting layer at least partially slides from the helmet to divert rotational energy that results from the impact. In one embodiment, a low friction coating can be applied to the interior surface of the slidable energy diverting layer. In another embodiment, a low friction coating can be applied to a surface of the energy absorbing layer that faces the slidable energy diverting layer. In another embodiment, the helmet can include a tether secured to the slidable energy diverting layer and the energy absorbing layer, where the tether limits movement of the slidable energy diverting layer upon sliding of the slidable energy diverting layer.

Another illustrative helmet includes an energy absorbing layer and an intermediate layer mounted to a portion of an exterior surface of the energy absorbing layer. The helmet also has a slidable energy diverting layer that includes a primary surface and one or more extensions that extend from the primary surface. The one or more extensions are adhered to the energy absorbing layer using an adhesive, treatment, or texturing to create a bond between the energy absorbing layer and the slidable energy diverting layer. The primary surface rests on the intermediate layer such that only the extensions are secured to the energy absorbing layer.

In one embodiment, the adhesive is applied a distance inward from peripheral edges of the one or more extensions, where the distance is between two millimeters (mm) and four mm. In another embodiment, upon impact to the helmet, the bond is broken such that the slidable energy diverting layer at least partially slides from the helmet to divert rotational energy that results from the impact.

Another illustrative helmet includes an energy absorbing layer that includes a ledge or a channel around at least a portion of a perimeter of the energy absorbing layer. The helmet also includes a slidable energy diverting layer that includes a primary surface and a flange that extends from the primary surface, where the flange interacts with the ledge or the channel to secure the slidable energy diverting layer to the energy absorbing layer during normal use of the helmet. The helmet also includes a tether assembly that secures the slidable energy diverting layer to the energy absorbing layer.

In an illustrative embodiment, the flange releases from the ledge or the channel in response to an impact to the helmet such that the slidable energy diverting layer slides to divert rotational energy that results from the impact. In another embodiment, the flange has a first depth at a front of the slidable energy diverting layer and a second depth at a side of the slidable energy diverting layer, such that the first depth is greater than the second depth. In another embodiment, the flange has a first angle relative to the primary surface at a front of the slidable energy diverting layer and a second angle relative to the primary surface at a side of the slidable energy diverting layer.

The helmet can also include a connector base embedded in the energy absorbing layer, where the tether assembly includes a cord and a snap fit connector attached to the cord, and wherein the snap fit connector mates with the connector base to secure the cord to the energy absorbing layer. In another embodiment, a loop of the cord connects to the snap fit connector such that two strands of the cord extend between the energy absorbing layer and the slidable energy diverting layer.

In another embodiment, the tether assembly includes a cord that extends between the energy absorbing layer and the slidable energy diverting layer, and the cord mounts to a top cap that attaches to the slidable energy diverting layer. In one embodiment, a friction channel extends through a body of the top cap, and the cord runs through the friction channel to increase resistance on the cord. In another embodiment, the friction channel comprises a first friction channel, and the top cap also includes a second friction channel, such that the first friction channel and the second friction channel each receive a portion of the cord. In another embodiment, an opening is positioned between the first friction channel and the second friction channel, and a loop of the cord extends through the opening. In another embodiment, a clip receives both ends of the cord. The clip secures the ends of the cord to maintain the cord as a loop that extends from the top cap. The tether assembly can also include a top cap cover that is sized to receive the top cap. The top cap cover mounts to the slidable energy diverting layer to secure the cord to the slidable energy diverting layer. In one embodiment, the top cap cover mounts to an inner surface of the slidable energy diverting layer such that the tether assembly does not extend through the slidable energy diverting layer.

Other principal features and advantages of the invention will become apparent to those skilled in the art upon review of the following drawings, the detailed description, and the appended claims.

BRIEF DESCRIPTION OF THE DRAWINGS

Illustrative embodiments will hereafter be described with reference to the accompanying drawings, wherein like numerals denote like elements. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

FIG. 5AA is a bottom view of a tether assembly in which the top cap cover mounts to the top cap via an annular snap fit in accordance with an illustrative embodiment.

FIG. 5BB is a bottom view of a tether assembly in which the top cap cover mounts to the top cap via a cantilever snap fit in accordance with an illustrative embodiment.

DETAILED DESCRIPTION

Figure 1:
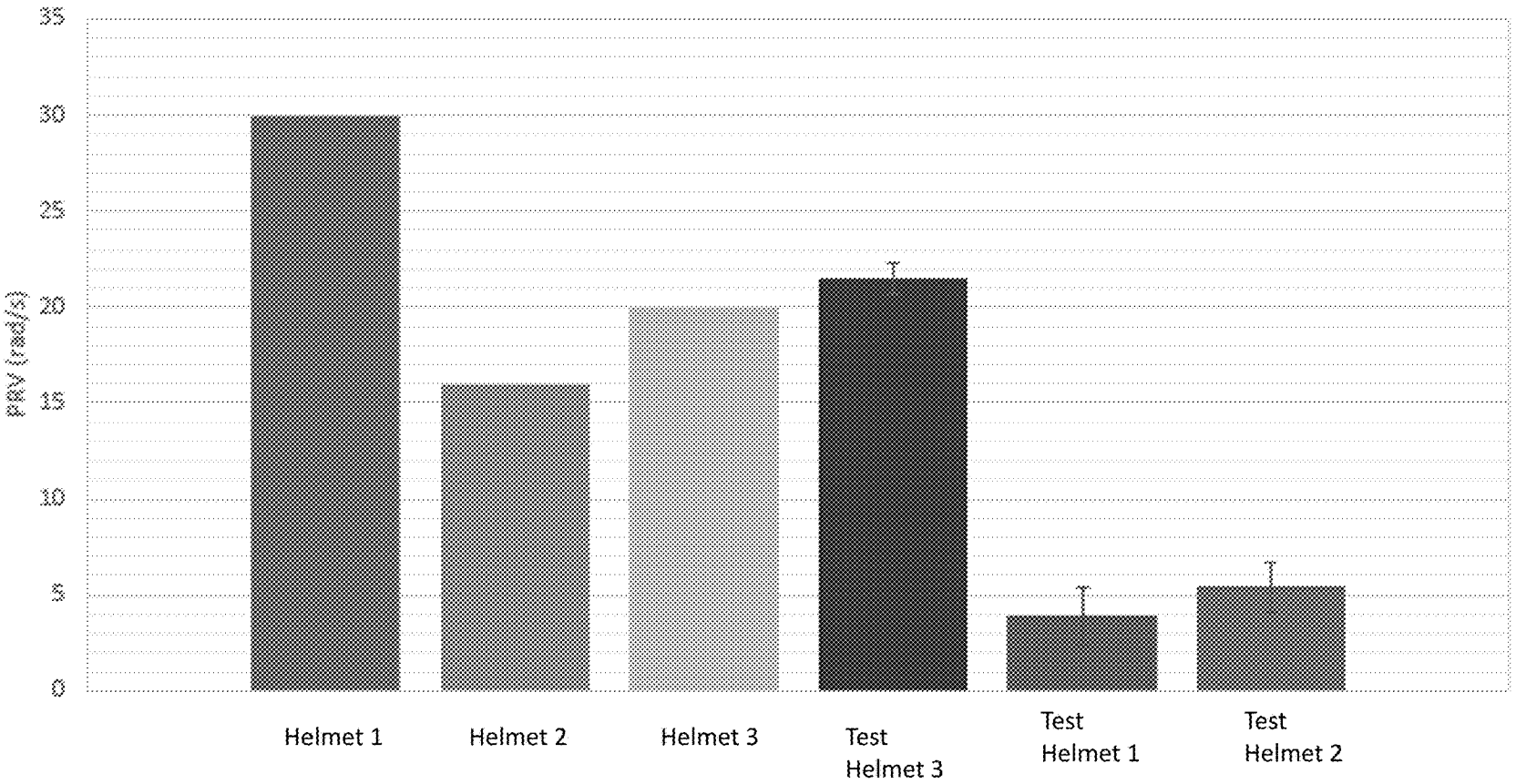
FIG. 1 is a chart that depicts results of testing traditional helmets to two variations of a helmet with an energy diverting layer in accordance with an illustrative embodiment.

Described herein are helmets that include at least one energy diverting layer, that also acts as an external shell of the helmet. In the event of an impact to the helmet, the energy diverting layer moves relative to the rest of the helmet to help absorb or manage the energy of the impact and help manage potential injury to the wearer of the helmet. In an illustrative embodiment, the helmets described herein can be cycling helmets. However, it is to be understood that the description is not intended to be limited to cycling helmets. For example, the helmets described herein can be used for cycling, motorcycling, rock climbing, ice climbing, skiing, snowboarding, etc.

A typical protective helmet includes an energy absorbing layer surrounded by an external shell. The energy absorbing layer can be expanded polystyrene (EPS), expanded polypropylene (EPP), high density polyethylene (HDPE), ultra-high molecular weight high density polyethylene (UHMWPE), foam, etc. The external shell can be formed from polycarbonate (PC) or another suitable material such as carbon fiber. In traditional helmets, the external shell is completely laminated or otherwise completely securely mounted to the energy absorbing layer to ensure that the two layers remain completely attached and do not separate during an impact to the helmet. The complete attachment of helmet layers also helps prevent the external shell from delaminating during everyday use, thereby helping to preserve the aesthetic appearance of the helmet. As further described in FIG. 1, having an energy diverting layer that slides on the helmet in the event of an impact as disclosed herein can help to absorb or manage impact energy such that the predicted risk of injury to the user is lowered when compared to a traditional helmet that does not include such a slidable energy diverting layer.

In an illustrative embodiment, the energy diverting layer is the external shell of the helmet. In one embodiment, the helmet includes an intermediate layer in the form of a polycarbonate shell that is securely mounted to the energy absorbing layer (e.g., EPS) of the helmet. Alternatively, the intermediate layer can be made from a different type of material. In such an embodiment with an intermediate layer, the external shell is slidably secured to the intermediate layer via one or more magnet to magnet connections that form a bond. In another embodiment, the helmet does not include an intermediate layer, and the external shell is slidably mounted directly to the energy absorbing layer via one or more magnets. In another embodiment, magnets are not used to facilitate movement of the external shell upon impact to the helmet. In such an embodiment, the external shell can be partially laminated to the energy absorbing layer such that the external shell slides in the event of an impact. In another alternative embodiment, the external shell can attach to the energy absorbing layer via a flange of the external shell that mates with a ledge or other feature of the energy absorbing layer. In such an embodiment, adhesive and/or magnets may not be used. These embodiments are all described in more detail below with reference to the figures.

To help determine the effectiveness of the proposed helmets with a slidable energy diverting layer, the inventors conducted experimental impact tests on a number of different cycling helmets using a head and neck impact testing method. Specifically, three commercially available helmets (Helmet 1, Helmet 2, and Helmet 3) from various manufacturers were tested, along with a first embodiment of the proposed helmet that includes an external shell slidably mounted to an intermediate layer via one or more magnets (Test Helmet 1), a second embodiment of the proposed helmet that includes an external shell slidably mounted to the energy absorbing layer via one or more magnets (Test Helmet 2), and a third embodiment of the proposed helmet that includes an edge bonded external shell slidably mounted to the energy absorbing layer (Test Helmet 3). Helmet 1 was a traditional EPS helmet, and Helmets 2 and 3 include rotation mitigation technology. Specifically, the helmets were subjected to an impact and the peak rotational velocity (PRV) of the helmet was measured (in radians/second (rad/s)) in response to the impact. It is generally understood that a lower PRV of a helmet will result in a lower likelihood of injury to the user of the helmet. FIG. 1 is a chart that depicts results of testing traditional helmets to two variations of a helmet with an energy diverting layer in accordance with an illustrative embodiment. As shown, Test Helmet 1 and Test Helmet 2 with a magnetically slidable energy diverting layer had significantly lower peak rotational velocities as compared to the three commercially available helmets that were tested. Test Helmet 3 had peak rotational velocities comparable to commercially available helmets that include rotation mitigation technology. The results of FIG. 1 are based on neck impact testing. A freehead (no neck) test was also conducted on both the commercially available helmets and the test helmets. The freehead tests produced similar results to those of FIG. 1.

Figure 2A:
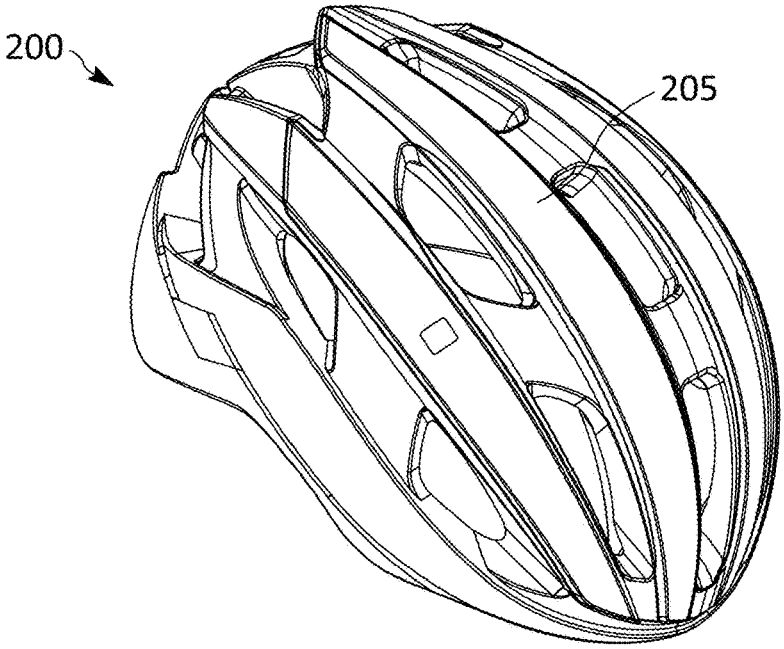
FIG. 2A is a top, perspective view of a helmet with a slidable energy diverting layer in accordance with a first illustrative embodiment.
Figure 2B:
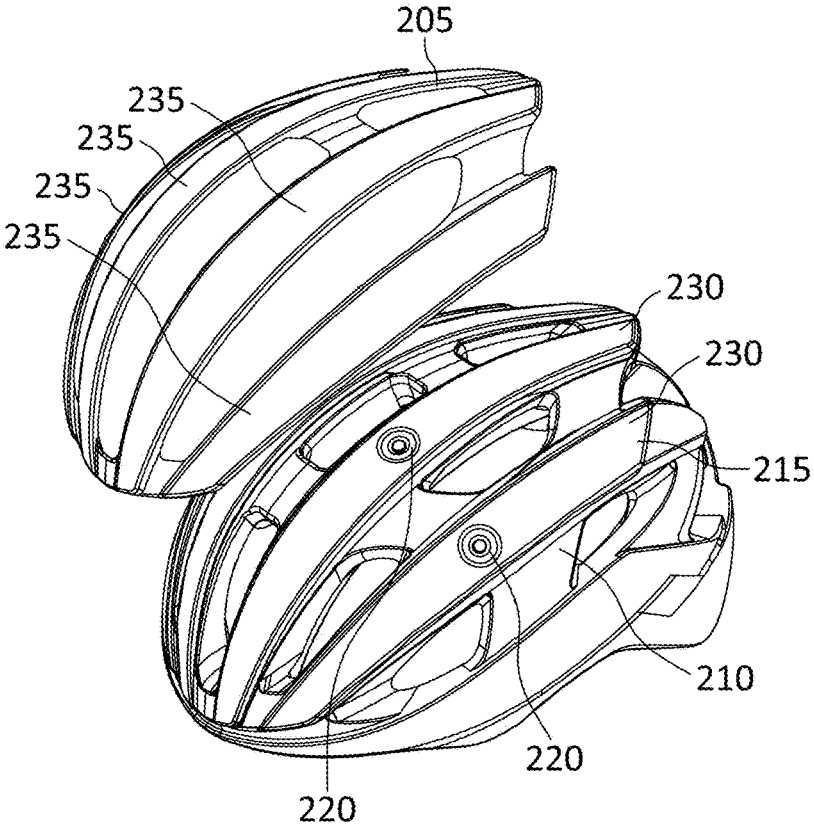
FIG. 2B is a partially exploded view of the helmet of FIG. 2A with the slidable energy diverting layer slid from the helmet in accordance with an illustrative embodiment.
Figure 2C:
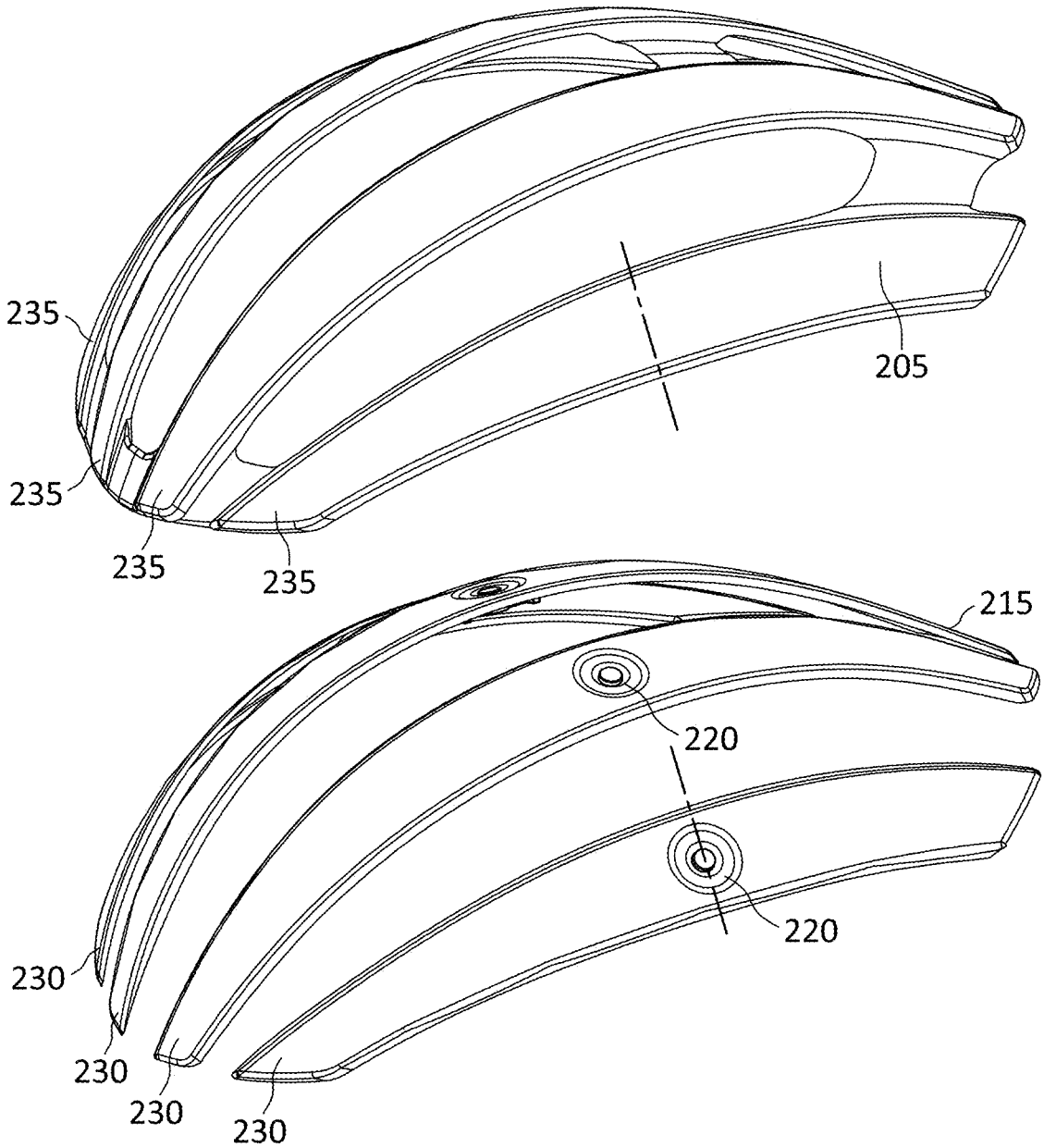
FIG. 2C depicts the slidable energy diverting layer and an intermediate layer to which the slidable energy diverting layer mounts in accordance with an illustrative embodiment.
Figure 2D:
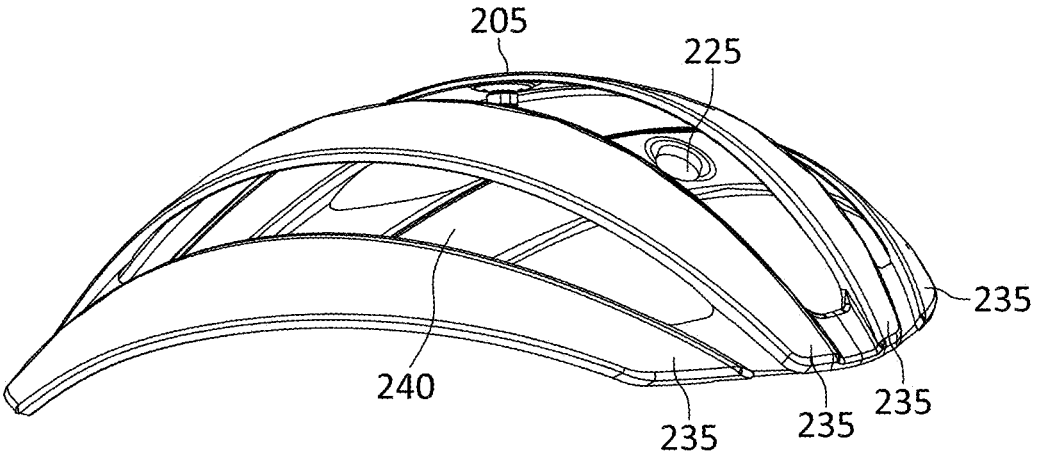
FIG. 2D depicts a view of an exterior surface of the slidable energy diverting layer in accordance with an illustrative embodiment.
Figure 2E:
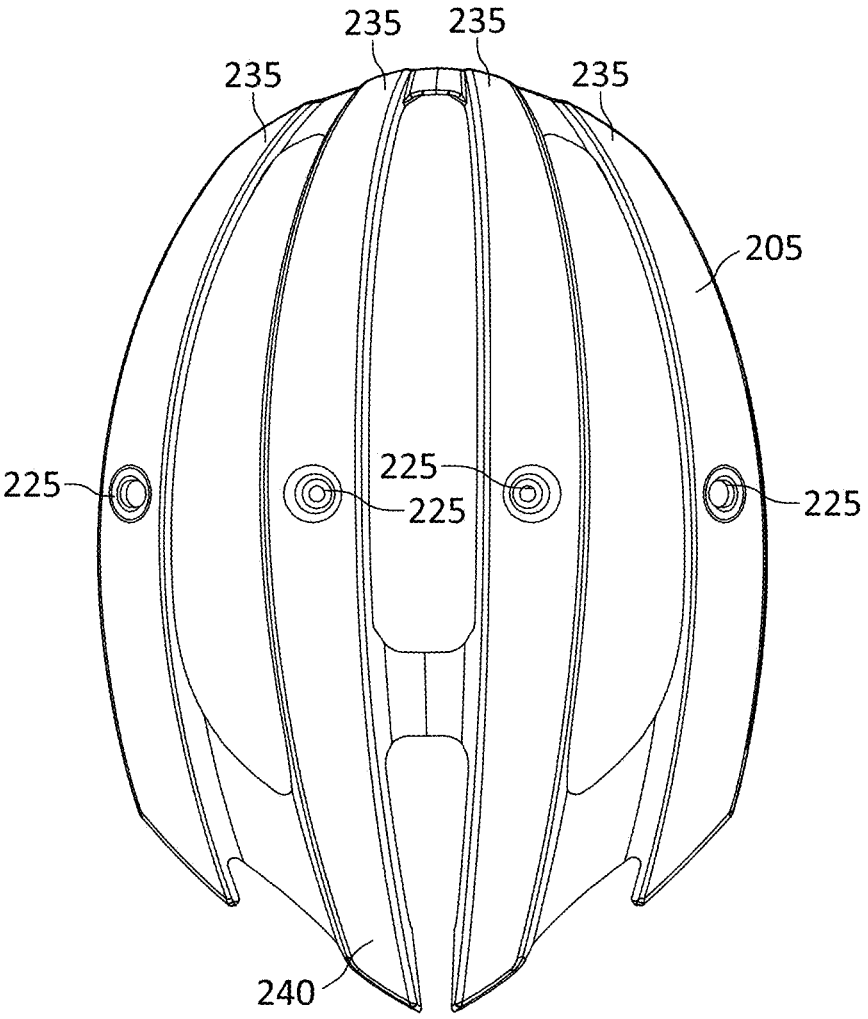
FIG. 2E depicts a view of an interior surface of the slidable energy diverting layer with a low friction coating applied thereto in accordance with an illustrative embodiment.

FIG. 2A is a top, perspective view of a helmet 200 with a slidable energy diverting layer 205 in accordance with a first illustrative embodiment. FIG. 2B is a partially exploded view of the helmet 200 of FIG. 2A with the slidable energy diverting layer 205 slid from the helmet 200 in accordance with an illustrative embodiment. FIG. 2C depicts the slidable energy diverting layer 205 and an intermediate layer to which the slidable energy diverting layer 205 mounts in accordance with an illustrative embodiment. FIG. 2D depicts a view of an exterior surface of the slidable energy diverting layer 205 in accordance with an illustrative embodiment. FIG. 2E depicts a view of an interior surface of the slidable energy diverting layer 205 with a low friction coating applied thereto in accordance with an illustrative embodiment. As shown, the helmet 200 includes an energy absorbing layer 210, which is a high-density foam layer designed to absorb certain types of impacts and to help cushion and protect the head from certain types of injuries. The energy absorbing layer 210 can be made from EPS or any other suitable material, as described herein.

Mounted to the energy absorbing layer 210 is an intermediate layer (or intermediate shell) 215. In an illustrative embodiment, the intermediate layer 215 is securely mounted to the energy absorbing layer 210 such that the energy absorbing layer 210 and the intermediate layer 215 remain attached to one another in the event of an impact to the helmet 200. The intermediate layer 215 can be mounted to the energy absorbing layer 210 using an adhesive, mechanical bonding, or any other method. In another illustrative embodiment, both the intermediate layer 215 and the slidable energy diverting layer 205 are made from polycarbonate. Alternatively, either or both of the intermediate layer 215 and the slidable energy diverting layer 205 can be made from another suitable material, such as a carbon fiber woven material. It is also noted that that the intermediate layer 215 and the slidable energy layer 205 can each be made from different materials in some embodiments. For example, the intermediate layer 215 can be made from a carbon fiber material and the slidable energy diverting layer 205 can be made from polycarbonate in one embodiment, or vice versa. In an illustrative embodiment, both the slidable energy diverting layer 205 and the intermediate layer 215 can have a thickness that is greater than or equal to 0.3 millimeters (mm) and less than or equal to 1.2 mm. Alternatively, a different range of thickness may be used, such as 0.25 mm-1.3 mm, etc. The slidable energy diverting layer 205 and the intermediate layer 215 can be formed through injection molding, thermoforming, or any other manufacturing technique known in the art.

As shown, the intermediate layer 215 includes a plurality of cavities 220 that are used to slidably secure the slidable energy diverting layer 205 to the helmet 200. Specifically, each of the cavities 220 is positioned above a magnet that is embedded into the energy absorbing layer 210. The slidable energy diverting layer 205 includes a corresponding plurality of pockets 225 that are mounted to the interior surface of the slidable energy diverting layer 205. Each of the pockets 225 includes a magnet. The pockets 225 mounted to the interior surface of the slidable energy diverting layer 205 can be sized to mate with the cavities 220 formed in the intermediate layer 215 such that the magnets in the pockets are attracted to the magnets embedded in the energy absorbing layer 210. The magnets and their attachment to the layers is described in more detail below with reference to FIG. 4. Alternatively, one of the magnets in a pair (e.g., 415, 445) can be replaced with a magnetically attachable material such as a ferrous material like iron or steel. As used herein, magnetic material can refer to a magnet or to a magnetically attachable material such as a ferrous metal.

As shown, the cavities 220 are positioned at a center of each of a plurality of ribs 230 that form the intermediate layer 215. Similarly, the pockets 225 are positioned at a center of each of a corresponding plurality of ribs 235 that form the slidable energy diverting layer 205. In alternative embodiments, a different number of cavities/pockets can be used in each of the intermediate layer 215 and the slidable energy diverting layer 205, such as 1 cavity/pocket in each layer, 2 cavities/pockets in each layer, 3 cavities/pockets in each layer, 5 cavities/pockets in each layer, 8 cavities/pockets in each layer, 10 cavities/pockets in each layer, 12 cavities/pockets in each layer, etc. While the slidable energy diverting layer 205 and the intermediate layer 215 are each shown with 4 ribs, it is to be understood that a different number of ribs can be used for the layers in alternative embodiments, such as 2 ribs, 3 ribs, 5 ribs, etc. In another alternative embodiment, the layers of the helmet may not include ribs at all. For example, any of the helmets described herein can be a dome helmet in which each of the layers is formed from a solid surface that does not include ribs, but that may include one or more openings for helmet vents.

Additionally, the cavities/pockets 220/225 can be positioned at different locations along the ribs 230/235 of each of the intermediate layer 215 and the slidable energy diverting layer 205, respectively. For example, in one embodiment, one or more cavities/pockets can be positioned at a front portion of the ribs 230/235, where the front portion refers to the portions of the ribs that extend from a transverse (or cross-sectional) centerline (see FIG. 2C) of the ribs to the front of the helmet 200. Similarly, one or more cavities/pockets can be positioned at a rear portion of the ribs, where the rear portion refers to the portions of the ribs that extend from the transverse centerline of the ribs to the rear of the helmet 200. Similarly, while the cavities/pockets 220/225 are depicted as being longitudinally centered along the ribs 230/235, in alternative embodiments the cavities/pockets 220/225 can be off center longitudinally.

In an illustrative embodiment, magnets positioned in the cavities/pockets 220/225 are attracted to one another and used in combination with chamfers (described below) to help ensure that the slidable energy diverting layer 205 only slides in the event of an impact to the helmet. As also discussed in more detail below, the slidable energy diverting layer 205 is designed to not slide or move relative to the rest of the helmet during normal use of the helmet.

In the embodiment shown in FIGS. 2A-2E, the intermediate layer 215 is formed as a plurality of ribs 230 that are not connected to one another, and that are independently mounted to the energy absorbing layer 210. Conversely, the slidable energy diverting layer 205 is formed as an integral unit in which the adjacent ribs 235 in the plurality of ribs 235 are connected to one another at least at the front of the helmet 200 and at the rear of the helmet 200. In alternative embodiments, the intermediate layer 215 and the slidable energy diverting layer 205 can be identical in shape. For example, both the intermediate layer 215 and the slidable energy absorbing layer 210 can be formed as ribs that are not connected to one another, as a series of connected ribs, or alternatively as a dome (or semispherical) shape that does not include ribs.

Referring now to FIGS. 2D and 2E, it can be seen that an interior surface of the slidable energy diverting layer 205 can include a low friction coating 240 to facilitate movement between the slidable energy diverting layer 205 and the intermediate layer 215 in the event of an impact to the helmet 200. The low friction coating can be silk screening ink, printing ink, Teflon (PTFE), polysiloxane, etc. As used herein, the interior surface of the slidable energy diverting layer 205 refers to the surface that contacts an exterior surface of the intermediate layer 215 during normal use of the helmet. In an alternative embodiment, the low friction coating 240 can be applied to the exterior surface of the intermediate layer 215 to facilitate the movement between the two layers. In another alternative embodiment, the low friction coating 240 can be applied to both the interior surface of the slidable energy diverting layer 205 and the exterior surface of the intermediate layer 215. In such an embodiment, the same low friction coating 240 can be applied to both the interior surface of the slidable energy diverting layer 205 and the exterior surface of the intermediate layer 215. Alternatively, a first type of low friction coating can be applied to the interior surface of the slidable energy diverting layer 205 and a second type of low friction coating can be applied to the exterior surface of the intermediate layer 215, where the first type of low friction coating differs from the second type of low friction coating.

Figure 3A:
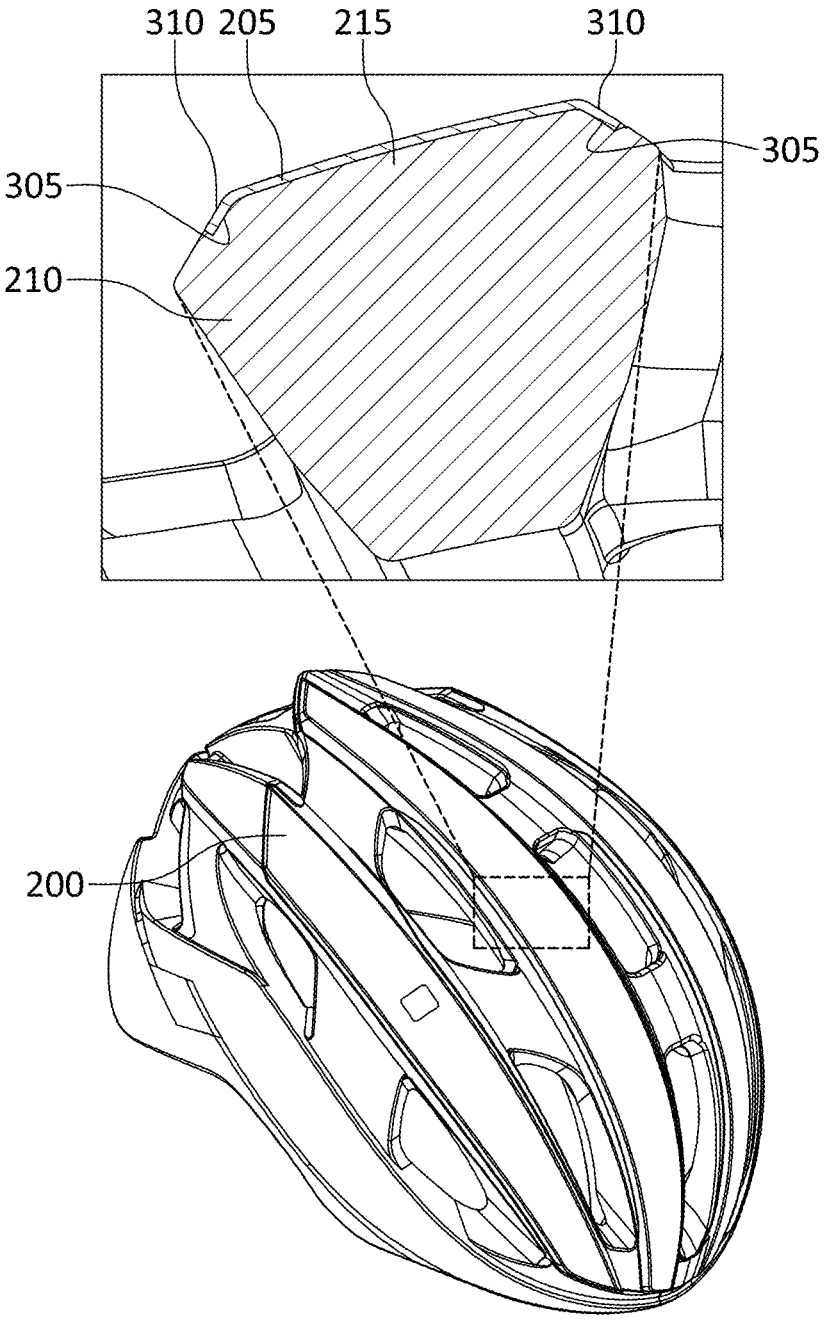
FIG. 3A depicts the helmet along with a close-up cross-sectional view of a portion of the helmet that extends in between two vents of the helmet in accordance with an illustrative embodiment.
Figure 3B:
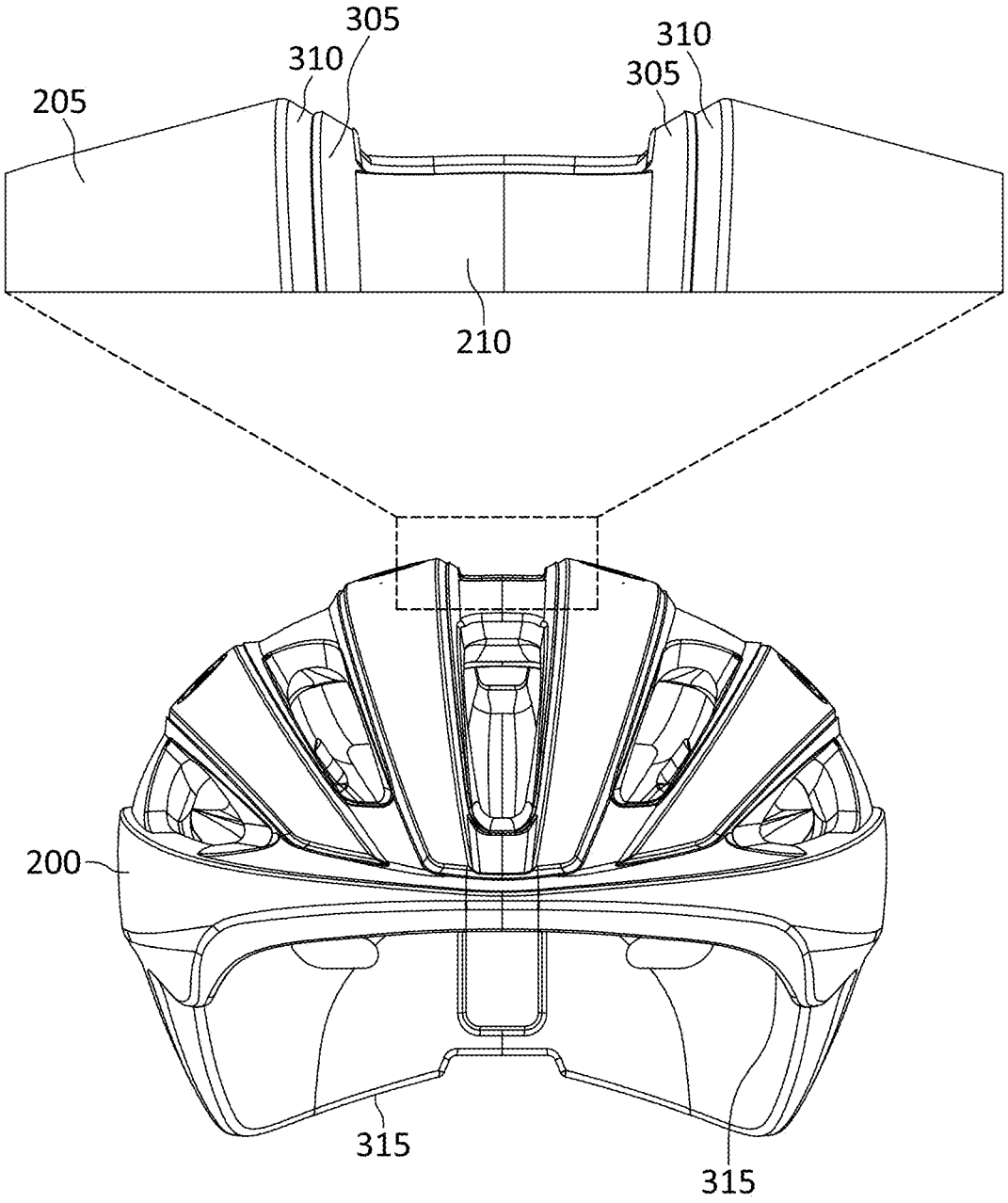
FIG. 3B depicts the helmet along with a close-up view of a portion of the helmet that extends in between two ribs of the slidable energy diverting layer of the helmet in accordance with an illustrative embodiment.

In addition to the magnetic material(s) which are used to secure the slidable energy diverting layer 205 to the helmet 200, chamfers can be used to help keep the slidable energy diverting layer 205 in place or registered (i.e., mounted to the helmet as shown in FIG. 2A) during normal use of the helmet. Specifically, the chamfers act to help secure (or key) the slidable energy diverting layer 205 to the helmet 200 such that the layer 205 does not slide during normal use. FIG. 3A depicts the helmet 200 along with a close-up cross-sectional view of a portion of the helmet that extends in between two vents of the helmet in accordance with an illustrative embodiment. FIG. 3B depicts the helmet 200 along with a close-up view of a portion of the helmet that extends in between two ribs of the slidable energy diverting layer 205 of the helmet in accordance with an illustrative embodiment.

As shown in FIGS. 3A and 3B, the energy absorbing layer 210 of the helmet 200 includes chamfered edges 305 that are angled to receive angled extensions 310 that extend from the slidable energy diverting layer 205 of the helmet 200. As such, in addition to forming the exterior of the helmet 200, the chamfering allows the slidable energy diverting layer 205 of the helmet to extend into one or more helmet vents to ensure proper fit of the slidable energy diverting layer 205 onto the helmet. In addition to having chamfered edges along one or more vents of the helmet, the energy absorbing layer 210 can include chamfered edges along at least a portion of a bottom edge 315 of the helmet. In such an embodiment, the slidable energy diverting layer can include one or more angled extensions that are angled to match (i.e., mate with) the portion(s) of the bottom edge 315 of the helmet that are chamfered to help register the slidable energy diverting layer to the helmet during normal use. In another embodiment, the angled extensions 310 can clip into detents formed into the energy absorbing layer 210.

Figure 3C:
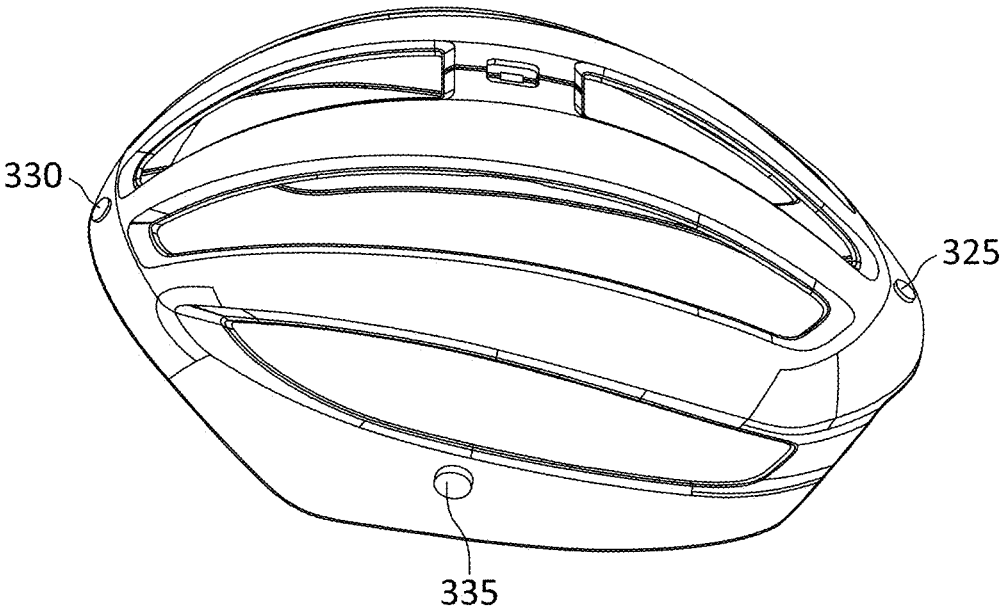
FIG. 3C depicts an alternative embodiment, in which magnets are mounted along adjacent to the bottom edge of the helmet in accordance with an illustrative embodiment.

FIG. 3C depicts an alternative embodiment, in which magnets are mounted along adjacent to the bottom edge of the helmet in accordance with an illustrative embodiment. Specifically, FIG. 3C shows a slidable energy diverting layer that includes a first magnet 325, a second magnet 330, a third magnet 335, and a fourth magnet (not visible) positioned spread out along a bottom of the energy diverting layer, at the polar extremities. The first magnet 325 is positioned at a front of the helmet, the second magnet 330 is positioned at the rear of the helmet, the third magnet 335 is on a first side of the helmet, and the fourth magnet is on a second side (opposite the first side) of the helmet. In an alternative embodiment, fewer or additional magnets may be used. Additionally, in other embodiments, the positions of the magnets on the slidable energy diverting layer can be changed.

Figure 4A:
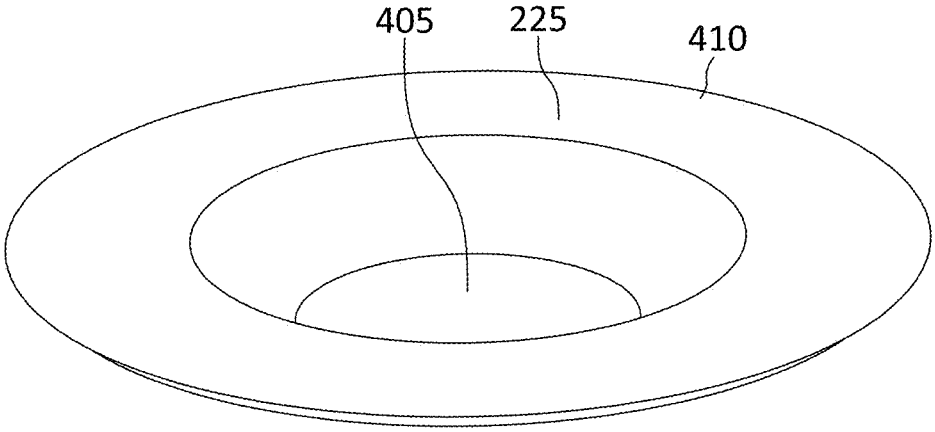
FIG. 4A is a perspective view of a pocket used to hold a magnet in accordance with an illustrative embodiment.
Figure 4B:
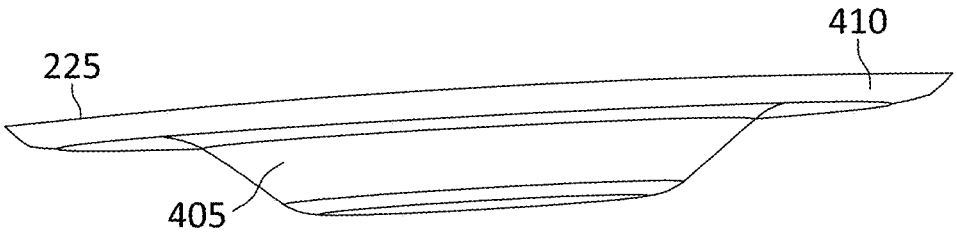
FIG. 4B is a side view of the pocket in accordance with an illustrative embodiment.

In an illustrative embodiments, the magnet(s) are mounted to the slidable energy diverting layer using pocket (s) that are mounted to the interior surface of the slidable energy diverting layer. FIG. 4A is a perspective view of a pocket 225 used to hold a magnet in accordance with an illustrative embodiment. FIG. 4B is a side view of the pocket 225 in accordance with an illustrative embodiment. In one embodiment, the pocket 225 can be formed using thermoforming or injection molding, and can be made from polycarbonate, carbon fiber material, or a different thermoplastic. Alternatively, a different manufacturing technique and/or material may be used to form the pocket 225. In another embodiment, the pocket 225 can be integrally formed into a cage embedded in the energy absorbing layer 210.

As shown, the pocket 225 includes a receptacle 405 that is sized to receive a magnet and a flange 410 that surrounds the receptacle 405. In an illustrative embodiment, the pocket 225 is mounted to the interior surface of the slidable energy diverting layer 205. The pocket 225 can be mounted to the interior surface of the slidable energy diverting layer 205 using an adhesive (e.g., 3M® double-sided adhesive (e.g., VHB4930), cyanoacrylate glue, contact cement, epoxy, CA glue, etc.), tape (e.g., thermoplastic polyurethane (TPU) tape), or any other method such as rivets. Specifically, the adhesive, tape, etc. can be applied to a top surface of the flange 410 (i.e., the surface of the flange 410 that is visible in FIG. 4A) such that the top surface of the flange 410 is adjacent to the interior surface of the slidable energy diverting layer.

Figure 4C:
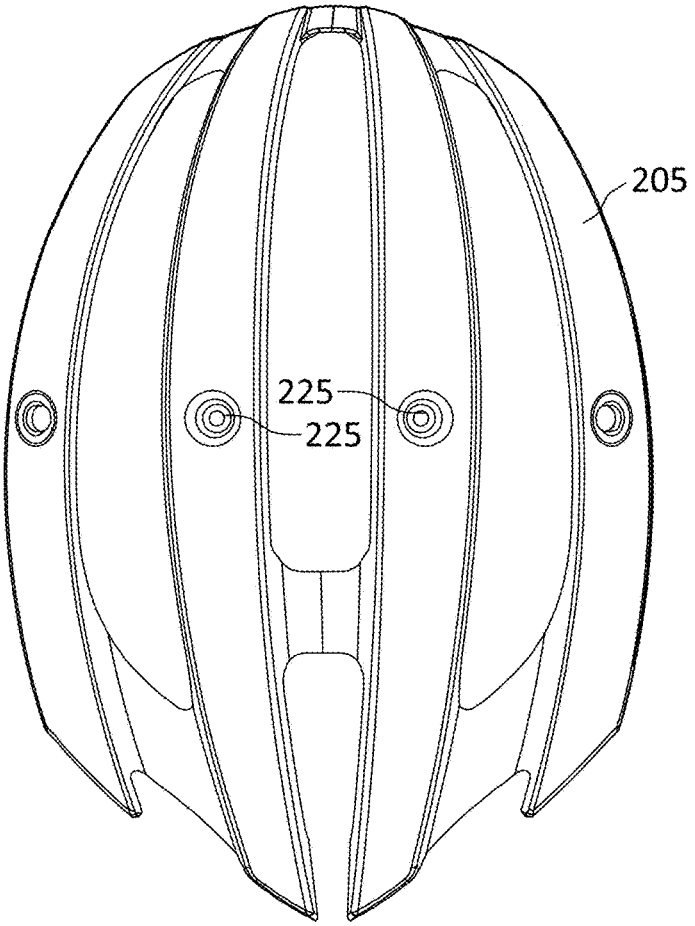
FIG. 4C depicts a first view of pockets mounted to an interior surface of the slidable energy diverting layer in accordance with an illustrative embodiment.
Figure 4D:
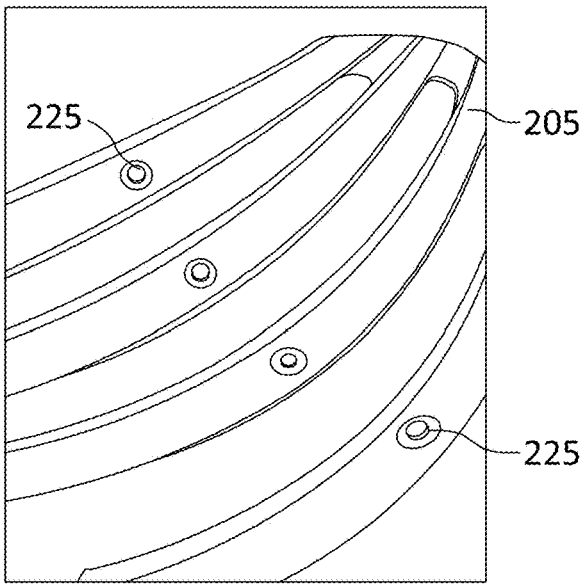
FIG. 4D depicts a second view of pockets mounted to an interior surface of the slidable energy diverting layer in accordance with an illustrative embodiment.

FIG. 4C depicts a first view of pockets 225 mounted to an interior surface of the slidable energy diverting layer 205 in accordance with an illustrative embodiment. FIG. 4D depicts a second view of pockets 225 mounted to an interior surface of the slidable energy diverting layer 205 in accordance with an illustrative embodiment. In FIGS. 4C and 4D, the pockets 225 are shown mounted at a center location of each of the ribs that form the energy diverting layer 205. However, as discussed above, the pockets 225 can be mounted anywhere on the interior surface of the slidable energy diverting layer 205. Similarly, although 4 pockets 225 are shown, a different number of pockets 225 can be used in alternative embodiments.

Figure 4E:
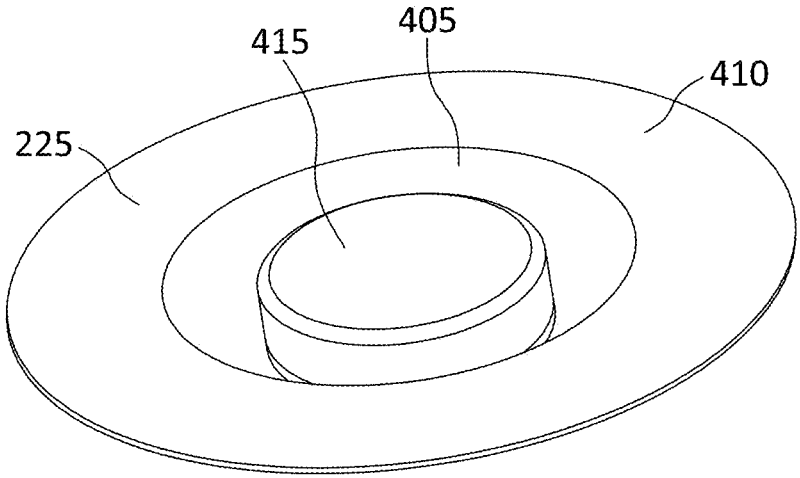
FIG. 4E depicts the pocket with a magnet positioned in the receptacle of the pocket in accordance with an illustrative embodiment.
Figure 4F:
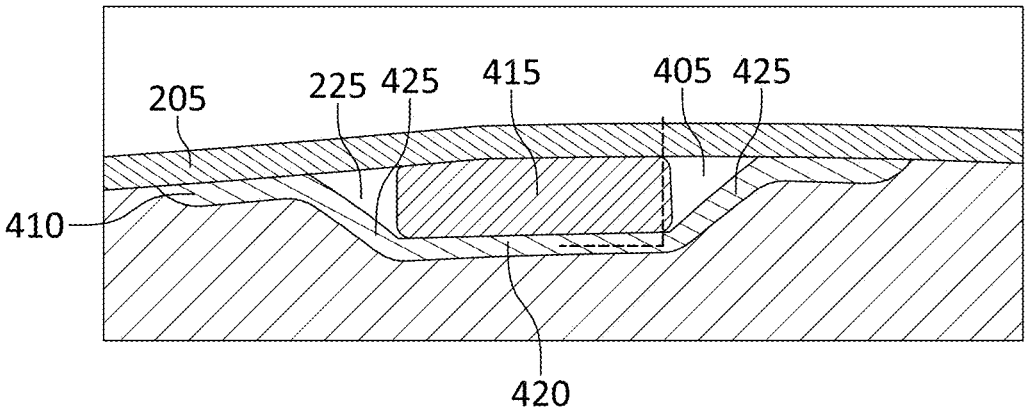
FIG. 4F is a cross-sectional view of a pocket and magnet mounted to the interior surface of the slidable energy diverting layer in accordance with an illustrative embodiment.

FIG. 4E depicts the pocket 225 with a magnet 415 (or magnetic material) positioned in the receptacle 405 of the pocket 225 in accordance with an illustrative embodiment. The magnet(s) 415 mounted in the pocket(s) 225 can be referred to as primary magnet(s) (or primary magnetic material(s)). FIG. 4F is a cross-sectional view of a pocket 225 and primary magnet 415 mounted to the interior surface of the slidable energy diverting layer 205 in accordance with an illustrative embodiment. As shown, the pocket 225 is sized such that the primary magnet 415 sits flush against the interior surface of the slidable energy diverting layer 205. In one embodiment, the primary magnet 415 is secured to a bottom wall 420 of the pocket 225 using a tape, adhesive, or other method to prevent movement of the primary magnet 415 within the pocket. In an alternative embodiment, the magnet 415 may not be secured to the bottom wall 420 of the pocket 225 and is held in place via a friction fit. The primary magnet 415 is depicted as a flattened cylinder that has a circular shape in cross-section. Similarly, the bottom wall 420 of the pocket 225 has a circular shape to receive a bottom end of the primary magnet 415. In alternative embodiments, a different shape can be used for both the primary magnet 415 and the bottom wall 420 of the pocket 225, such as square, rectangular, triangular, etc.

As best shown in FIGS. 4B and 4F, the receptacle 405 of the pocket 225 is formed to have walls 425 that are angled greater than 90 degrees relative to the bottom wall 420 of the receptacle 405 in the pocket 225. As such, each of the walls 425 acts as a ramp that mates with an angled surface formed in the intermediate layer and allows the slidable energy diverting layer to slide from the intermediate layer upon impact to the helmet. FIG. 4F also includes dashed lines to depict a 90 degree angle relative to the bottom wall 420 of the receptacle 405. It can be seen that the angle of each wall 425 is greater than 90 degrees relative to the bottom wall 420.

Figure 4G:
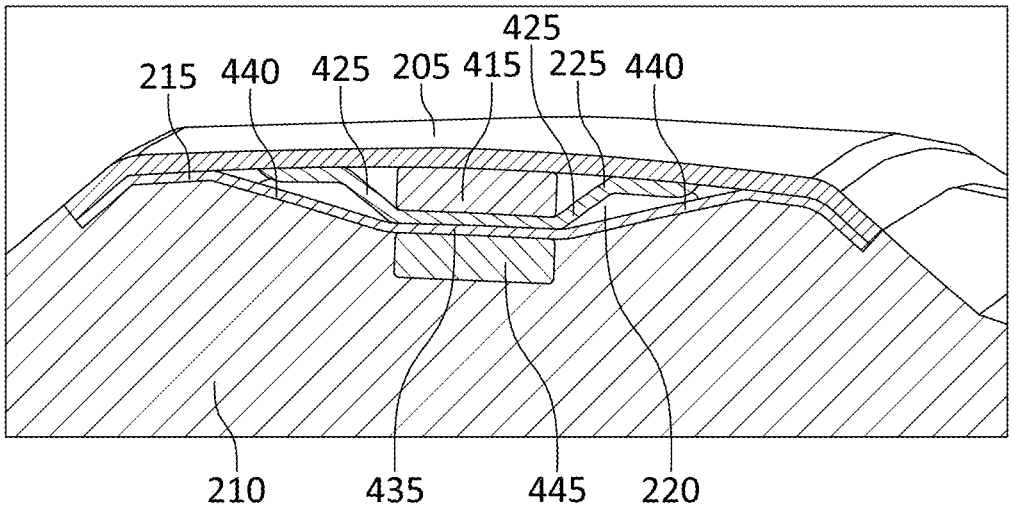
FIG. 4G is a cross-sectional view that depicts a pocket to cavity interface between helmet layers in accordance with an illustrative embodiment.

FIG. 4G is a cross-sectional view that depicts a pocket to cavity interface between helmet layers in accordance with an illustrative embodiment. As shown, the pocket 225 is mounted to an interior surface of the slidable energy diverting layer 205. The pocket includes the primary magnet 415. Formed in the intermediate layer 215 is a cavity 220 that is sized to receive the pocket 225. The cavity 220 includes a bottom wall 435 and sidewalls 440. As shown, the sidewalls 440 are angled relative to the bottom wall 435 at an angle greater than 90 degrees. Dashed lines are used to depict a 90 degree angle relative to the bottom wall 435. The sidewalls 440 reflect the angled walls 425 of the pocket 225 and enable the angled walls 425 to ramp out of the cavity 220 in response to an impact to the helmet. Similarly, the energy absorbing layer 210 is shaped (e.g., thermoformed) to receive the cavity 220. A secondary magnet (or secondary magnetic material) 445 is mounted underneath the bottom wall 435 of the cavity 220 (i.e., in the energy absorbing layer 210). In an illustrative embodiment, the primary magnet 415 and the secondary magnet 445 can be the same type of magnet, have the same size, and have the same shape. Alternatively, the primary and secondary magnets may differ from one another. For example, in one embodiment, the secondary magnet 445 can be a heat resistant magnet to help ensure that the magnet does not demagnetize during a heat intensive injection molding of the energy absorbing layer into which the secondary magnet 445 is placed. The primary magnet 415 may not be heat resistant because it is not subjected to excessive heat during manufacturing. As shown, during normal use of the helmet, the magnet 415 embedded in the pocket 225 of the slidable energy diverting layer 205 is aligned with and positioned over the secondary magnet 445. The primary magnet 415 and the secondary magnet 445 are oriented to attract to one another, thereby securing the slidable energy diverting layer 205 to the intermediate layer during normal use.

Figure 4H:
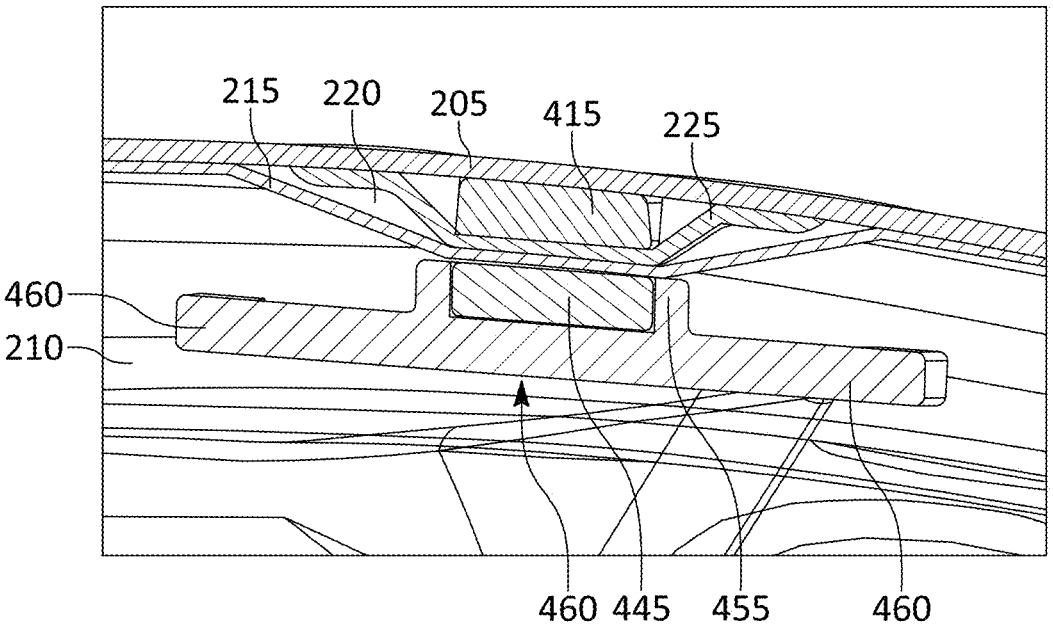
FIG. 4H is a cross-sectional view showing how the secondary magnet incorporated into the energy absorbing layer is mounted in accordance with an illustrative embodiment.
Figure 4I:
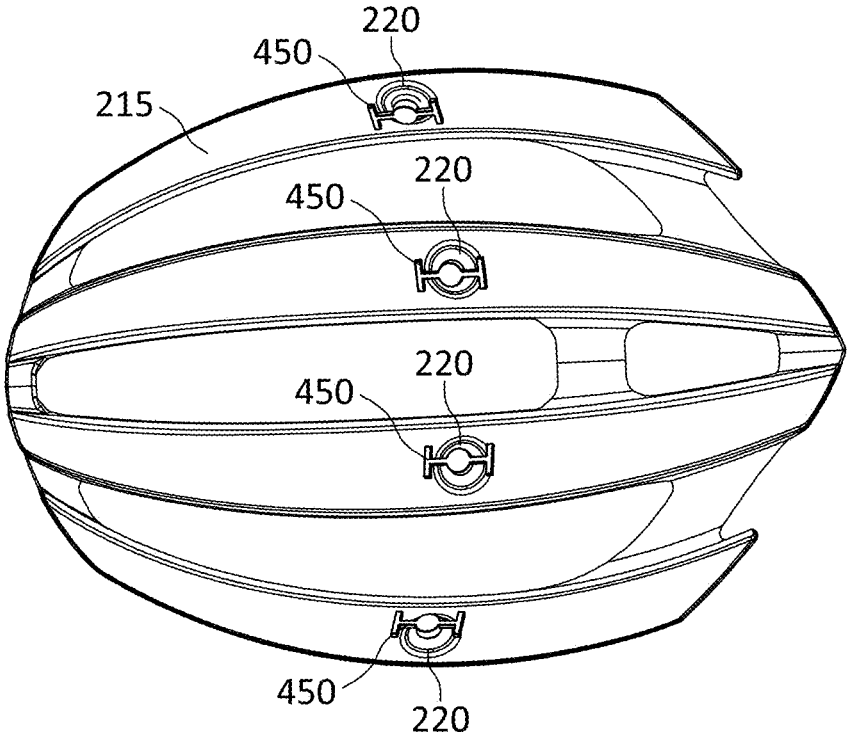
FIG. 4I depicts placement of the magnet holders relative to the positions of the cavities formed in the intermediate layer in accordance with an illustrative embodiment.

FIG. 4H is a cross-sectional view showing how the secondary magnet 445 incorporated into the energy absorbing layer is mounted in accordance with an illustrative embodiment. As shown, the secondary magnet 445 is mounted in a magnet holder (or anchor) 450 that includes a magnet receptacle 455 and arms 460 that extend from the magnet receptacle. In one embodiment, the secondary magnet 445 can be glued, taped, or otherwise secured to the magnet receptacle 455. In an illustrative embodiment, the magnet holder 450 is embedded in the energy absorbing layer 210 during formation of the energy absorbing layer 210. Alternatively, the magnet holder 450 may be adhered to the energy absorbing layer 210 (e.g., using glue, tape, etc.) after formation of the energy absorbing layer 210. The magnet holder 450 is positioned such that it is concentric to the cavity formed in the intermediate layer 215. FIG. 4I depicts placement of the magnet holders 450 relative to the positions of the cavities 220 formed in the intermediate layer 215 in accordance with an illustrative embodiment.

Figure 4J:
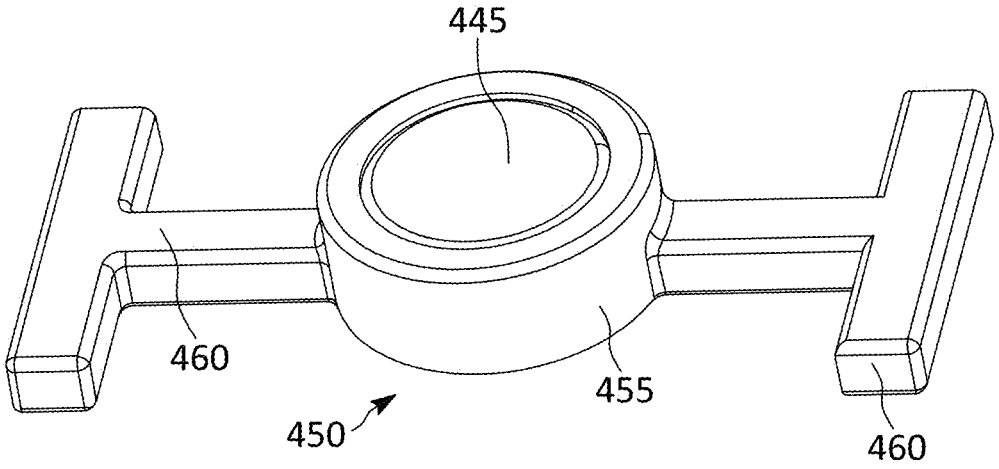
FIG. 4J is a plan perspective view of the magnet holder in accordance with an illustrative embodiment.

FIG. 4J is a plan perspective view of the magnet holder 450 in accordance with an illustrative embodiment. As shown, each of the arms 460 of the magnet holder 450 has a t-shape that extends from a cylindrical magnet receptacle 455. Alternatively, the arms 460 can have a different shape such as an s-shape, an f-shape, a straight line, an e-shape, etc. Similar to the primary magnet 415, in alternative embodiments the secondary magnet 445 (and the magnet receptacle 455) can have a different cross-sectional shape, such as square, rectangular, triangular, etc. In another alternative embodiment, the magnet holder 450 may not be used. For example, in one embodiment, a magnet receptacle can be formed directly in the energy absorbing layer and the second magnet can be adhered (or otherwise mounted) directly to the magnet receptacle formed in and by the energy absorbing layer.

Figure 4K:
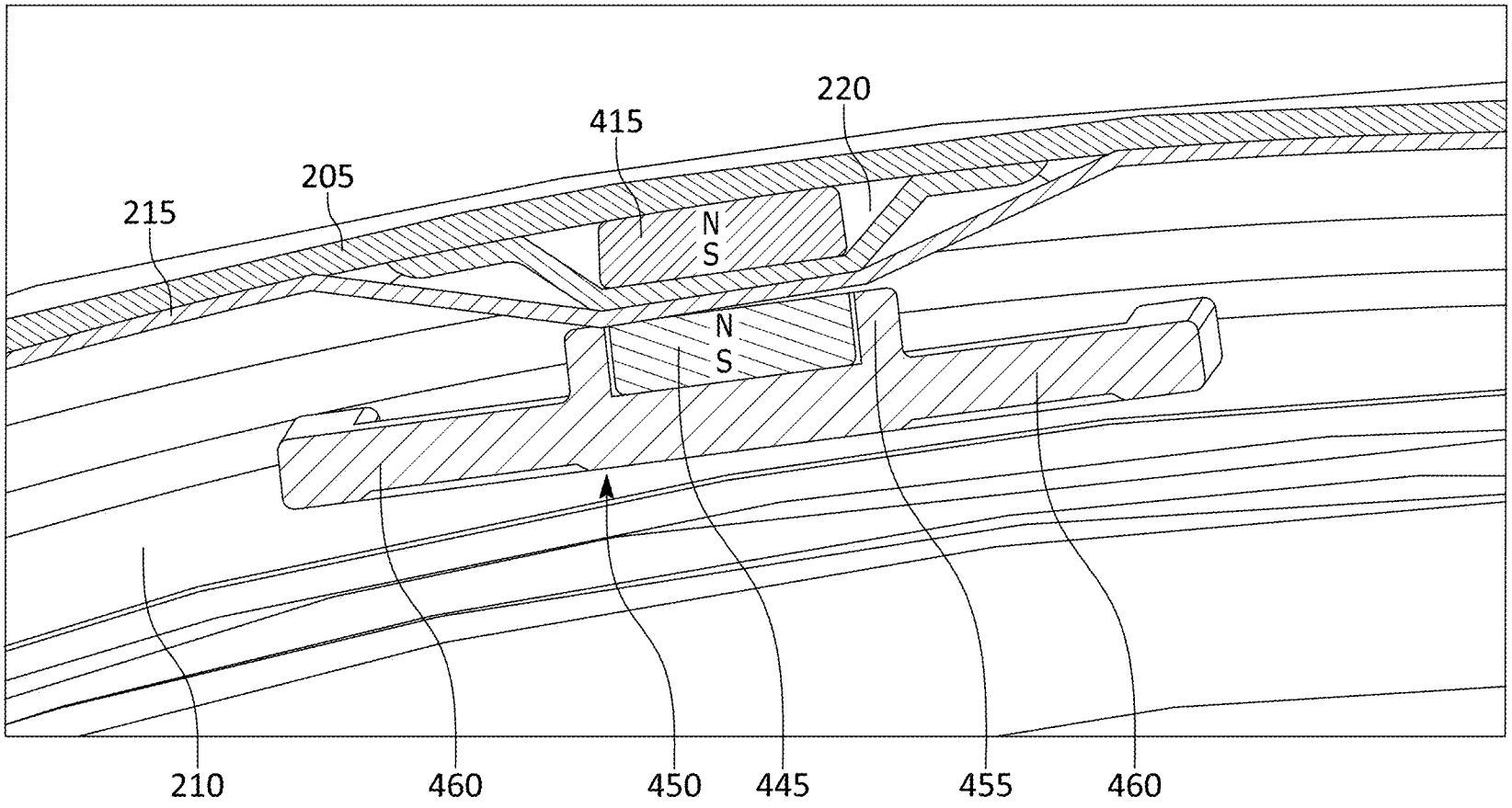
FIG. 4K depicts orientation of the magnets in accordance with an illustrative embodiment.

As discussed above, the primary magnet 415 and the secondary magnet 445 are attracted to one another to keep the slidable energy diverting layer attached to the rest of the helmet during normal use. In an illustrative embodiment, the magnetic strength of the primary magnet 415 and the second magnet 445 can be between 1 pound of force and 3 pounds of force (i.e., ~4.45 Newtons--~13.34 Newtons). Alternatively, magnetic strengths outside of this range may be used. Various magnetic strengths can be used based on the positioning and number of the magnets. As also discussed, a plurality of primary magnets 415 and a plurality of secondary magnets 445 can be used to establish a corresponding plurality of attachment points for the slidable energy diverting layer. FIG. 4K depicts orientation of the magnets in accordance with an illustrative embodiment. In an illustrative embodiment, each of the secondary magnets 445 is situated in the magnet holder 450 so that the outwardly facing polarity is opposite of the inwardly facing polarity of each of the magnets 415, creating a magnetic attraction. In the embodiment of FIG. 4K, the primary magnet 415 is oriented such that its South pole is adjacent to the north pole of the secondary magnet 445. Alternatively, the polarities of both magnets can be reversed to create the attraction. The attraction creates a bond between the slidable energy diverting layer and the intermediate layer, and thus the rest of the helmet. The magnetic attraction keeps the slidable energy diverting layer from moving or rattling during regular use of the helmet. In another embodiment, the primary magnet 415 and the secondary magnet 445 can be molded magnets (dense magnetic powders blended with a variety of polymer base materials) and formed into respective cone shapes. The molded magnets can be adhered to the slidable energy diverting layer 205 and the intermediate layer 215/the energy absorbing layer 210, respectively.

Figure 4L:
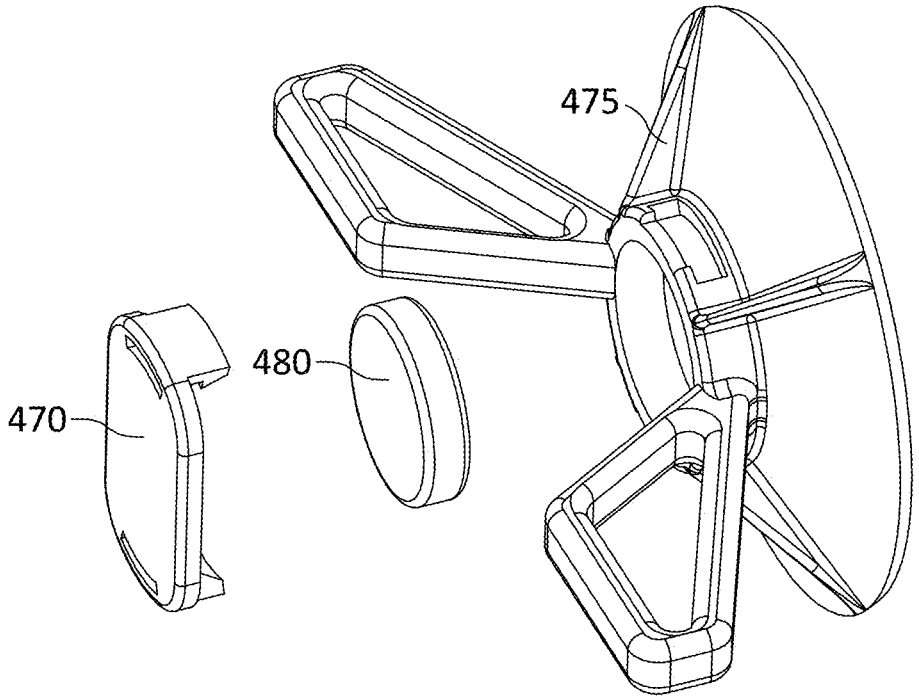
FIG. 4L is a rear perspective view of a magnetic holder assembly in accordance with another illustrative embodiment.
Figure 4M:
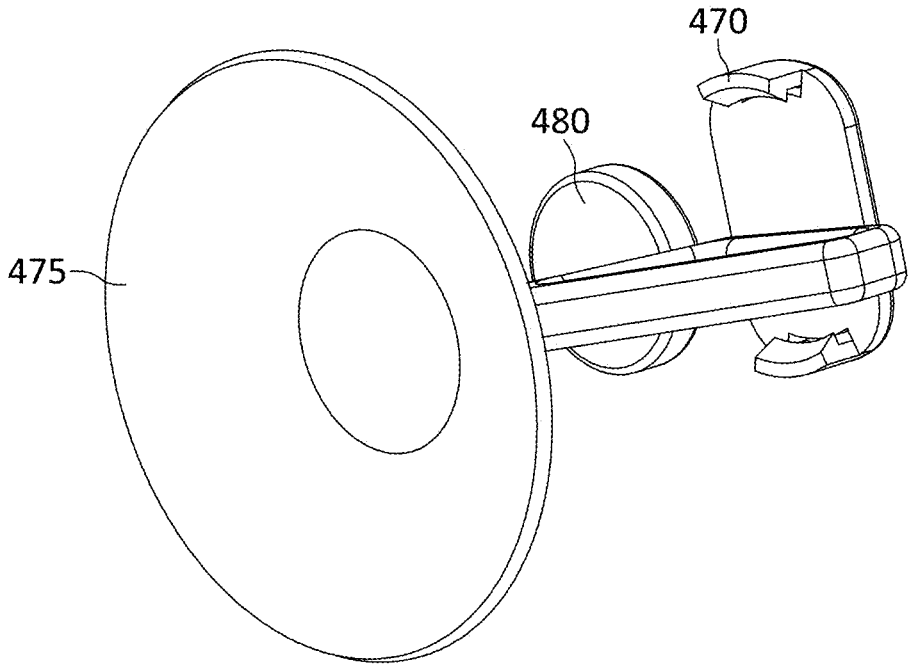
FIG. 4M is a front perspective view of the magnetic holder assembly of FIG. 4L in accordance with an illustrative embodiment.

FIG. 4L is a rear perspective view of a magnetic holder assembly in accordance with another illustrative embodiment. FIG. 4M is a front perspective view of the magnetic holder assembly of FIG. 4L in accordance with an illustrative embodiment. In one embodiment, the magnetic holder assembly of FIG. 4L can be used to attach magnets directly to the energy absorbing layer without the use of an intermediate layer. In such an embodiment, one or more layers of paint or other coating can be applied to the energy absorbing layer to reduce friction.

The embodiment of FIGS. 4L and 4M includes a cap 470, a magnet anchor 475, and a magnet 480 that fits between the cap 470 and the magnet anchor 475. The cap 470, the magnet 480, and a portion of the magnet anchor 475 can be embedded in the energy absorbing layer 210 during formation of the energy absorbing layer 210. Alternatively, the cap 470 and/or the magnet anchor 475 may be adhered to the energy absorbing layer 210 (e.g., using glue, tape, etc.) after formation of the energy absorbing layer 210. As shown, the magnet anchor 475 includes wings that help it stay secured to the energy absorbing layer 210. In an illustrative embodiment, the cap 470 snaps onto a magnet receptacle formed on a rear surface of the magnet anchor 475 such that the magnet 480 is securely mounted within the magnet receptacle. A front surface of the magnet anchor 475 is smooth and finished because it is an exposed surface.

Figure 4N:
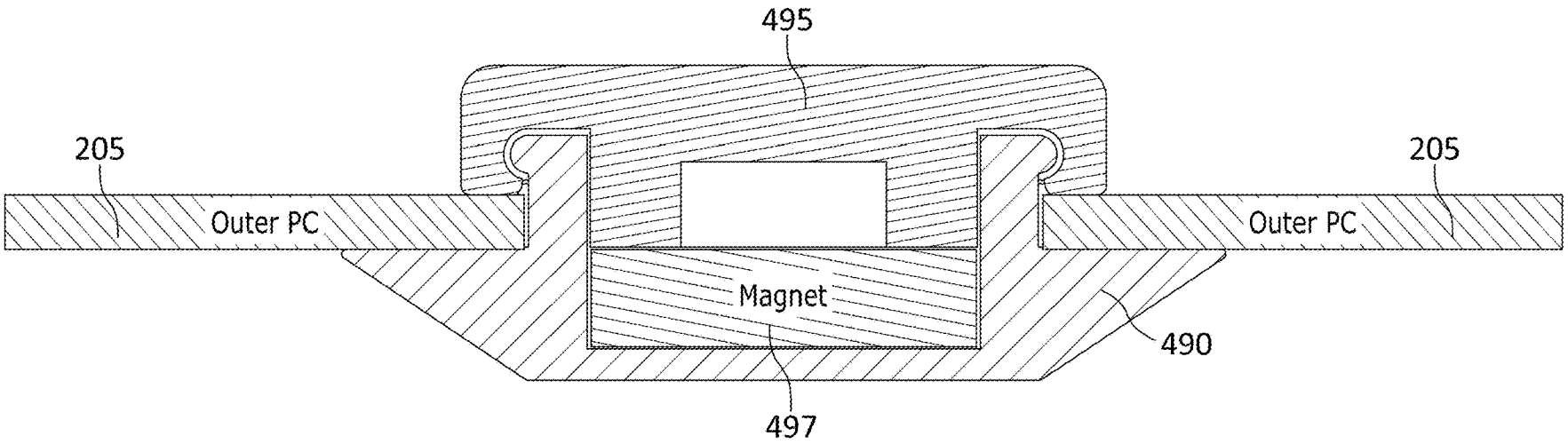
FIG. 4N depicts use of a rivet assembly to mount a magnet to the slidable energy diverting layer 205 in accordance with an illustrative embodiment.

FIG. 4N depicts use of a rivet assembly to mount a magnet to the slidable energy diverting layer 205 in accordance with an illustrative embodiment. An opening (or hole) is formed in the slidable energy diverting layer 205 and a rivet bottom (or magnet holder) 490 mounts through a bottom of the opening. The rivet bottom 490 includes tabs that extend through the opening past an outer surface of the slidable energy diverting layer 205. These tabs are sized and positioned to receive a rivet top 495 that securely mounts to the rivet bottom 490 via a snap-fit. A magnet 497 is secured between the rivet bottom 490 and the rivet top 495, and is used to help register the slidable energy diverting layer 205 to the rest of the helmet, as discussed herein. The embodiment of FIG. 4N can be used with or without an adhesive to help secure the rivet bottom 490 to the slidable energy diverting layer 205 and/or to secure the rivet top 495 to the rivet bottom 490.

Figure 5A:
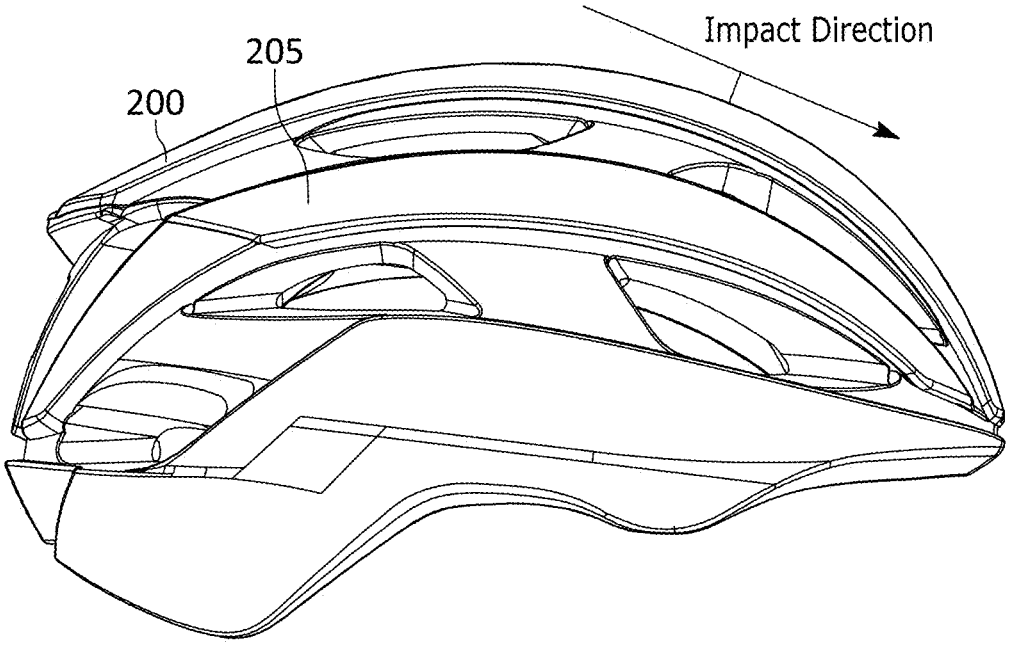
FIG. 5A depicts a helmet with a slidable energy diverting layer along with an indication of a typical direction of impact in accordance with an illustrative embodiment.
Figure 5B:
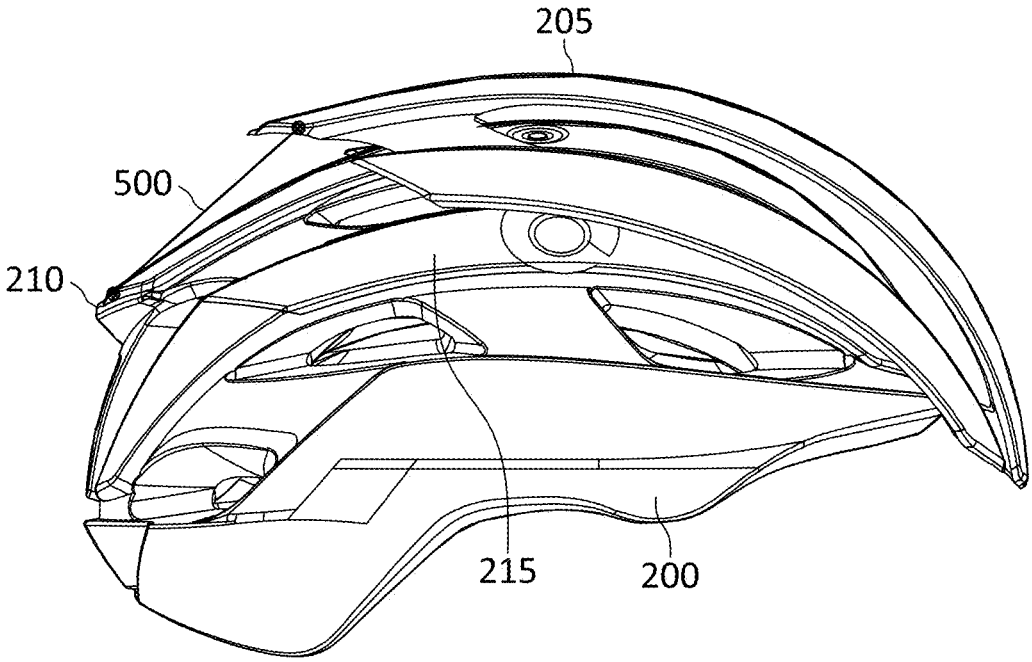
FIG. 5B depicts the helmet with the slidable energy diverting layer slid from the intermediate layer of the helmet and secured by a tether in accordance with an illustrative embodiment.

In another illustrative embodiment, the slidable energy diverting layer 205 can be connected to the helmet by one or more tethers such that the slidable energy diverting layer does not fully separate from the helmet upon impact. The one or more tethers can be used to help ensure that movement of the slidable energy diverting layer is controlled and limited when the slidable energy diverting layer moves. FIG. 5A depicts a helmet with a slidable energy diverting layer 205 along with an indication of a typical direction of impact in accordance with an illustrative embodiment. FIG. 5B depicts the helmet 200 with the slidable energy diverting layer 205 slid from the intermediate layer of the helmet and registered by a tether 500 in accordance with an illustrative embodiment.

In one embodiment, the tether 500 can be an elastic cord, band, or strap that has a limited range of motion (i.e., stretch), and this limited range of motion is large enough to allow the slidable energy diverting layer 205 to slide from the helmet and short enough to keep the slidable energy diverting layer 205 out of range of the user's face. Alternatively, the tether 500 can be inelastic. The tether 500 can be made from hemp cord, natural rubber, wax cord, ripstop cord, thick (e.g., 3 mm) elastic cord (e.g., elastodiene), thin (e.g., 1.5 mm) elastic cord, etc. Additionally, the tether 500 can be pre-tensioned or un-tensioned when mounted, depending on the embodiment. The tether 500 can be attached to the slidable energy diverting layer 205 and to the energy absorbing layer 210 in one embodiment. Alternatively, the tether 500 can be attached to intermediate layer 215 in some embodiments. In one embodiment, the tether 500 runs through a tube that is positioned within the energy absorbing layer 210. The tube can extend fully through the energy absorbing layer 210 such that one end of the tether 500 is attached to an interior surface of the energy absorbing layer 210.

Figure 5D:
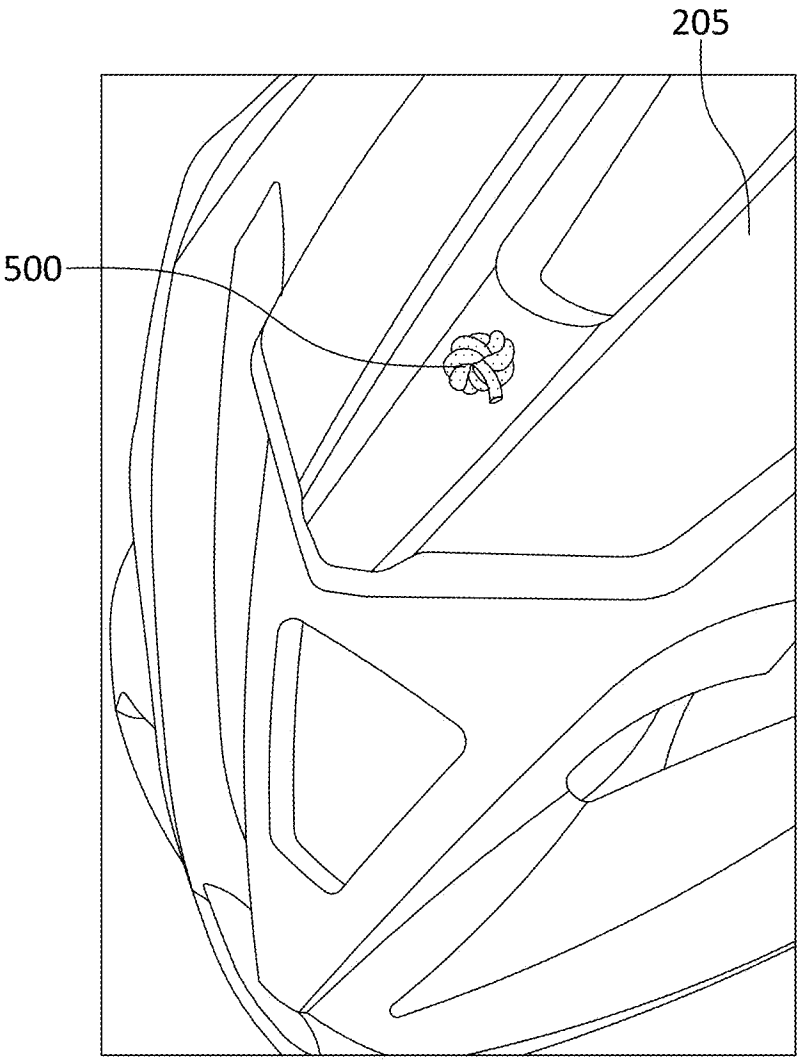
FIG. 5D depicts an end of the tether mounted to an exterior surface of the slidable energy diverting layer in accordance with an illustrative embodiment.
Figure 5C:
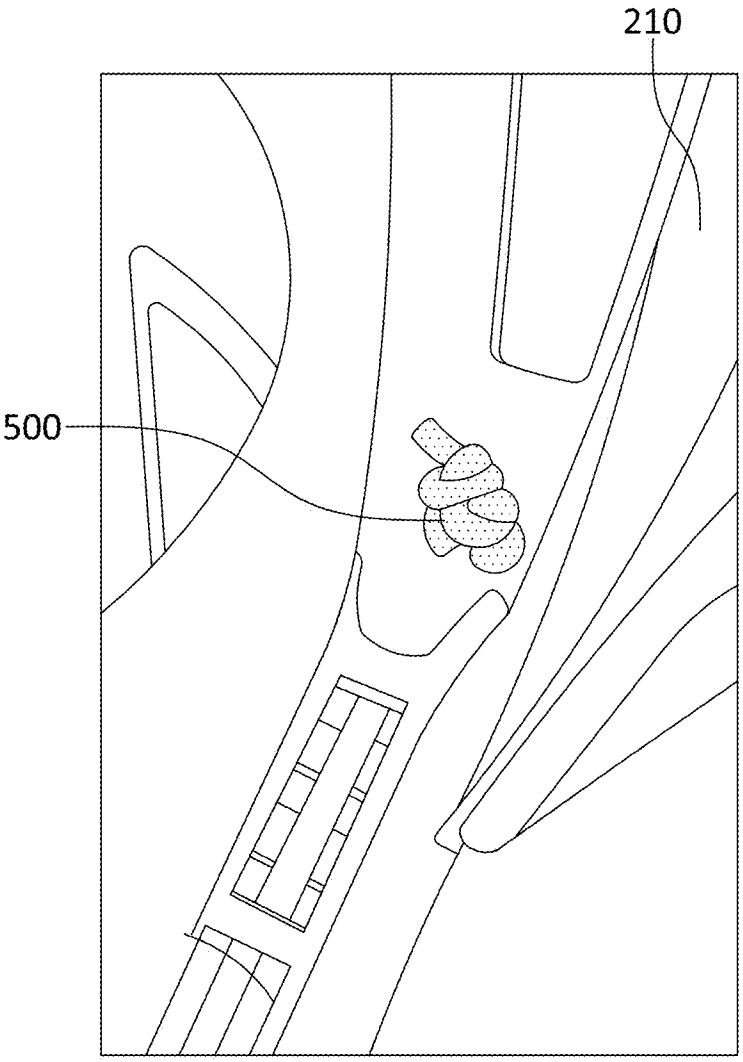
FIG. 5C depicts an end of the tether mounted to an interior surface of the energy absorbing layer in accordance with an illustrative embodiment.

FIG. 5C depicts an end of the tether 500 mounted to an interior surface of the energy absorbing layer 210 in accordance with an illustrative embodiment. FIG. 5D depicts an end of the tether 500 mounted to an exterior surface of the slidable energy diverting layer 205 in accordance with an illustrative embodiment. In the embodiment shown, the ends of the tether 500 pass through holes in the energy absorbing layer 210 and the slidable energy diverting layer 205, and are held in place with knots that prevent the tether 500 from passing back through the holes. In alternative embodiments, knots may not be used. For example, a glue, tape, or other adhesive can be used to secure the tether 500 to an interior surface of the slidable energy diverting layer and to an exterior surface of the intermediate layer 215 and/or the energy absorbing layer 210.

Figure 5F:
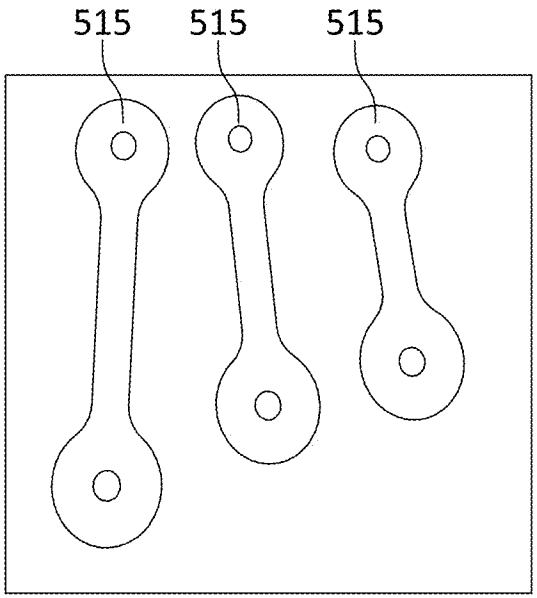
FIG. 5F depicts example elastic tethers in accordance with an illustrative embodiment.
Figure 5E:
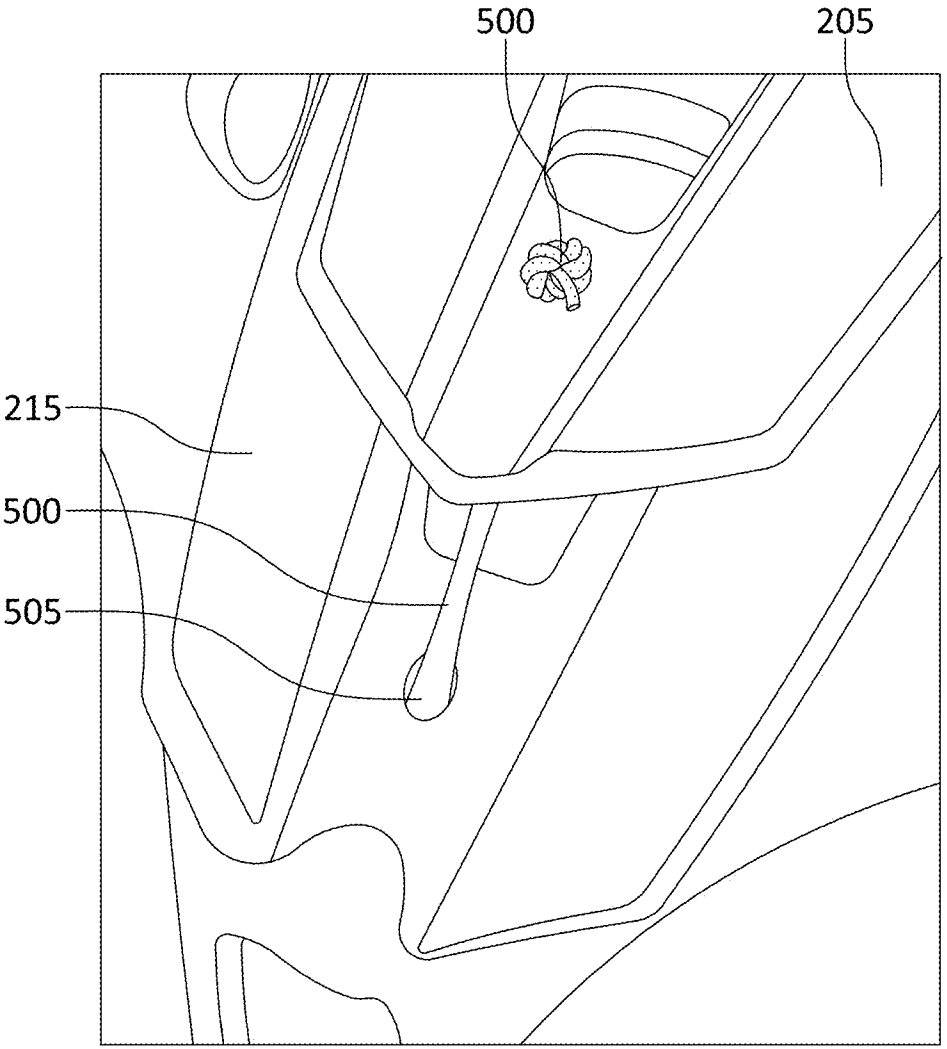
FIG. 5E shows the slidable energy diverting layer slid from the helmet and held in place by the tether in accordance with an illustrative embodiment.

FIG. 5E shows the slidable energy diverting layer slid from the helmet and held in place by the tether 500 in accordance with an illustrative embodiment. As best shown in FIG. 5E, the tether 500 passes through a tube 505 embedded in the energy absorbing layer 210. The tube 505 allows the tether 500 to deform and move without obstruction and prevents rubbing on the energy absorbing layer 210. In the event of impact to the helmet, the slidable energy diverting layer 205 slides relative to the rest of the helmet. The tether 500 stretches to a set limit and prevents the slidable energy diverting layer 205 from sliding any further.

Figure 5H:
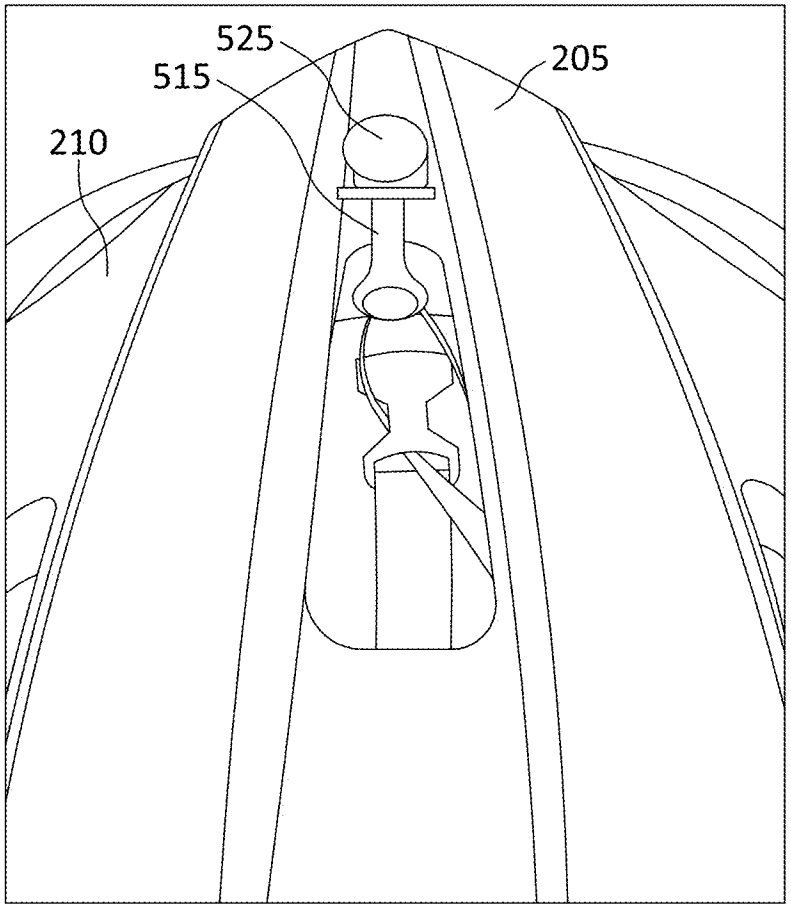
FIG. 5H depicts an elastic tether mounted to the slidable energy diverting layer and to the energy absorbing layer via a snap fit connection in accordance with an illustrative embodiment.
Figure 5G:
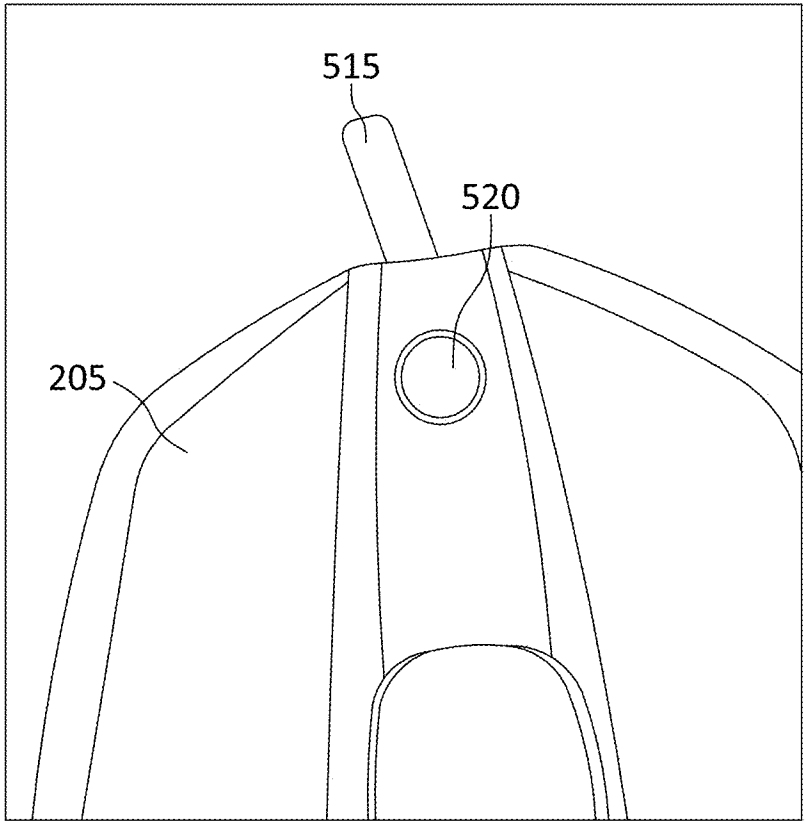
FIG. 5G depicts an elastic tether mounted to the slidable energy diverting layer via a rivet in accordance with an illustrative embodiment.
Figure 5I:
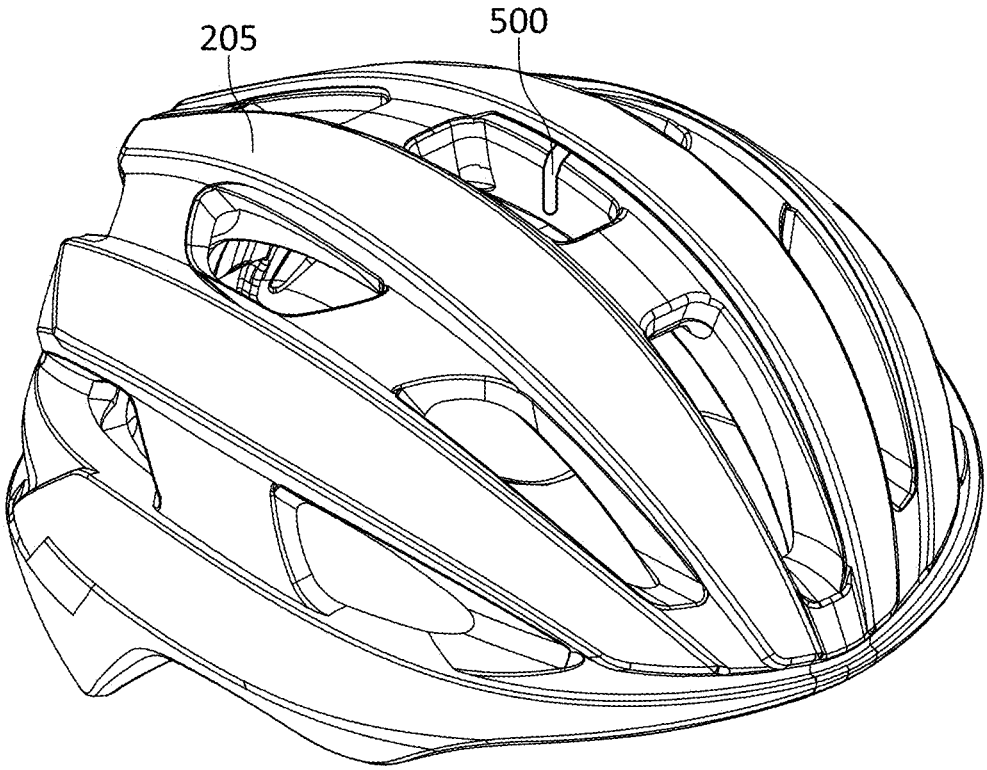
FIG. 5I shows a helmet in which the tether is formed as a tab that extends from and is integrally formed with the slidable energy diverting layer in accordance with an illustrative embodiment.

In another embodiment, instead of an elastic cord, the tether 500 can be formed by an elastic tether 515. FIG. 5F depicts example elastic tethers 515 in accordance with an illustrative embodiment. Each end of the elastic tethers 510 is an enlarged circle shape with a circular through hole. The through holes in the ends of the elastic tether are used to secure the elastic tether to the energy absorbing layer, the slidable energy diverting layer, and/or the intermediate layer. For example, the elastic tethers can be attached by forcing a rivet or snap fit tether into the through holes in the enlarged circular ends of the elastic tether. The rivet or snap fit fastener is mounted to each of the energy absorbing layer 210, the slidable energy diverting layer 205, and/or the intermediate layer 215, depending on the embodiment. FIG. 5G depicts an elastic tether 515 mounted to the slidable energy diverting layer 205 via a rivet 520 in accordance with an illustrative embodiment. FIG. 5H depicts an elastic tether 515 mounted to the slidable energy diverting layer 205 and to the energy absorbing layer 210 via a snap fit connection 525 in accordance with an illustrative embodiment. Specifically, a snap basket is embedded into the EPS of the energy absorbing layer 210. A snap fit plug is placed through the circular hole in the tether and snapped into the snap basket. The other end of the tether is attached to the slidable energy diverting layer 205 via a through hole in the layer, and then is attached in place. Different configurations can be used in alternative embodiments.

While the above-discussed embodiments of FIG. 5 depict a single tether to restrict movement of the slidable energy diverting layer upon sliding from the helmet, in alternative embodiments a plurality of tethers can be used. For example, 2, 3, 4, 5, 6, etc. tethers may be used to secure the slidable energy diverting layer at a plurality of distinct locations. The plurality of tethers can be configured and/or located to control the movement of slidable energy diverting layer in multiple dimensions. In another alternative embodiment, instead of elastic tether(s) or cords, the tether(s) can be integrally formed as part of the slidable energy diverting layer 205. For example, the tether(s) can be formed as one or more tabs or flanges that extend from an outer edge or the interior surface of the slidable energy diverting layer 205. Ends of the one or more tabs or flanges can be embedded into or adhered to the energy absorbing layer to secure the slidable energy diverting layer 205 to the energy absorbing layer 210 and thereby limit movement of the slidable energy diverting layer 205 upon sliding. Alternatively, the ends of the one or more tabs or flanges can be adhered or otherwise mounted to the intermediate layer 215. FIG. 5I shows a helmet in which the tether 500 is formed as a tab that extends from and is integrally formed with the slidable energy diverting layer 205 in accordance with an illustrative embodiment. In alternative embodiments, a plurality of the tethers 500 can be used.

Figure 5J:
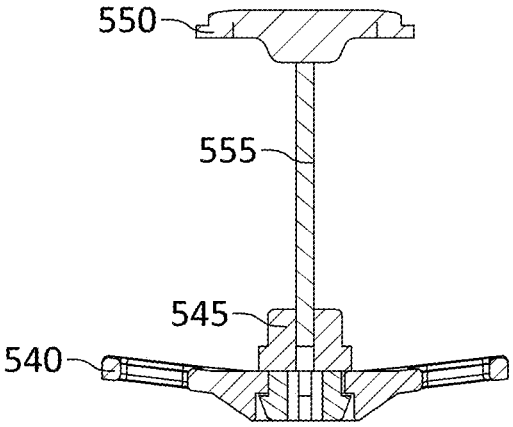
FIG. 5J depicts a cross-sectional view of a tether assembly in accordance with another illustrative embodiment.
Figure 5K:
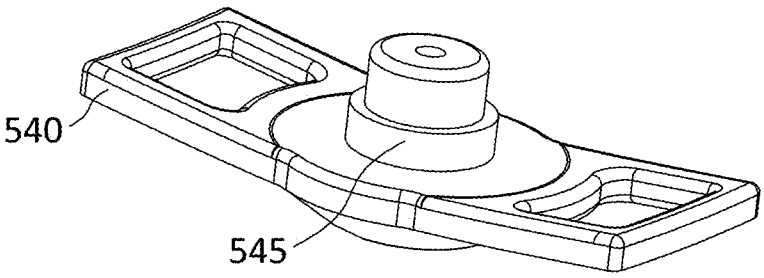
FIG. 5K is a perspective view of the tether anchor of FIG. 5J in accordance with an illustrative embodiment.
Figure 5L:
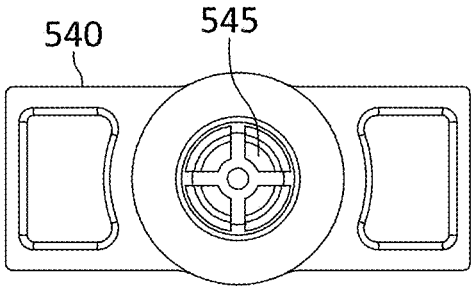
FIG. 5L is a bottom view of the tether anchor of FIG. 5J in accordance with an illustrative embodiment.

FIG. 5J depicts a cross-sectional view of a tether assembly in accordance with another illustrative embodiment. FIG. 5K is a perspective view of the tether anchor of FIG. 5J in accordance with an illustrative embodiment. FIG. 5L is a bottom view of the tether anchor of FIG. 5J in accordance with an illustrative embodiment. The tether assembly includes a tether anchor 540, a snap fit plug 545 that mounts within an opening formed in the tether anchor 540, a top cap 550 that mounts to the slidable energy diverting layer 205, and a cord 555 that mounts to both the snap fit plug 545 and to the top cap 550. In an illustrative embodiment, the top cap 550 can be insert molded with the energy diverting layer 205 during production. The tether anchor 540, which includes wings to help keep it in place, can be molded into the energy absorbing layer 210. Alternatively or additionally, an adhesive can be used to secure the top cap 550 to the energy diverting layer 205 and/or the tether anchor 540 to the energy absorbing layer 210.

As shown, the tether anchor 540 includes a central opening that receives the snap fit plug 545, which can be mounted to the tether anchor 540 subsequent to mounting the tether anchor 540 to the helmet. The snap fit plug includes a central opening that receives the cord 555. The top cap 550 also includes an opening that receives the cord 555. In an illustrative embodiment, the cord 555 is overmolded to the top cap 550, and the top cap 550 is positioned to cover an opening in the slidable energy diverting layer to provide an aesthetically pleasing exterior surface of the helmet, and also to prevent debris from entering the helmet. The cord 555 can also be overmolded to the snap fit plug 545. In one embodiment, the cord 555 includes a knot at each end such that the overmolding process results in material that forms the top cap and snap-fit plug being molded around the knots to ensure that the cord 555 does not detach from either the top cap 550 or the snap fit plug 545. In alternative embodiments, instead of overmolding, the cord 555 can be attached to the snap fit plug 545 and/or to the top cap 550 via a friction fit, via an adhesive, etc. The cord 555 can be elastic or inelastic, depending on the embodiment. In one embodiment, the cord 555 can be 25 mm in length, but in alternative embodiments different lengths may be used, such as 12 mm, 15 mm, 20 mm, 30 mm, 35 mm, 40 mm, etc. In an embodiment in which the cord 555 is elastic, the tether can have a length of 20-25 mm at rest and a length of 45-50 mm when stretched out, resulting in cord travel distance of 20-30 mm. Alternatively, a different amount of cord travel/stretch may be used.

In an illustrative embodiment, a single tether can be used to control detachment of the energy diverting layer from the remainder of the helmet. The single tether can be attached at the center of the top of the helmet. Alternatively, 2 or more tethers may be used and/or the tethers can be positioned at different location(s) on the helmet.

Figure 5M:
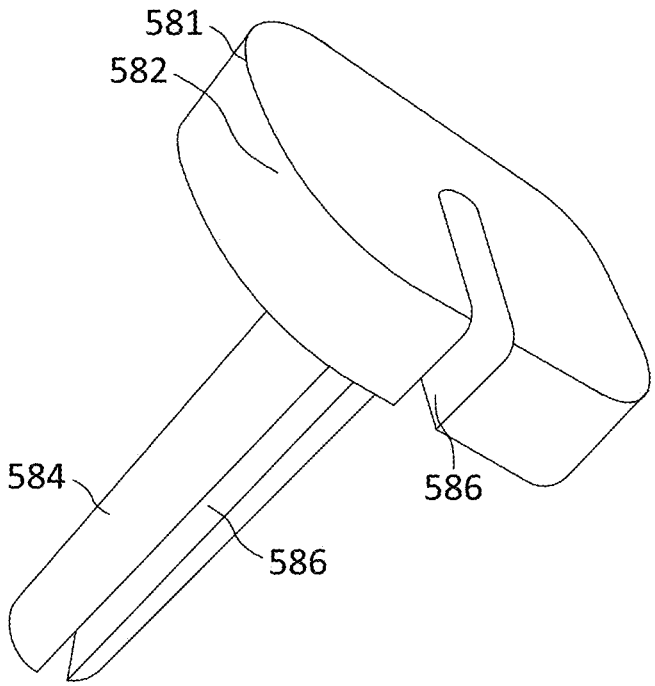
FIG. 5M is a perspective view of a tool for use in mounting the snap fit plug in accordance with an illustrative embodiment.

FIG. 5M is a perspective view of a tool 581 for use in mounting the snap fit plug in accordance with an illustrative embodiment. The tool 581 includes a base portion 582 and an extension 584 that extends from the base portion. The extension is in the shape of a cylinder with a slot 586 that runs along a length of the cylinder. The slot 586 also extends into the handle as shown. In an illustrative embodiment, the tool 581 is used to apply pressure through the opening in the tether anchor 540 and a corresponding hole in the energy absorbing layer to allow the snap-fit plug 565 to be mounted to the tether anchor 540, which is attached to the energy absorbing layer.

Figure 5N:
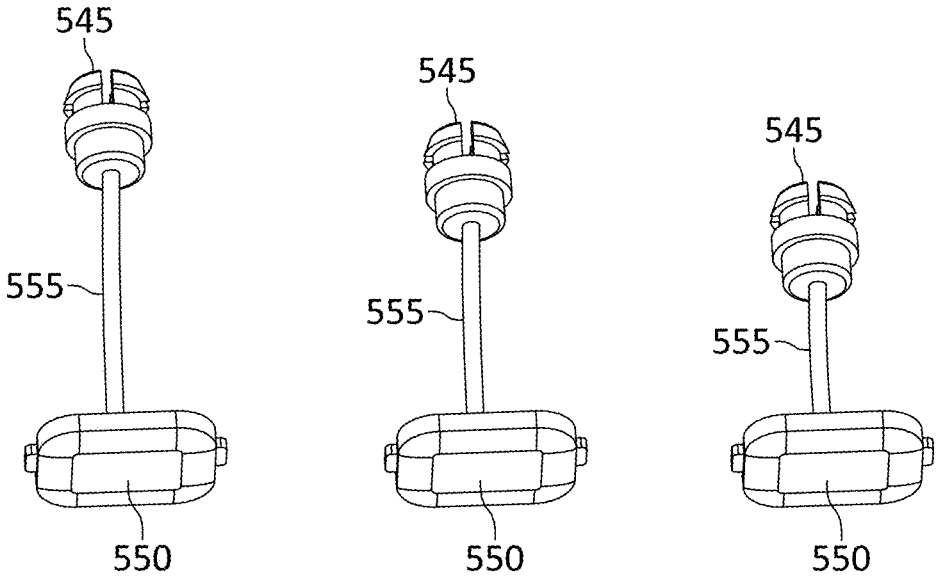
FIG. 5N depicts overmolded tether assemblies of various lengths in accordance with an illustrative embodiment.

FIG. 5N depicts overmolded tether assemblies of various lengths in accordance with an illustrative embodiment. In the embodiment shown, the top portion and bottom portion on the ends of cord are overmolded with the top cap and the snap-fit plug, respectively. Specifically, the cord is placed in the cavity of the mold at a set length, and then plastic flows into the cavity, fusing/mechanically bonding to the cord, while forming the top cap and the snap-fit plug.

Figure 5O:
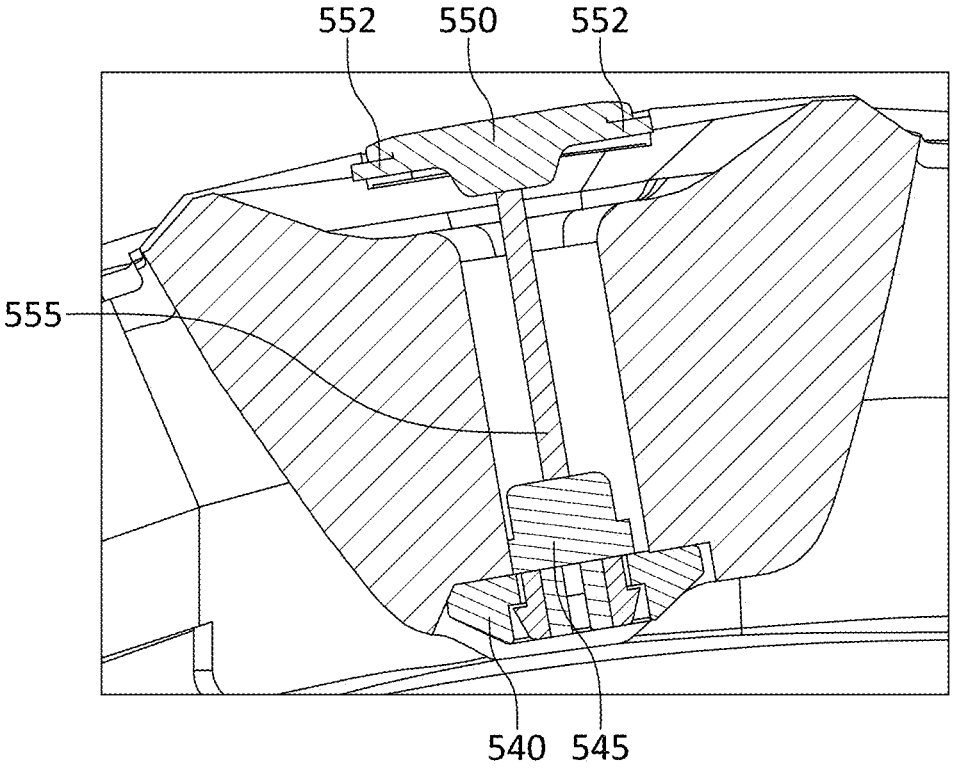
FIG. 5O is a cross-sectional view of a tether assembly mounted to a helmet in accordance with an illustrative embodiment.

FIG. 5O is a cross-sectional view of a tether assembly mounted to a helmet in accordance with an illustrative embodiment. In the embodiment shown, the tether assembly is mounted at a center of the top of the helmet. In alternative embodiments the tether assembly may be mounted at a different location. As shown, the top cap 550 has tabs 552 that mate with openings formed in a tray in the slidable energy diverting layer. The tabs 552 secure the top cap to the slidable energy diverting layer and prevent movement of the top cap 550 during normal use of the helmet.

Figure 5P:
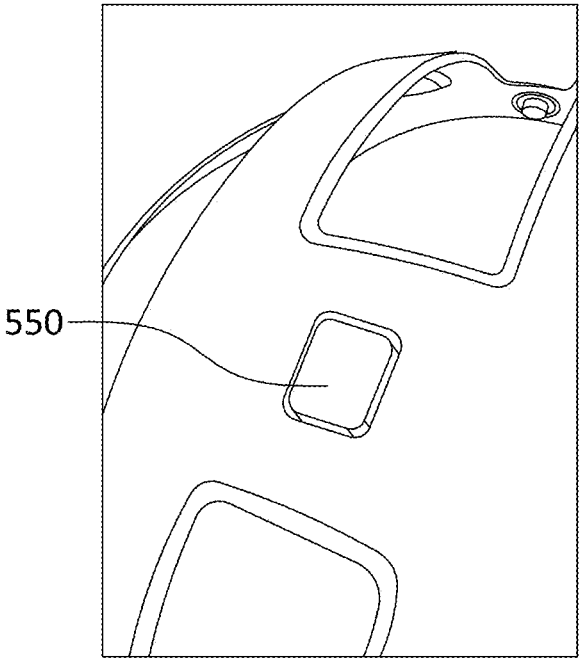
FIG. 5P is an external view of the slidable energy absorbing layer with a mounted tether assembly in accordance with an illustrative embodiment.
Figure 5Q:
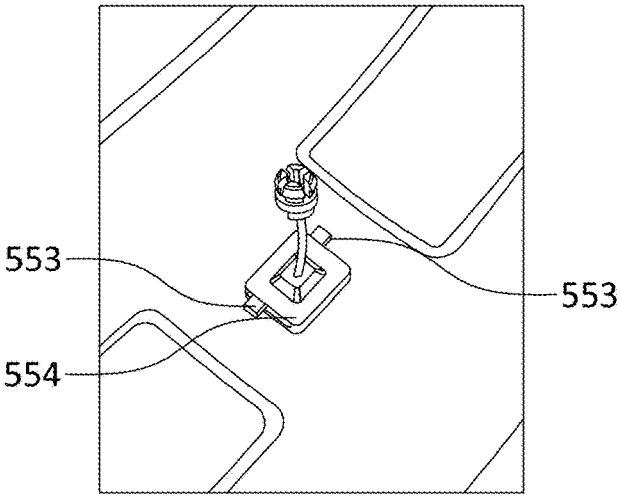
FIG. 5Q is an interior view of the slidable energy absorbing layer with the mounted tether assembly in accordance with an illustrative embodiment.

FIG. 5P is an external view of the slidable energy absorbing layer with a mounted tether assembly in accordance with an illustrative embodiment. As shown, the top cap 550 of the tether assembly is mounted within an opening in the slidable energy absorbing layer such that the top cap is flush. FIG. 5Q is an interior view of the slidable energy absorbing layer with the mounted tether assembly in accordance with an illustrative embodiment. As shown, the tabs 552 of the top cap 550 mate with slots 553 in a tray 554 that is formed in the slidable energy diverting layer. The tray 554 includes the opening that receives a portion of the top cap 550 and the cord 555. Additionally, the tray 554 extends past the remaining interior surface of the energy diverting layer such that, when mounted, the top cap 550 is flush with the exterior surface of the energy diverting layer.

Figure 5R:
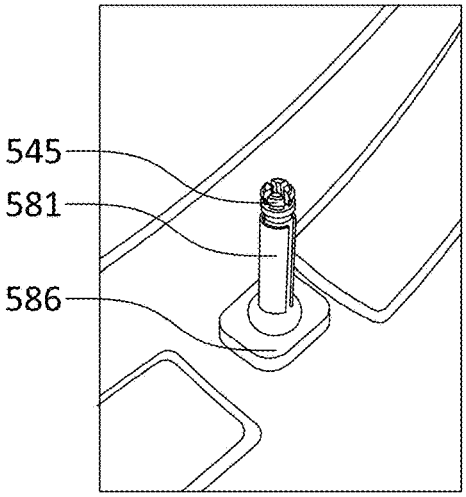
FIG. 5R depicts use of the tool to assemble the helmet in accordance with an illustrative embodiment.
Figure 5S:
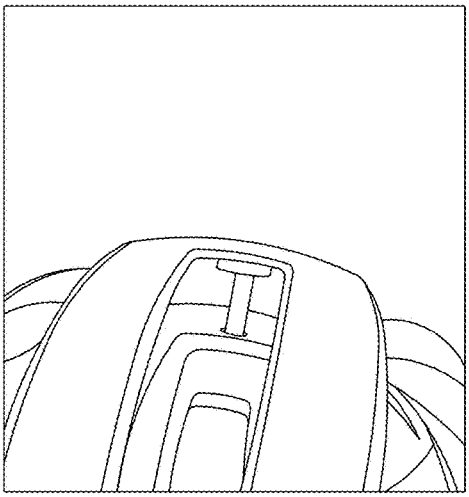
FIG. 5S shows the mounted tether assembly with the slidable energy diverting layer detached from the energy absorbing layer in accordance with an illustrative embodiment.

FIG. 5R depicts use of the tool 581 to assemble the helmet in accordance with an illustrative embodiment. As shown, the base portion 582 of the tool 581 mounts over tray 554 shown in FIG. 5Q. The cord 555 is received by the slot 586 formed in the extension 584 of the tool 581. As such, the tool 581 holds the cord 555 in a standing position, and an end of the extension 584 supports the snap-fit plug 545 attached to the cord 555 for mounting to the energy absorbing layer. FIG. 5S shows the mounted tether assembly with the slidable energy diverting layer detached from the energy absorbing layer in accordance with an illustrative embodiment.

Figure 5T:
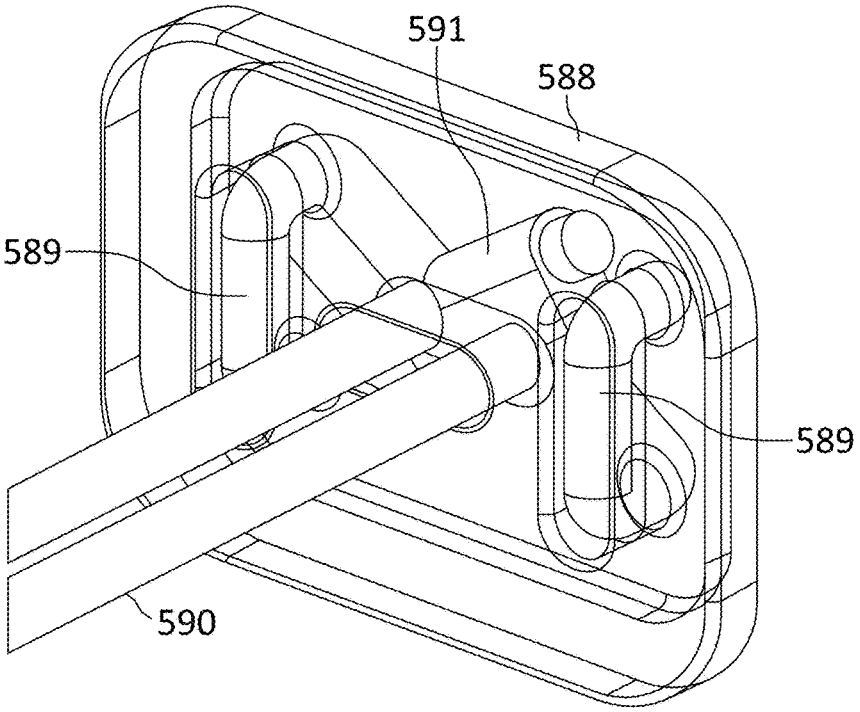
FIG. 5T is a semi-transparent bottom view of a top cap of a tether assembly that includes friction channels to receive a cord in accordance with an illustrative embodiment.
Figure 5U:
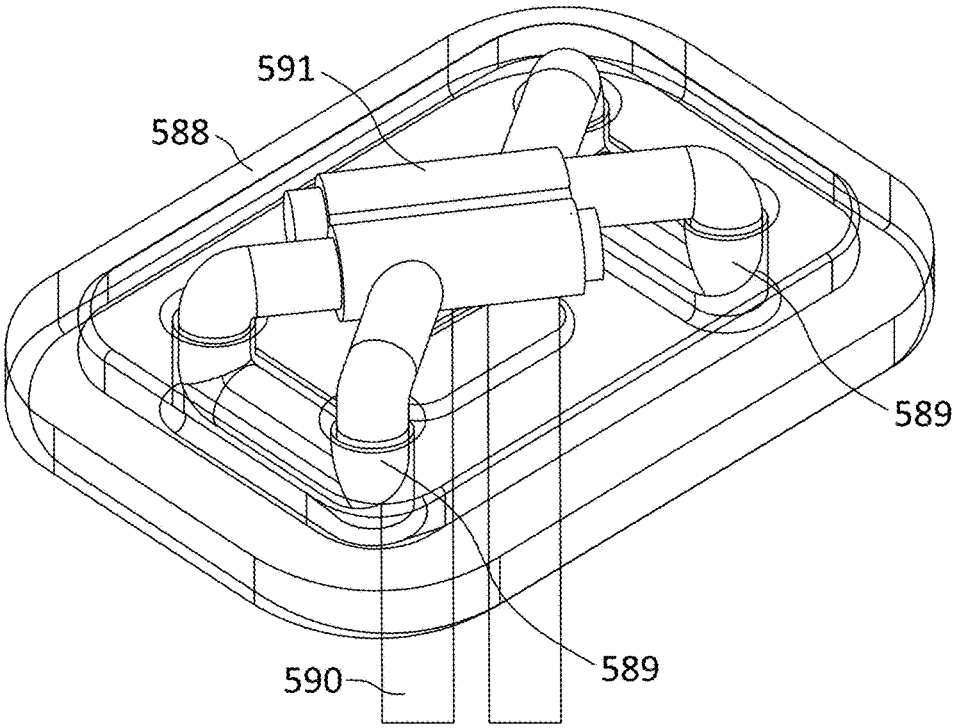
FIG. 5U is a semi-transparent top view of the top cap of the tether assembly that includes friction channels to receive the cord in accordance with an illustrative embodiment.

In another embodiment, the top cap (or top badge) of the tether assembly to which the cord is mounted can include one or more grooves (i.e., friction channels) that are sized to receive the cord. These friction channels create a high drag force on the cord during movement of the cord that occurs responsive to an impact. The ends of the cord can be secured by a metal clip in one embodiment, and the high drag force imposed on the cord by the friction channels reduces the stress on the metal clip, making it less likely that the metal clip will fail during an impact. FIG. 5T is a semi-transparent bottom view of a top cap 588 of a tether assembly that includes friction channels 589 to receive a cord 590 in accordance with an illustrative embodiment. FIG. 5U is a semi-transparent top view of the top cap 588 of the tether assembly that includes friction channels 589 to receive the cord 590 in accordance with an illustrative embodiment. In this embodiment, the top cap 588 includes a pair of friction channels, each of which is sized to receive an end of the cord 590. The top cap 588 also includes an opening in the center through which a loop of the cord 590 extends such that the loop can be secured to the rest of the helmet.

Figure 5V:
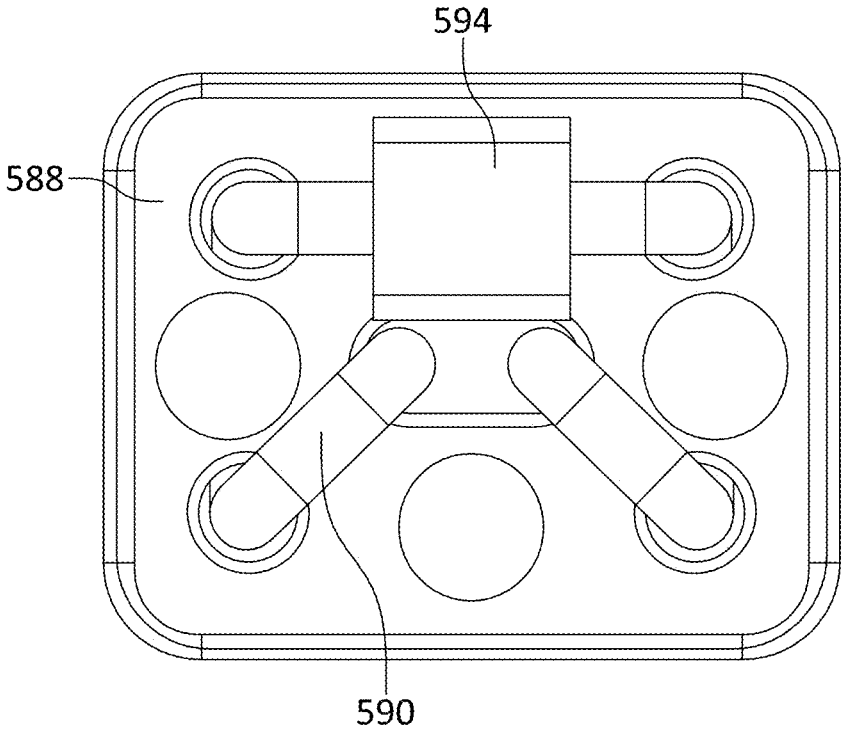
FIG. 5V is a top view of the top cap with a metal clip a that secures ends of the cord a without overlapping the cord in accordance with an illustrative embodiment.

Also shown in FIGS. 5T and 5U is a metal clip 591 that is used to secure ends of the cord 590 such that the cord 590 is unable to fully release from the top cap 588 in the event of an impact. As discussed, the friction channels 589, which extend through a body of the top cap 588, further secure the cord 590 to the top cap 588 by increasing the drag on the cord 590 during an impact to the helmet. This increased drag on the cord 590 reduces the pulling force on the metal clip 591, which prevents failure of the metal clip 591. As shown, in this embodiment, the ends of the cord 590 overlap one another (i.e., are positioned side-by-side) when mounted in the metal clip 591. In an alternative embodiment, the ends of the cord do not overlap. For example, FIG. 5V is a top view of the top cap 588 with a metal clip 594 that secures ends of the cord 590 without overlapping the cord in accordance with an illustrative embodiment. Specifically, the metal clip 594 secures the cord 590 such that the ends of the cord 590 are aligned and either in contact with one another or adjacent to one another. In one embodiment, a length of the cord 590 can be 75 mm, which results in an ~17 mm long assembled tether. Use of such a dual strand loop to form the tether increases the overall strength of the tether, reducing the risk of failure. Additionally, the embodiment of FIGS. 5T, 5U, and 5V is straightforward to assemble, with no overmolding involved.

Figure 5W:
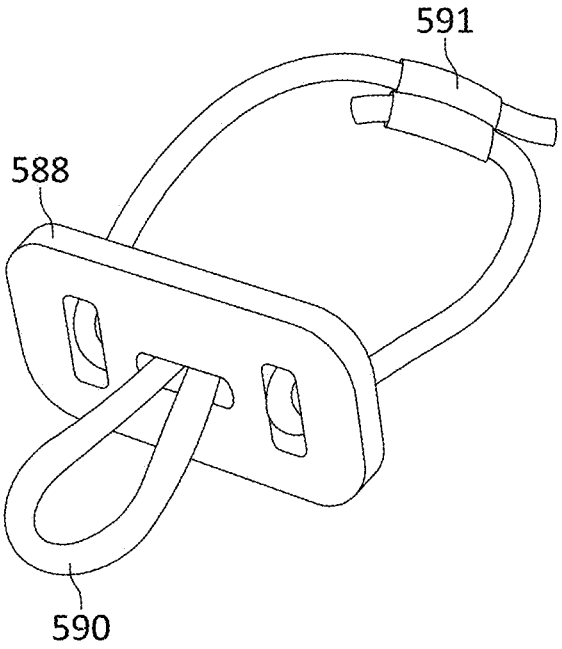
FIG. 5W depicts the top cap with a mounted cord partially extending though a central opening in accordance with an illustrative embodiment.
Figure 5X:
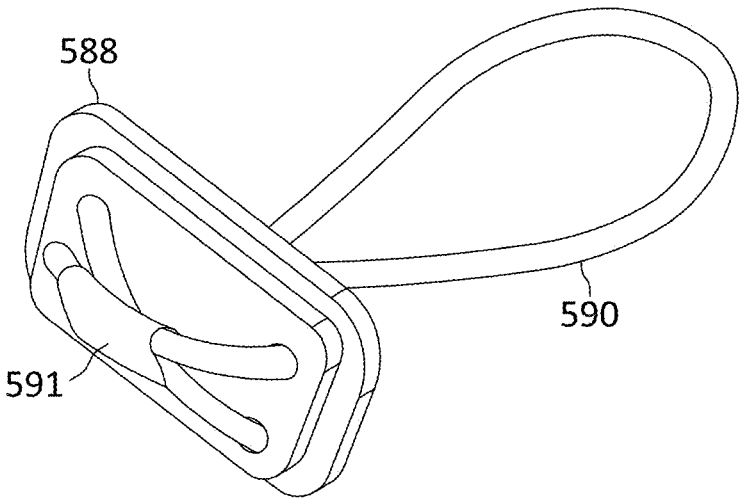
FIG. 5X depicts the top cap with a mounted cord fully extending through the central opening in accordance with an illustrative embodiment.
Figure 5Y:
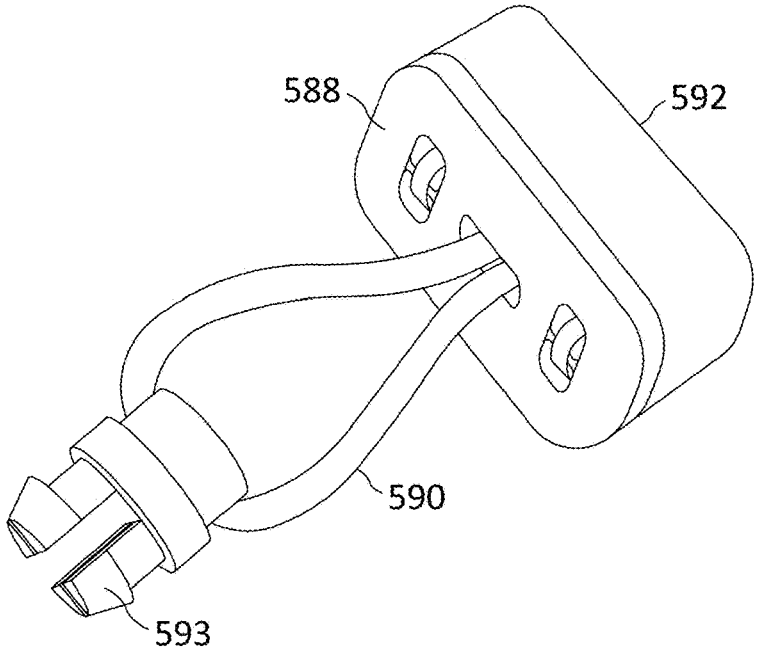
FIG. 5Y depicts a fully assembled tether assembly including a top cap cover mounted to the top cap in accordance with an illustrative embodiment.

FIG. 5W depicts the top cap 588 with a mounted cord 590 partially extending though a central opening in accordance with an illustrative embodiment. FIG. 5X depicts the top cap 588 with a mounted cord 590 fully extending through the central opening in accordance with an illustrative embodiment. As shown, the metal clip 591 is crimped to secure the ends of the cord 590. FIG. 5Y depicts a fully assembled tether assembly including a top cap cover 592 mounted to the top cap 588 in accordance with an illustrative embodiment. In one embodiment, the top cap cover 592 mounts to an interior surface of the outer shell of the helmet such that the outer shell does not include a through hole to accommodate the tether assembly. For example, the top cap cover 592 can be secured via an adhesive to the interior surface of the outer shell (i.e., slidable energy diverting layer). In an alternative embodiment, the top cap cover can be secured with an opening in the outer shell. FIG. 5Y also shows a snap fit connector 593 mounted to the cord 590. The snap fit connector 593 is used to secure the tether assembly to the interior of the helmet (e.g., the energy absorbing layer) as described herein. The top cap cover 592 can be secured to the top cap 588 via a snap-fit, via adhesive, etc.

Figure 5Z:
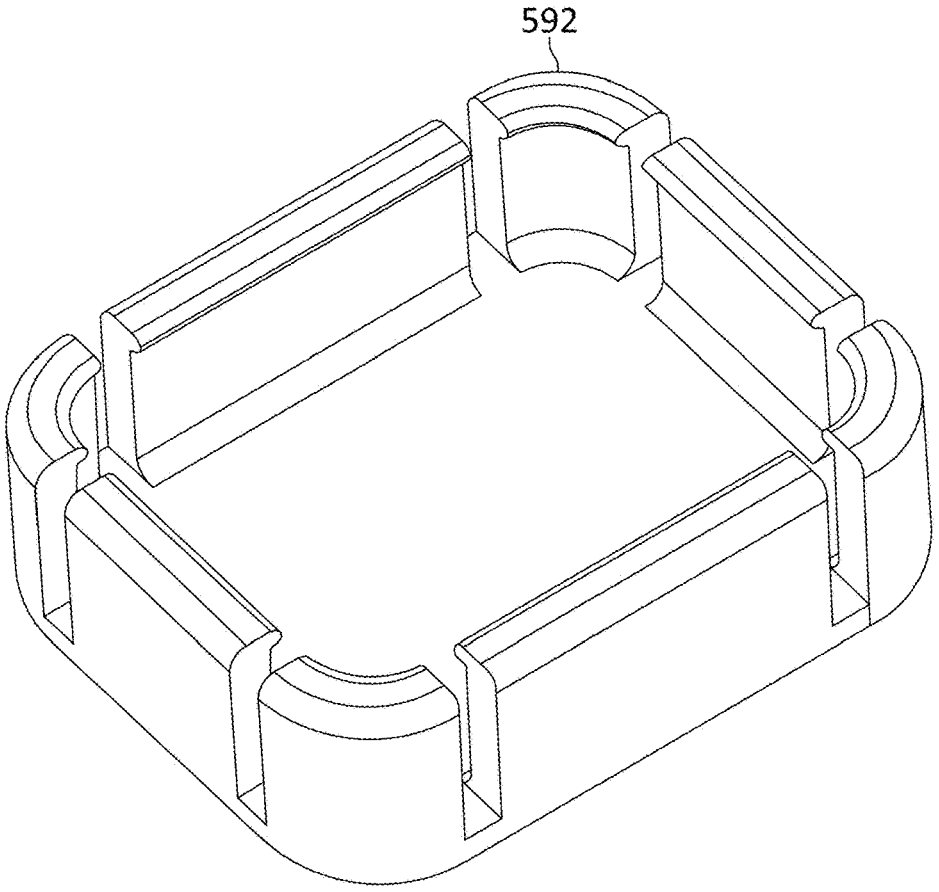
FIG. 5Z is a perspective view of the top cap cover in accordance with an illustrative embodiment.
Figure 5A:
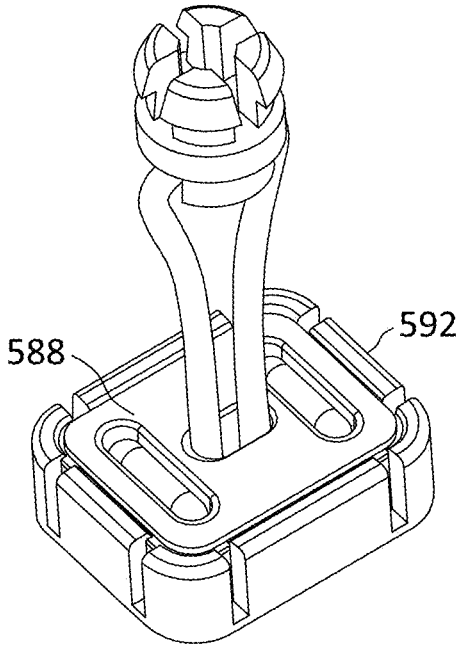
Figure 5B:
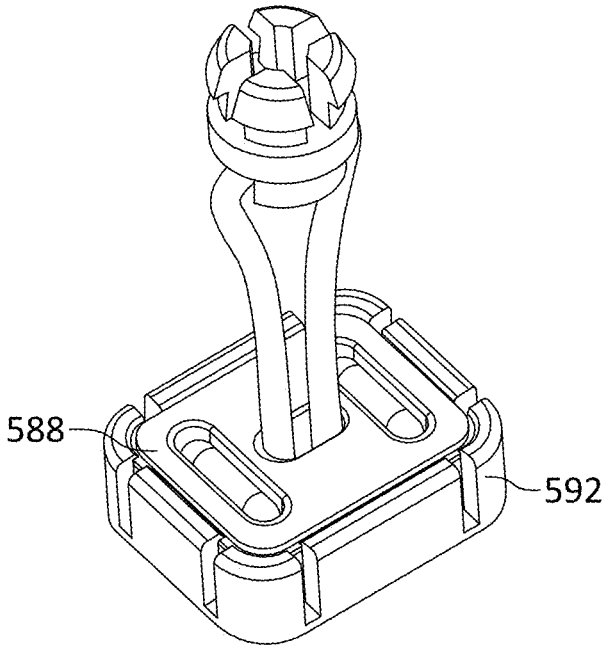

FIG. 5Z is a perspective view of the top cap cover 592 in accordance with an illustrative embodiment. FIG. 5AA is a bottom view of a tether assembly in which the top cap cover 592 mounts to the top cap 588 via an annular snap fit in accordance with an illustrative embodiment. FIG. 5BB is a bottom view of a tether assembly in which the top cap cover 592 mounts to the top cap 588 via a cantilever snap fit in accordance with an illustrative embodiment. As shown, the top cap cover 592 of FIG. 5AA includes additional slots in the flange that extends from the base of the top cap cover, as compared to the top cap cover 592 of FIG. 5BB. These additional slots enable the annular snap fit, as opposed to the cantilever snap fit shown in FIG. 5BB. As shown, the distal end of the flange includes a lip which is used to secure the top cap cover 592 to the top cap 588.

Figure 6A:
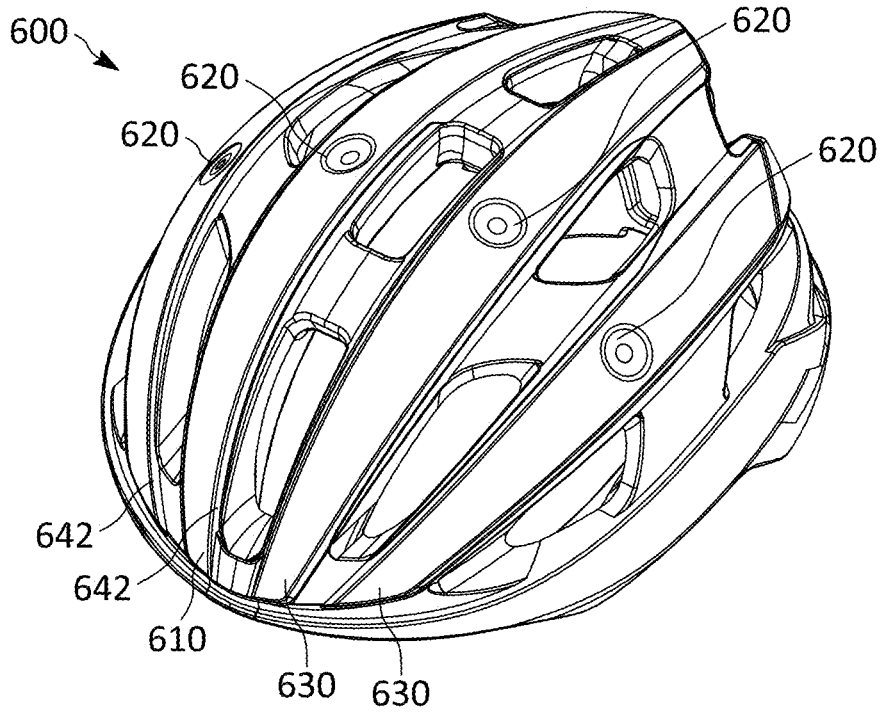
FIG. 6A is a top perspective view of an energy absorbing layer of a helmet in accordance with an illustrative embodiment.
Figure 6B:
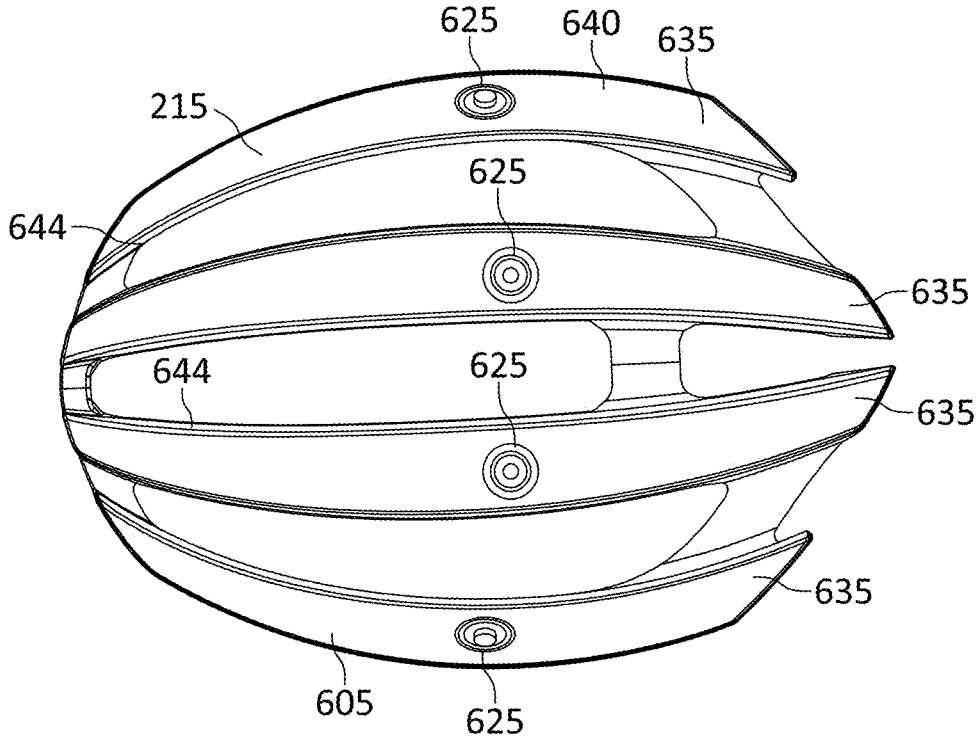
FIG. 6B depicts an interior surface of a slidable energy diverting layer of the helmet in accordance with an illustrative embodiment.

In another embodiment, the helmet 200 described with reference to FIGS. 2-5 can be implemented without use of an intermediate layer. In such an embodiment, cavities are formed directly in the energy absorbing layer 210 instead of the intermediate layer. FIG. 6A is a top perspective view of an energy absorbing layer 610 of a helmet 600 in accordance with an illustrative embodiment. FIG. 6B depicts an interior surface of a slidable energy diverting layer 605 of the helmet 600 in accordance with an illustrative embodiment. In an illustrative embodiment, the slidable energy diverting layer 605 is the same as the slidable energy diverting layer 205 described with reference to FIGS. 2-5. In an alternative embodiment, the energy diverting layer 605 can be split into a plurality of shells that mount to the energy absorbing layer 610. For example, the energy diverting layer 605 can be formed from 4 ribs in one embodiment, each of which is independently mounted to the energy absorbing layer 610.

Figure 6C:
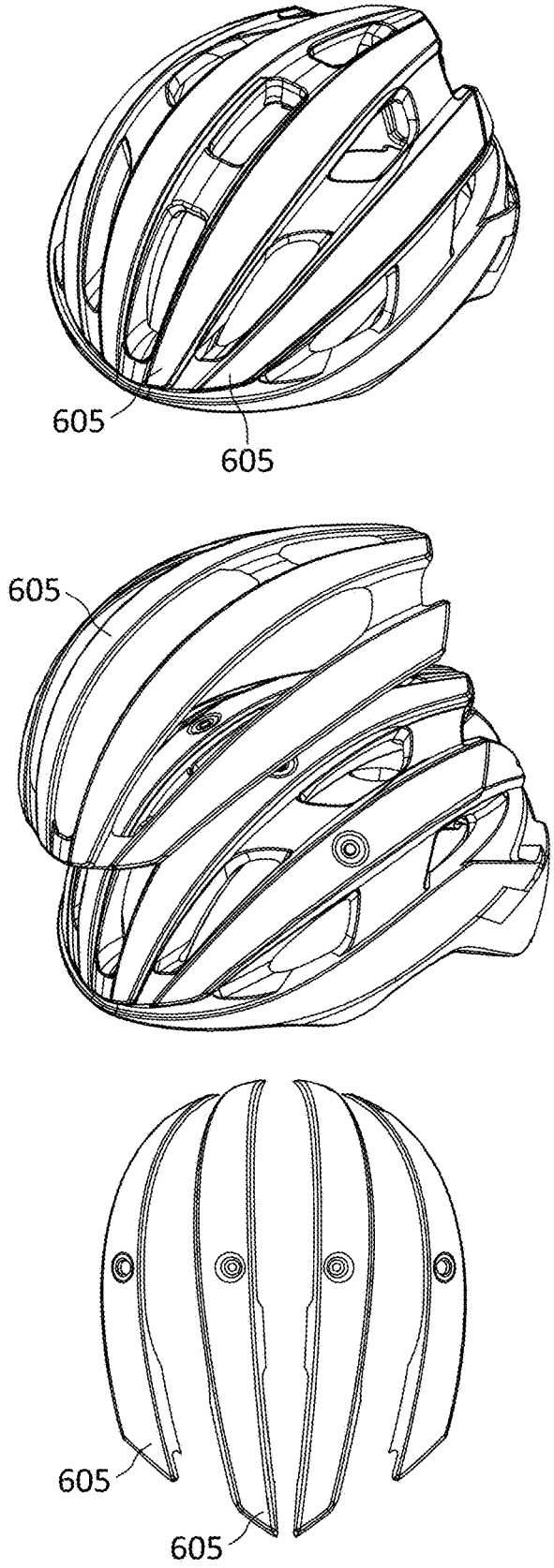
FIG. 6C includes images of a helmet in which the energy diverting layer 605 is formed as a plurality of independent ribs in accordance with an illustrative embodiment.

FIG. 6C includes images of a helmet in which the energy diverting layer 605 is formed as a plurality of independent ribs in accordance with an illustrative embodiment. In an alternative embodiment, the energy diverting layer 605 can consist of a plurality of plates covering a sector of the helmet.

As shown in FIG. 6A, the energy absorbing layer 610 includes a plurality of cavities 620 that are used to slidably secure the slidable energy diverting layer 605 to the helmet 600. Each of the cavities 620 is positioned above a magnet that is embedded into the energy absorbing layer 610. The slidable energy diverting layer 605 includes a corresponding plurality of pockets 625 that are mounted to the interior surface of the slidable energy diverting layer 605. Each of the pockets 625 includes a magnet. The pockets 625 mounted to the interior surface of the slidable energy diverting layer 605 are sized to mate with the cavities 620 formed in the energy absorbing layer 610 such that the magnets in the pockets 625 are attracted to the magnets embedded in the energy absorbing layer 610. The magnets and their attachment to the layers is described in more detail below with reference to FIG. 6D.

As shown, the cavities 620 are positioned at a center of each of a plurality of ribs 630 that form the energy absorbing layer 610. Similarly, the pockets 625 are positioned at a center of each of a corresponding plurality of ribs 635 that form the slidable energy diverting layer 605. In alternative embodiments, a different number of cavities/pockets can be used in each of the energy absorbing layer 610 and the slidable energy diverting layer 605, such as 1 cavity/pocket in each layer, 2 cavities/pockets in each layer, 3 cavities/pockets in each layer, 5 cavities/pockets in each layer, 8 cavities/pockets in each layer, 10 cavities/pockets in each layer, 12 cavities/pockets in each layer, etc. While the slidable energy diverting layer 605 and the energy absorbing layer 610 are each shown with 4 ribs, it is to be understood that a different number of ribs can be used for the layers in alternative embodiments, such as 2 ribs, 3 ribs, 5 ribs, etc.

Additionally, the cavities/pockets 620/625 can be positioned at different locations along the ribs 630/635 of each of the energy absorbing layer 610 and the slidable energy diverting layer 605, respectively. For example, in one embodiment, one or more cavities/pockets can be positioned at a front portion of the ribs 630/635, where the front portion refers to the portions of the ribs that extend from a transverse (or cross-sectional) centerline (defined in FIG. 2C) of the ribs to the front of the helmet 600. Similarly, one or more cavities/pockets can be positioned at a rear portion of the ribs, where the rear portion refers to the portions of the ribs that extend from the transverse centerline of the ribs to the rear of the helmet 600. Similarly, while the cavities/pockets 620/625 are depicted as being longitudinally centered along the ribs 630/635, in alternative embodiments the cavities/pockets 620/625 can be off center longitudinally.

In an illustrative embodiment, magnets positioned in the cavities/pockets 620/625 are attracted to one another and used in combination with chamfers (described below) to help ensure that the slidable energy diverting layer 605 only slides in the event of an impact to the helmet. As also discussed in more detail below, the slidable energy diverting layer 605 is designed to not slide or move relative to the rest of the helmet during normal use of the helmet 600.

As shown in FIG. 6B, an interior surface of the slidable energy diverting layer 605 includes a low friction coating 640 to facilitate movement between the slidable energy diverting layer 605 and the energy absorbing layer 610 in the event of an impact to the helmet 600. As used herein, the interior surface of the slidable energy diverting layer 605 refers to the surface that contacts an exterior surface of the energy absorbing layer 610 during normal use of the helmet. In an alternative embodiment, the low friction coating 640 can be applied to the exterior surface of the energy absorbing layer 610 to facilitate the movement between the two layers. In another alternative embodiment, the low friction coating 640 can be applied to both the interior surface of the slidable energy diverting layer 605 and the exterior surface of the energy absorbing layer 610. In such an embodiment, the same low friction coating 640 can be applied to both the interior surface of the slidable energy diverting layer 205 and the exterior surface of the intermediate layer 215. Alternatively, a first type of low friction coating can be applied to the interior surface of the slidable energy diverting layer 605 and a second type of low friction coating can be applied to the exterior surface of the energy absorbing layer 610, where the first type of low friction coating differs from the second type of low friction coating. In an alternative embodiment, the low friction coating(s) may not be used.

In addition to the magnet(s) which are used to secure the slidable energy diverting layer 605 to the helmet 600, chamfers can be used to help keep the slidable energy diverting layer 605 in place (i.e., aligned to the helmet) during normal use of the helmet. Specifically, the chamfers act to help secure (or key) the slidable energy diverting layer 605 to the helmet 600 such that the slidable energy diverting layer 605 does not slide during normal use. The same chamfering depicted in FIGS. 3A and 3B applies to the helmet 600.

Specifically, the energy absorbing layer 610 of the helmet 600 includes chamfered edges 642 that are angled to receive angled extensions 644 that extend from the slidable energy diverting layer 605 of the helmet 600. As such, in addition to forming the exterior of the helmet 600, the chamfering allows the slidable energy diverting layer 605 of the helmet to extend into one or more helmet vents to ensure proper fit of the slidable energy diverting layer 605 onto the helmet. In addition to having chamfered edges along one or more vents of the helmet, the energy absorbing layer 610 can also include chamfered edges along at least a portion of a bottom edge of the helmet. In such an embodiment, the slidable energy diverting layer can include one or more angled extensions that are angled to match (i.e., mate with) the portion(s) of the bottom edge of the helmet that are chamfered to help secure the slidable energy diverting layer 605 to the helmet during normal use.

Figure 6D:
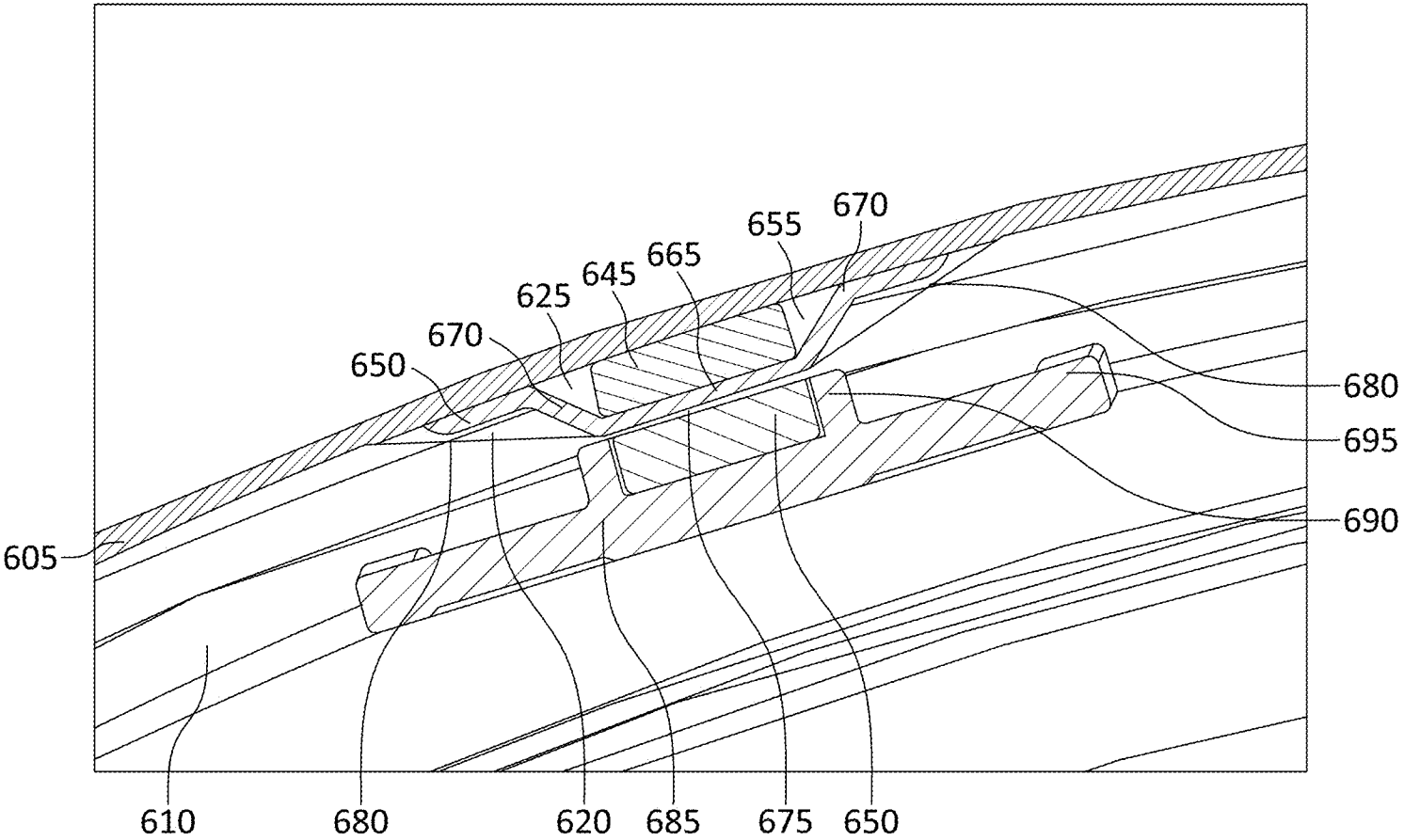
FIG. 6D is a cross-sectional view of a magnet to magnet interface of the helmet in accordance with an illustrative embodiment.

In an illustrative embodiments, the magnet(s) are mounted to the slidable energy diverting layer using pocket(s) that are mounted to the interior surface of the slidable energy diverting layer. FIG. 6D is a cross-sectional view of a magnet to magnet interface of the helmet 600 in accordance with an illustrative embodiment. FIG. 6D depicts a primary magnet 645 in a pocket 625 and a secondary magnet 650 positioned under a cavity 620 formed in the energy absorbing layer 610. In one embodiment, the pocket 625 can be formed using thermoforming or injection molding, and can be made from polycarbonate, carbon fiber material, or a different thermoplastic. Alternatively, a different manufacturing technique and/or material may be used to form the pocket 625. In an illustrative embodiment, an outward facing surface of the secondary magnet 650 is covered by EPS (or another material) that forms the energy absorbing layer 610. Alternatively, the outward facing surface of the secondary magnet 650 can be exposed (i.e., not covered by EPS or other material that forms the energy absorbing layer 610). In such an embodiment, the secondary magnet can be adhered to or press fit to the magnet holder to help ensure that the secondary magnet does not release from the energy absorbing layer 610 in response to an impact to the helmet. In an alternative embodiment, the slidable energy diverting layer 605 can be constructed at least in part of a magnetic powder to give the slidable energy diverting layer 605, itself, magnetic properties. In another alternative embodiment, the energy absorbing layer 610 can be constructed at least in part of a magnetic powder to give the slidable energy absorbing layer 610, itself, magnetic properties.

As shown, the pocket 625 includes a receptacle 655 that is sized to receive the magnet 645 and a flange 660 that surrounds the receptacle 655. In an illustrative embodiment, the pocket 625 is mounted to the interior surface of the slidable energy diverting layer 605. The pocket 625 can be mounted to the interior surface of the slidable energy diverting layer 605 using an adhesive (e.g., 3M® double-sided adhesive, cyanoacrylate glue, contact cement, etc.), tape (e.g., thermoplastic polyurethane (TPU) tape), or any other method. Specifically, the adhesive, tape, etc. can be applied to a top surface of the flange 660 such that the top surface of the flange 660 is adjacent to the interior surface of the slidable energy diverting layer 605.

The pocket 625 is sized such that the primary magnet 645 sits flush against the interior surface of the slidable energy diverting layer 605. In one embodiment, the primary magnet 645 is secured to a bottom wall 665 of the pocket 625 using a tape, adhesive, or other method to prevent movement of the primary magnet 645 within the pocket. In an alternative embodiment, the primary magnet 645 may not be secured to the bottom wall 665 of the pocket 625 and is held in place via a friction fit. The primary magnet 645 is depicted as a flattened cylinder that has a circular shape in cross-section. Similarly, the bottom wall 665 of the pocket 625 has a circular shape to receive a bottom end of the primary magnet 645. In alternative embodiments, a different shape can be used for both the primary magnet 645 and the bottom wall 665 of the pocket 625, such as square, rectangular, triangular, etc.

The receptacle 655 of the pocket 625 is formed to have walls 670 that are angled greater than 90 degrees relative to the bottom wall 665 of the receptacle 655 in the pocket 625. As such, each of the walls 670 acts as a ramp that mates with an angled surface formed in the energy absorbing layer and allows the slidable energy diverting layer to slide from the energy absorbing layer upon impact to the helmet.

Formed in the energy absorbing layer 610 is a cavity 620 that is sized to receive the pocket 625. The cavity 620 includes a bottom wall 675 and sidewalls 680. As shown, the sidewalls 680 are angled relative to the bottom wall 675 at an angle greater than 90 degrees. The sidewalls 680 reflect the angled walls 670 of the pocket 625 and enable the angled walls 670 to ramp out of the cavity 620 in response to an impact to the helmet. The second magnet 650 is mounted underneath the bottom wall 675 of the cavity 620, in the energy absorbing layer 610. During normal use of the helmet, the primary magnet 645 embedded in the pocket 625 of the slidable energy diverting layer 605 is aligned with and positioned over the secondary magnet 650. The primary magnet 645 and the secondary magnet 650 are oriented to attract to one another, thereby securing the slidable energy diverting layer 605 to the energy absorbing layer 610 during normal use.

The secondary magnet 650 is mounted in a magnet holder (or anchor) 685 that includes a magnet receptacle 690 and arms 695 that extend from the magnet receptacle. In one embodiment, the secondary magnet 650 can be glued, taped, or otherwise secured to the magnet receptacle 690. In an illustrative embodiment, the magnet holder 685 is embedded in the energy absorbing layer 610 during formation of the energy absorbing layer 610. Alternatively, the magnet holder 685 may be adhered to the energy absorbing layer 610 (e.g., using glue, tape, etc.) after formation of the energy absorbing layer 610. The magnet holder 685 is positioned such that it is concentric to the cavity formed in the energy absorbing layer.

In an illustrative embodiment, each of the arms 695 of the magnet holder 685 has a t-shape that extends from a cylindrical magnet receptacle 690. Alternatively, the arms 695 can have a different shape such as an s-shape, an f-shape, a straight line, an e-shape, etc. Similar to the primary magnet 645, in alternative embodiments the secondary magnet 650 (and the magnet receptacle 690) can have a different cross-sectional shape, such as square, rectangular, triangular, etc. In another alternative embodiment, the magnet holder 685 may not be used. For example, in one embodiment, a magnet receptacle can be formed directly in the energy absorbing layer and the second magnet can be adhered (or otherwise mounted) directly to the magnet receptacle formed in and by the energy absorbing layer.

The primary magnet 645 and the secondary magnet 650 are attracted to one another to keep the slidable energy diverting layer attached to the rest of the helmet during normal use. As discussed, a plurality of primary magnets 645 and a plurality of secondary magnets 650 can be used to establish a corresponding plurality of attachment points for the slidable energy diverting layer 605. In an illustrative embodiment, each of the secondary magnets 650 is situated in the magnet holder 685 so that the outwardly facing polarity is opposite of the inwardly facing polarity of each of the primary magnets 645, creating a magnetic attraction. The attraction(s) create a bond between the slidable energy diverting layer and the energy absorbing layer. The magnetic attraction keeps the slidable energy diverting layer from moving or rattling during regular use of the helmet.

Figure 6E:
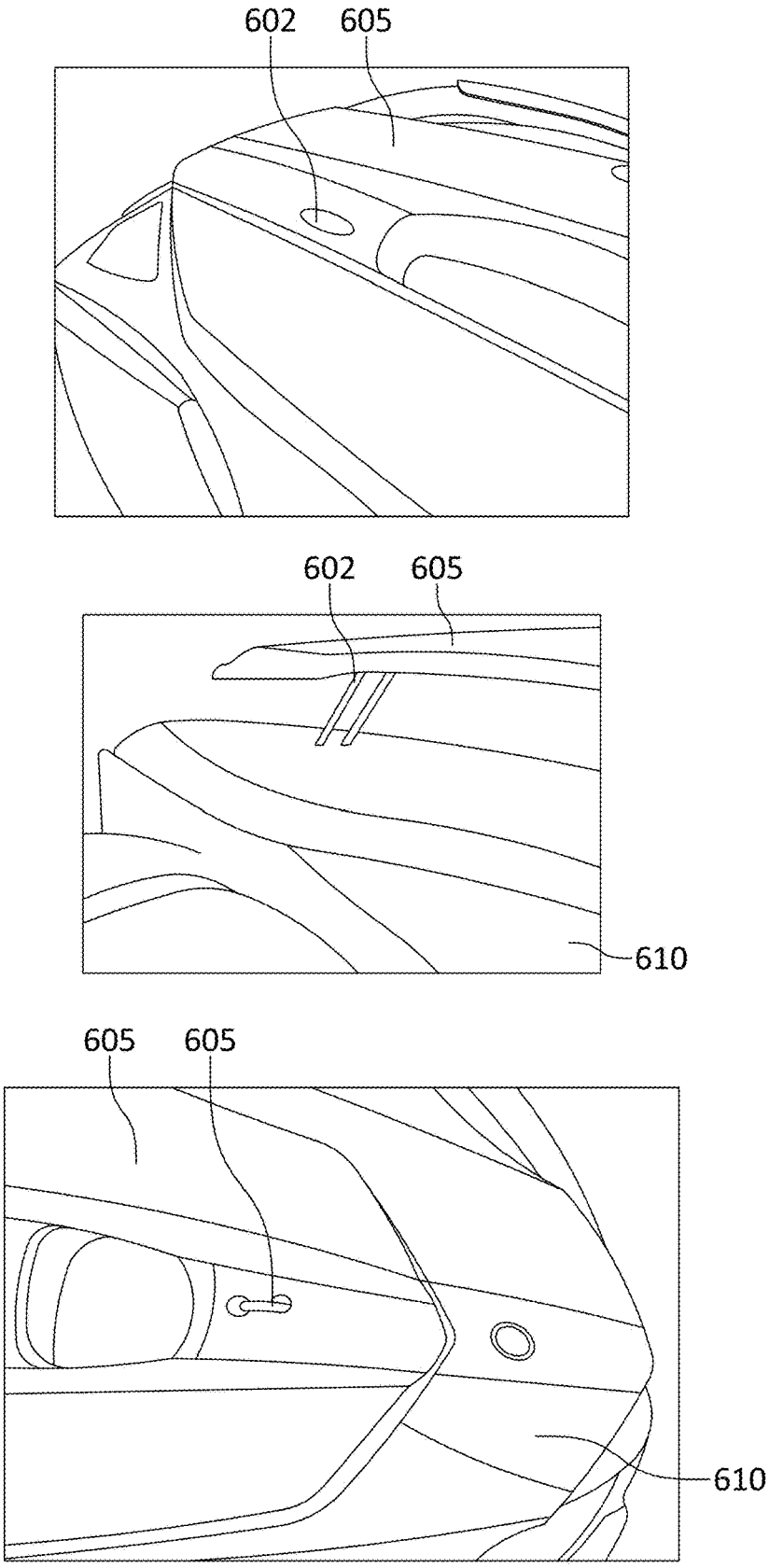
FIG. 6E is a series of images that depict a tether for use on a helmet in accordance with an illustrative embodiment.

In another illustrative embodiment, the slidable energy diverting layer 605 can be connected to the energy absorbing layer by one or more tethers such that the slidable energy diverting layer does not fully separate from the helmet upon impact. The one or more tethers can be used to help ensure that movement of the slidable energy diverting layer is controlled and limited when the slidable energy diverting layer moves. The various embodiments of the tether 500 described with reference to FIGS. 5A-5BB can be used in the helmet 600. For example, the tether used to secure the slidable energy diverting layer 605 to the energy absorbing layer 610 of the helmet 600 can be an elastic cord, band, or strap that has a limited range of motion (i.e., stretch), and this limited range of motion is large enough to allow the slidable energy diverting layer 605 to slide from the helmet and short enough to keep the slidable energy diverting layer 605 out of range of the user's face. Alternatively, the tether can be an extension or flange that is part of the formed slidable energy diverting layer and that is attached to the energy absorbing layer using an adhesive, a rivet, a snap-fit connection, etc. FIG. 6E is a series of images that depict a tether 602 for use on the helmet 600 in accordance with an illustrative embodiment. In the embodiment shown, the tether is an elastic cord that is looped through the slidable energy diverting layer 605. The tether 602 then runs through a tube in the energy absorbing layer 610 and is knotted or otherwise attached to an anchor on the interior of the helmet.

Other than the lack of an intermediate layer and placement of the cavities and second magnets, the helmet 600 of FIGS. 6A-6E can have the same features as and operate in the same way as the helmet 200 of FIGS. 2-5. Thus, with the exception of the intermediate layer, the entire description of FIGS. 2-5 applies to the embodiment of FIGS. 6A-6E.

Another illustrative embodiment is directed to a helmet with a slidable energy diverting layer without the use of magnets. In this embodiment, the slidable energy diverting layer (i.e., external shell) is partially bonded directly to the energy absorbing layer. For example, the slidable energy diverting layer can be attached to the energy absorbing layer by way of an adhesive. Any of the adhesives described herein can be used. The slidable energy diverting layer is also tethered to the energy absorbing liner (or to an intermediate layer) using one or more tethers, as described with respect to the other embodiments described herein. In the event of an impact, as the helmet strikes a surface, the slidable energy diverting layer is able to move relative to the intermediate layer and/or energy absorbing layer. The relative movement diverts rotational energy from the cyclist's head, thus decreasing the probability of traumatic injury.

In one embodiment, the slidable energy diverting layer has a thickness greater than or equal to 0.3 mm and less than or equal to 1.2 mm, and is either injection molded or thermoformed of a thermoplastic material. The intermediate layer, if used, can have the same thickness. Alternatively, a different thickness and/or method of formation can be used. For example, in one embodiment the slidable energy diverting layer and/or intermediate layer can also be formed from a carbon fiber woven material. The slidable energy diverting layer has a low friction coating applied to its interior to aid in the relative movement between the slidable energy diverting layer and the intermediate layer (or energy absorbing layer if an intermediate layer is not used).

In another illustrative embodiment, the slidable energy diverting layer forms the exterior of the helmet, but also extends into one or more of a plurality of helmet vents to ensure proper fit onto the helmet. In one embodiment, adhesive is applied to these extensions of the slidable energy diverting layer that extend into the vents. In a traditional helmet, adhesive is applied to the whole underside of the external shell. By applying the adhesive only to the extensions that extend into one or more of the helmet vents, a weaker bond (of the external shell) to the energy absorbing liner is formed relative to a traditional helmet. In one embodiment, the adhesive can also be applied to extensions that extend along a bottom edge of the helmet. In another embodiment, the bond area extends between 2 mm-4 mm from a periphery of the slidable energy diverting layer. This weaker bond formed by the partial adherence of the slidable energy diverting layer to the energy absorbing layer is durable enough to remain structurally sound in everyday use and riding, but can break away in the event of a crash.

In the event of an impact, the slidable energy diverting layer can move relative to the rest of the helmet but is limited in movement by one or more tethers, similar to the other embodiments described herein. In doing so, the slidable energy diverting layer cannot separate from the helmet and stays out of range of cyclist's face. Each of the tethers has two ends. The first end is mechanically connected to the slidable energy diverting layer. The second end is mechanically connected to the energy absorbing layer and/or the intermediate layer. The tether(s) can be of an elastic nature, rope-like, or spring-like. Alternatively, the tether(s) can be formed as extensions or flanges that are formed with and extend from the slidable energy diverting layer.

Figure 7A:
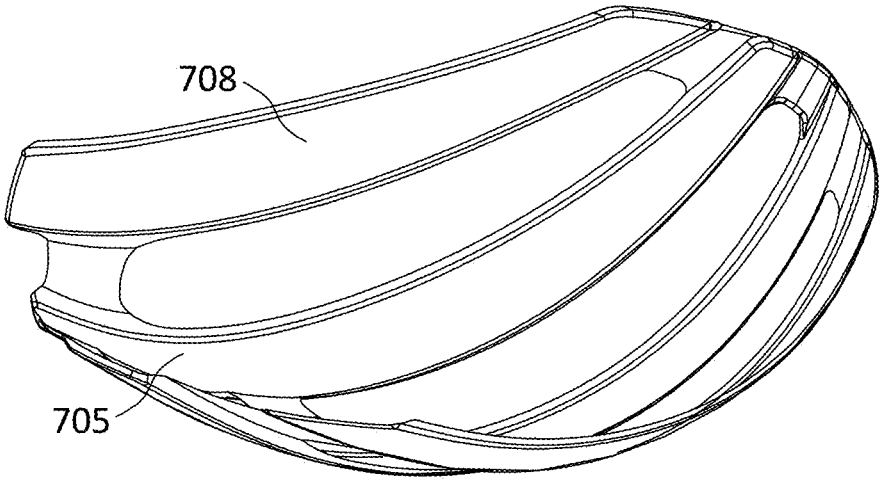
FIG. 7A is a perspective view of an interior surface of a slidable energy diverting layer in accordance with an illustrative embodiment.
Figure 7B:
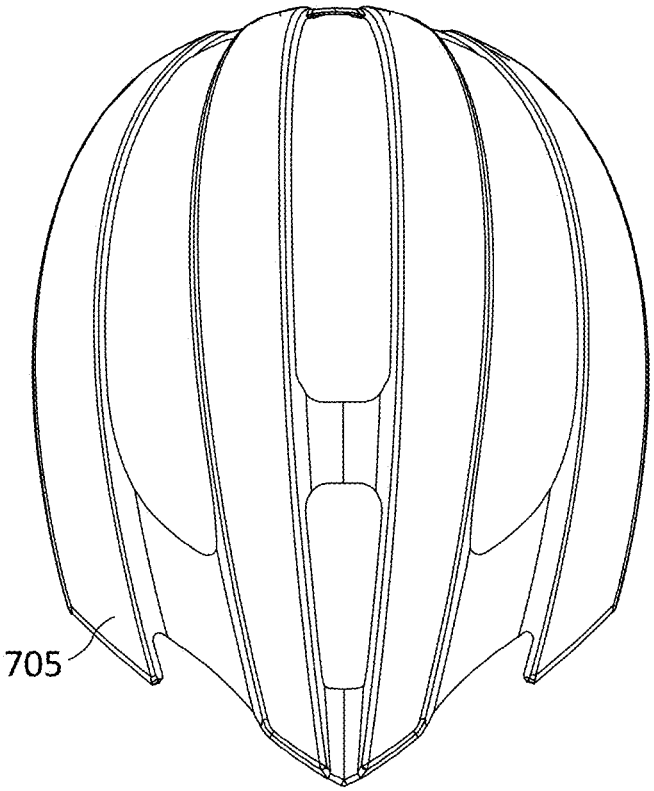
FIG. 7B is a perspective view of an exterior surface of the slidable energy diverting layer in accordance with an illustrative embodiment.

FIG. 7A is a perspective view of an interior surface of a slidable energy diverting layer 705 in accordance with an illustrative embodiment. FIG. 7B is a perspective view of an exterior surface of the slidable energy diverting layer 705 in accordance with an illustrative embodiment. As shown, the interior surface of the slidable energy diverting layer 705 includes a low friction coating 708 that facilitates movement between the slidable energy diverting layer 705 and an intermediate layer or an energy absorbing layer.

Figure 7C:
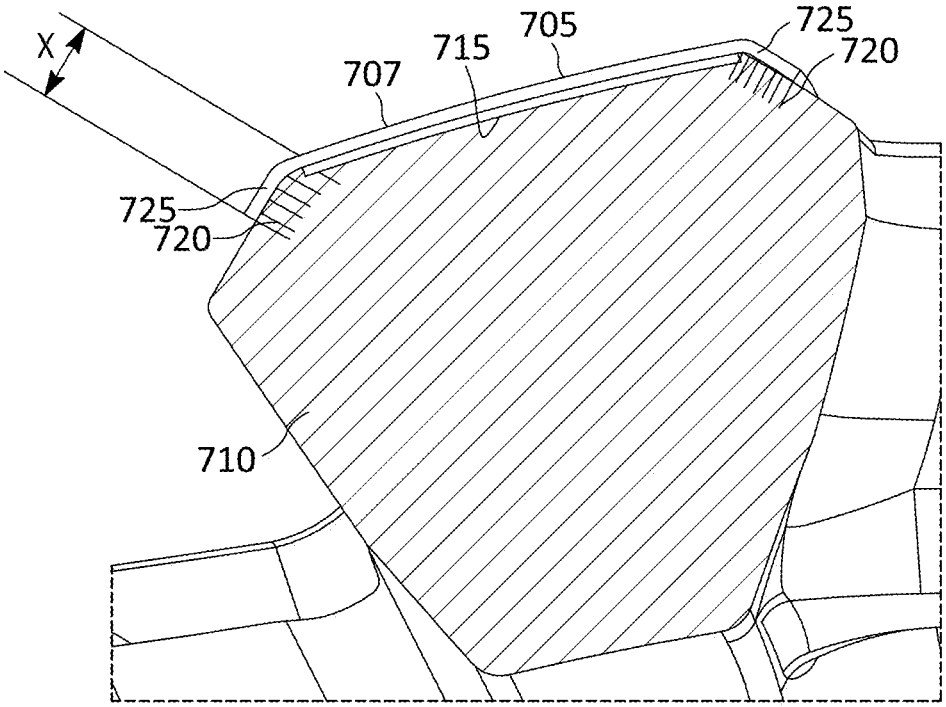
FIG. 7C is a cross-sectional view of a bridge area of a helmet that extends between two helmet vents in accordance with an illustrative embodiment.

FIG. 7C is a cross-sectional view of a bridge area of a helmet that extends between two helmet vents in accordance with an illustrative embodiment. The slidable energy diverting layer 705 is attached to an energy absorbing layer 710 with an adhesive 720. The slidable energy diverting layer 705 includes a primary surface 707 and extensions 725 that extend from the primary surface 707 at an angle relative to the primary surface 707. The adhesive 720 is only applied to the extensions 725 of the energy absorbing layer 710 that extend partially into helmet vents formed by the energy absorbing layer 710. The adhesive 720 may also be applied to extensions 725 that extend along a bottom wall (or edge) of the helmet. As shown, the adhesive 720 is applied at a distance x from a peripheral edge of the extensions 725 inward on the slidable energy diverting layer 705. In an illustrative embodiment, the distance x can be greater than or equal to 2 mm and less than or equal to 4 mm. In alternative embodiments, a different value for x can be used.

Figure 7D:
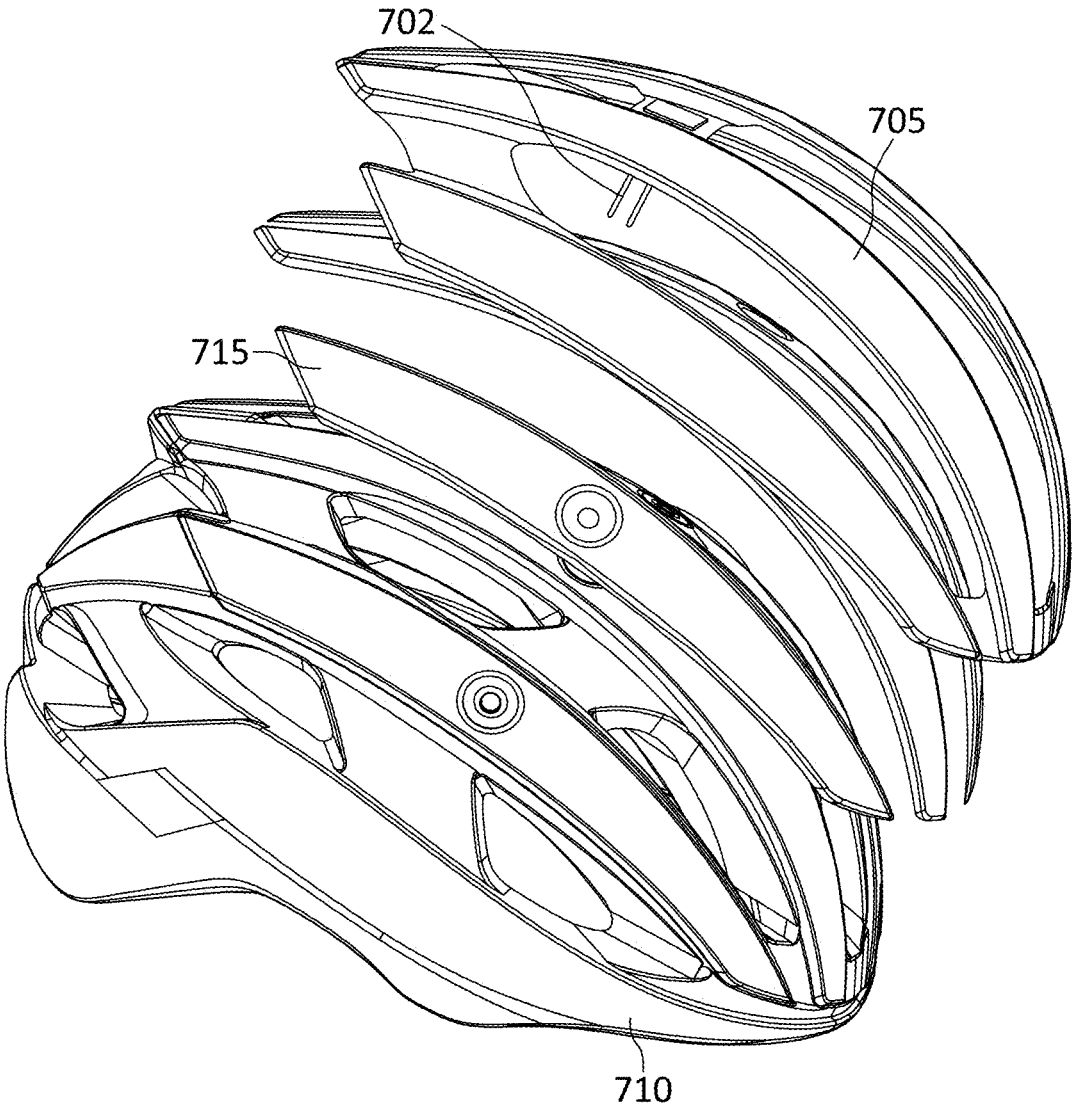
FIG. 7D is an exploded view of the helmet of FIGS. 7A-7C in accordance with an illustrative embodiment.

FIG. 7D is an exploded view of the helmet of FIGS. 7A-7C in accordance with an illustrative embodiment. As shown, the helmet includes a tether 702 that is used as described herein to limit movement of the slidable energy diverting layer 705 in response to a helmet impact that causes sliding of that layer. The tether 702 is mounted to the slidable energy diverting layer 705 as shown. When assembled, the tether 702 is also attached to one or more of the energy absorbing layer 710 and the intermediate layer 715.

In an illustrative embodiment, the adhesive 720 being used is designed to specifically bond thermoplastic material such as polycarbonate (PC) to expanded polystyrene (EPS) and is heat activated. In such an embodiment, the entire inward faces of both the slidable energy diverting layer 705 and the intermediate layer 715 can be coated with this adhesive. In a first stage of injection, the intermediate layer 715 is placed in the tool and the EPS (or other material used to form the energy absorbing layer 710) is injected. The two components become fused together through heat and steam. Afterwards, the mold is opened, and the slidable energy diverting layer 705 is placed inside. The second stage of injection reheats the mold and fuses the slidable energy diverting layer 705 to the energy absorbing layer 710 only at the areas denoted, since the adhesive in the other areas will not bond PC to PC. The distance "x" can be tuned to change the bond force required to have the slidable energy diverting layer 705 break away in the event of a crash but stay assembled in everyday use.

As a result of this fabrication process, other than the extensions 725, the remainder of the slidable energy diverting layer 705 (i.e., the primary surface 707) is positioned on an intermediate layer 715. The intermediate layer 715 can be the same as the intermediate layer 215 described herein, except that the intermediate layer 715 does not include cavities because magnets are not used in this embodiment. For example, in an illustrative embodiment, the intermediate layer 715 is securely mounted to the energy absorbing layer 710 such that the energy absorbing layer 710 and the intermediate layer 715 remain attached to one another in the event of an impact to the helmet. The intermediate layer 715 can be mounted to the energy absorbing layer 710 using an adhesive or any other method. In another illustrative embodiment, both the intermediate layer 715 and the slidable energy diverting layer 705 are made from polycarbonate. Alternatively, either or both of the intermediate layer 715 and the slidable energy diverting layer 705 can be made from another suitable material, such as a carbon fiber woven material. It is also noted that that the intermediate layer 715 and the slidable energy layer 705 can each be made from different materials in some embodiments. For example, the intermediate layer 715 can be made from a carbon fiber material and the slidable energy diverting layer 705 can be made from polycarbonate in one embodiment, or vice versa.

In an illustrative embodiment, both the slidable energy diverting layer 705 and the intermediate layer 715 can have a thickness that is greater than or equal to 0.3 mm and less than or equal to 1.2 mm. Alternatively, a different thickness may be used. The slidable energy diverting layer 705 and the intermediate layer 715 can be formed through injection molding, thermoforming, or any other manufacturing technique known in the art. In an alternative embodiment, the intermediate layer 715 may not be used, and the slidable energy diverting layer 705 can rest entirely on energy absorbing layer 710.

In another embodiment, the helmet of FIG. 7, or any of the other helmets described herein, can be implemented without an adhesive or magnets to secure the slidable energy diverting layer. For example, in one embodiment, an extension (or flange) of the slidable energy diverting layer can extend from the primary surface at an angle relative to the primary surface. In one embodiment, the extension can extend along a bottom edge of the energy absorbing layer to register the slidable energy diverting layer to the energy absorbing layer. Alternatively or additionally, the extensions can extend along a bottom of the helmet and mate with at least a portion of a ledge, lip, channel, or other surface of the energy absorbing layer to register/secure the slidable energy diverting layer to the energy absorbing layer. In response to an impact, the extensions deform, allowing movement of the slidable energy diverting layer relative to the energy absorbing layer.

Figure 7F:
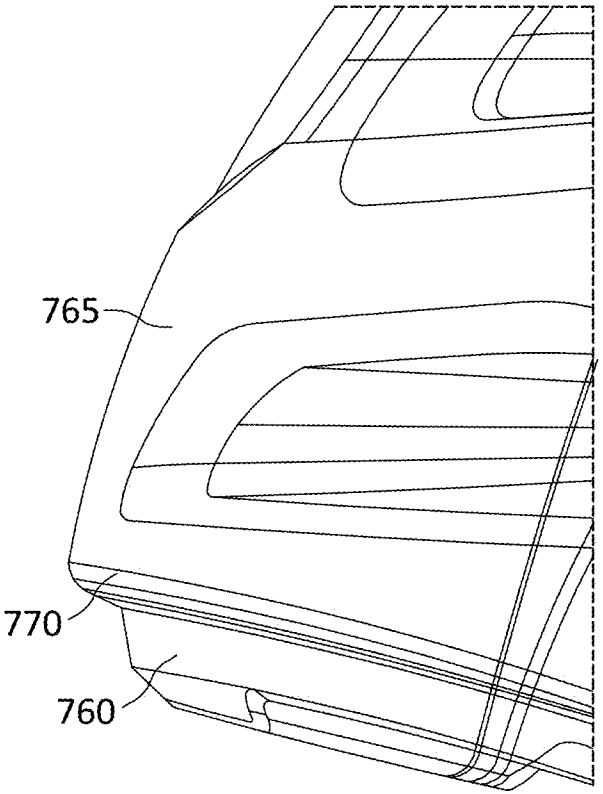
FIG. 7F is a partial view of the helmet showing how an extension (or flange) of a slidable energy diverting layer extends over the ledge to register the slidable energy diverting layer in accordance with an illustrative embodiment.
Figure 7E:
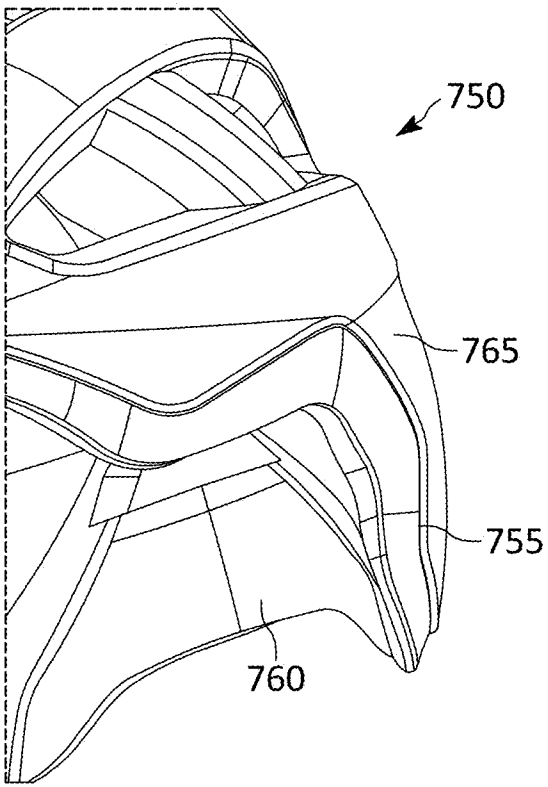
FIG. 7E is a partial view of a helmet that depicts a ledge (or step) that extends along a bottom of the energy absorbing layer in accordance with an illustrative embodiment.

FIG. 7E is a partial view of a helmet 750 that depicts a ledge (or step) 755 that extends along a bottom of the energy absorbing layer 760 in accordance with an illustrative embodiment. FIG. 7F is a partial view of the helmet 750 showing how an extension (or flange) 770 of a slidable energy diverting layer 765 extends over the ledge 755 to register the slidable energy diverting layer 765 in accordance with an illustrative embodiment. In an alternative embodiment, the ledge (or step) may extend along only a portion (or multiple portions) of the bottom of the helmet. Similarly, the extension (or flange) may extend from only a portion (or multiple portions) of the primary surface of the slidable energy diverting layer 765. In the embodiment of FIGS. 7E-7F, there are no magnets or adhesive used to secure the slidable energy diverting layer 760 to the energy absorbing layer 760. Rather, the interface of the extension 770 and the ledge 755 secures the slidable energy diverting layer 765 during normal use of the helmet 750. In the event of an impact, deformation of the slidable energy diverting layer 765 causes separation of the extension 770 from the ledge 755, enabling movement of the slidable energy diverting layer 765 relative to the energy absorbing layer 760. In an illustrative embodiment, the ledge 755 is continuous around a lower perimeter of the helmet 750. Similarly, the extension 770 can be continuous around a bottom edge of the slidable energy diverting layer 765. In one embodiment, extensions and ledges can also be used at the helmet vents to register the slidable energy diverting layer 765 to the energy absorbing layer 760. In one embodiment, the ledge 755 can be 1.5 mm deep and/or the extension 770 can have a width of 1.5 mm. In another embodiment, the ledge 755 and/or the extension 770 can have a first depth (e.g., 3 mm-5 mm) at a front and rear of the helmet and a second depth (e.g., 1.5 mm) along the sides of the helmet 750. In alternative embodiments, different depths/widths may be used. Alternatively, the ledge 755 and/or the extension 770 can be uniform in depth around the entire perimeter of the helmet 750.

Figure 7G:
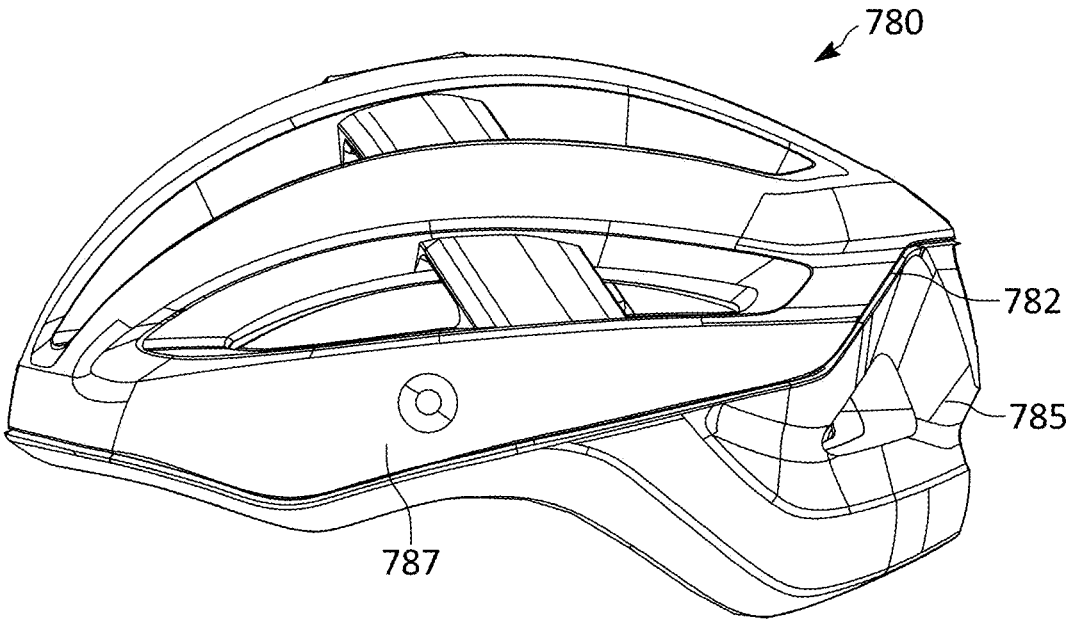
FIG. 7G is a side view of a helmet that includes a channel in the energy absorbing layer to register a slidable energy diverting layer in accordance with an illustrative embodiment.
Figure 7H:
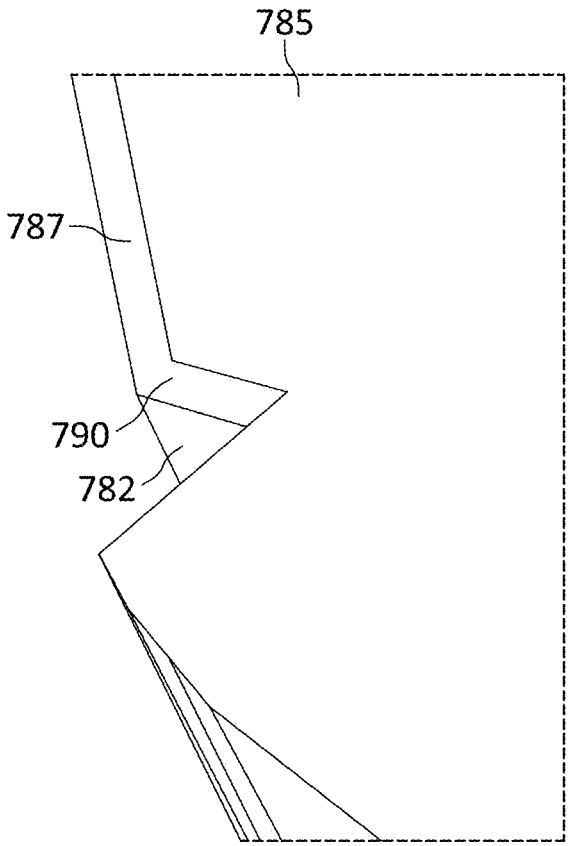
FIG. 7H is a close up partial view showing an interface of the channel and a flange of the slidable energy diverting layer in accordance with an illustrative embodiment.
Figure 7I:
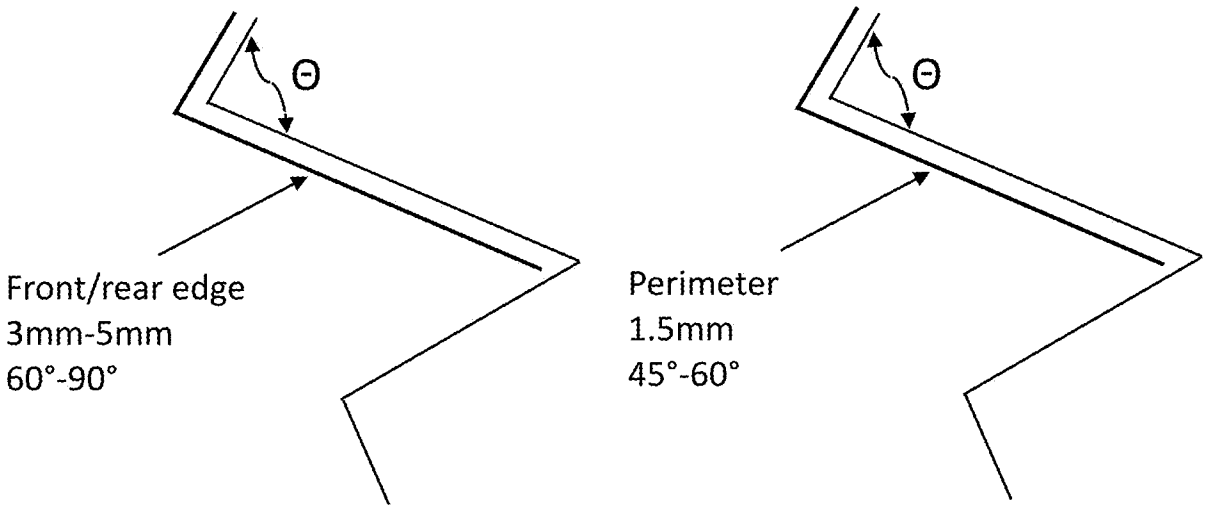
FIG. 7I depicts varying depths and angles of the flange and channel in accordance with an illustrative embodiment.

FIG. 7G is a side view of a helmet 780 that includes a channel 782 in the energy absorbing layer 785 to register a slidable energy diverting layer 787 in accordance with an illustrative embodiment. FIG. 7H is a close up partial view showing an interface of the channel 782 and a flange (or extension) 790 of the slidable energy diverting layer 787 in accordance with an illustrative embodiment. In the embodiment shown, the channel 782 is continuous around a lower perimeter of the helmet 780. In another embodiment, the channel 782 is not continuous and only extends around a portion or interrupted portions of the lower perimeter of the helmet 780. Similarly, in one embodiment, the flange may extend around only a portion or interrupted portions of the primary surface of the slidable energy diverting layer 787. In one embodiment, the channel 782 and the flange 790 can be uniform about the helmet 780. In another embodiment, front and rear edges of the helmet 780 can have a flange 790 depth and a channel 782 depth of approximately 3 mm-5 mm, and the sides of the helmet can have a flange 790 depth and a channel 782 depth of approximately 1.5 mm. In alternative embodiments, different dimensions can be used. The flange 790 and channel 782 can also have varying angles along the perimeter of the helmet 780, such as 60-90 degrees along the front and rear edges, and 45-60 degrees along the sides of the helmet. FIG. 7I depicts varying depths and angles of the flange 790 and channel 782 in accordance with an illustrative embodiment. In alternative embodiments, different angles may be used. Similar to the other embodiments described herein, the embodiments of FIGS. 7E-7I can be used with any of the tether assemblies described herein.

Figure 8:
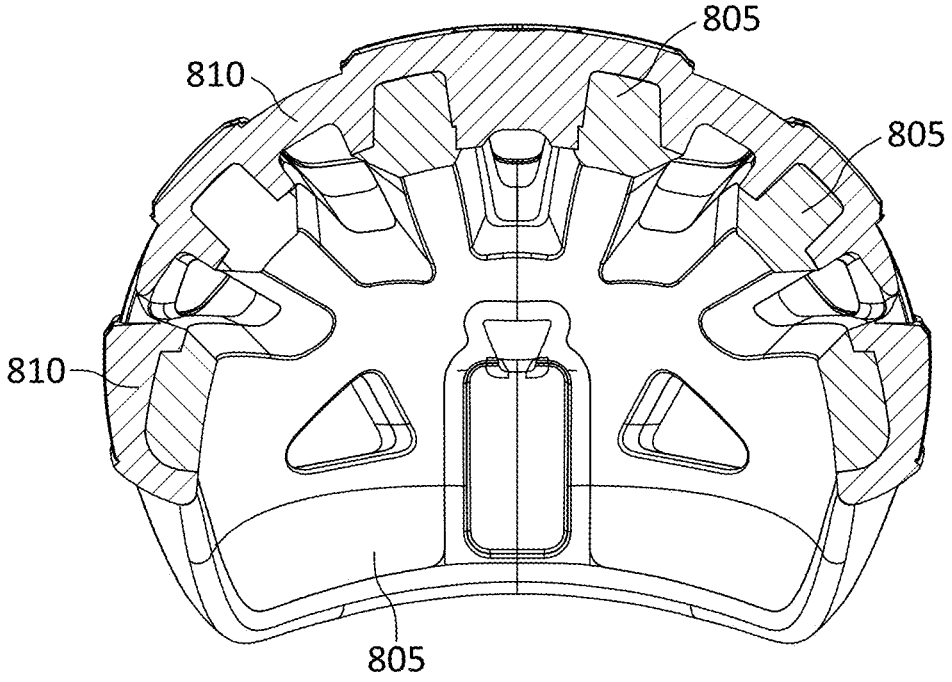
FIG. 8 depicts front and back cross-sectional views of a helmet having a dual density energy absorbing layer in accordance with an illustrative embodiment.
Figure 8:
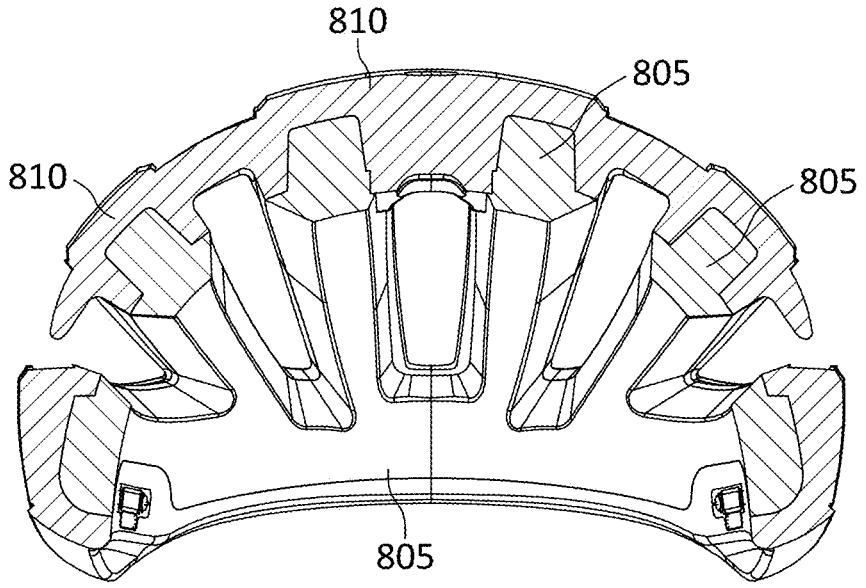

In one embodiment, the energy absorbing layer of the helmet can have a dual density. For example, a first portion of the energy absorbing layer can be made from a first material having a first density and a second portion of the energy absorbing layer can be made from a second material having a second density that differs from the first density. The first and second materials can be the same type of material (e.g., EPS), or different, depending on the embodiment. As an example, FIG. 8 depicts front and back cross-sectional views of a helmet having a dual density energy absorbing layer in accordance with an illustrative embodiment.

A first portion 805 of the energy absorbing layer is made from a material with a first density and a second portion 810 of the energy absorbing layer is made from a material with a second density. In one embodiment, the first portion 805 (i.e., the portion in contact with a head of a user) has a lower density than the second portion 810, which is positioned between the first portion 805 and the energy diverting layer of the helmet. In one embodiment, the density of the first portion 805 can be 60 grams/liter (g/L), 68 g/L, 80 g/L etc., and the density of the second portion 810 can be 90 g/L or 100 g/L. Alternatively, different densities may be used. In an illustrative embodiment, the second portion 810 of the energy absorbing layer can be molded first by being injected into a mold. As a result the second portion 810 (i.e., higher density material) partially fills and steams the skirt of the mold, forming areas for straps, anchors, etc. The first portion 805 (i.e., the lower density material) is injected after the second portion 810 to form fill the mold and form the rest of the energy absorbing layer.

As shown, each rib of the first portion 805 of the energy absorbing layer has a cross-section in the form of an upside down T-shape. Alternatively, a different shape/pattern may be used. In one embodiment, an internal reinforcement may be included in both the first portion 805 and the second portion 810 of the energy absorbing layer. For example, a nylon webbing can be placed in the mold such that the nylon webbing is embedded within the layer to provide additional strength.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A helmet comprising:

an energy absorbing layer, wherein the energy absorbing layer includes a secondary magnetic material that is at least partially embedded in the energy absorbing layer;

a slidable energy diverting layer that acts as an external shell of the helmet; and a pocket mounted to an interior surface of the slidable energy diverting layer such that the pocket is positioned in between the external shell of the helmet and the energy absorbing layer, wherein the pocket includes a primary magnetic material, wherein an attraction between the primary magnetic material and the secondary magnetic material secures the slidable energy diverting layer to the energy absorbing layer during normal use of the helmet.

2. The helmet of claim 1, wherein the energy absorbing layer includes a cavity positioned adjacent to the secondary magnetic material, wherein the cavity is sized to receive the pocket on the interior surface of the slidable energy diverting layer.

3. The helmet of claim 1, further comprising an intermediate layer mounted to the energy absorbing layer, wherein the intermediate layer includes a cavity that is positioned over the secondary magnetic material, wherein the cavity is sized to receive the pocket on the interior surface of the slidable energy diverting layer.

4. The helmet of claim 3, wherein the intermediate layer is made from the same materials as the slidable energy diverting layer.

5. The helmet of claim 1, wherein the attraction between the primary magnetic material and the secondary magnetic material releases upon an impact to the helmet such that the slidable energy diverting layer at least partially slides from the helmet to divert rotational energy that results from the impact.

6. The helmet of claim 1, further comprising a low friction coating applied to the interior surface of the slidable energy diverting layer.

7. The helmet of claim 1, further comprising a tether attached to the slidable energy diverting layer and the energy absorbing layer, wherein the tether limits movement of the slidable energy diverting layer upon sliding of the slidable energy diverting layer.

8. A helmet comprising:

an energy absorbing layer that includes a ledge or a channel around at least a portion of a perimeter of an exterior surface of the energy absorbing layer;

a slidable energy diverting layer that forms an external shell of the helmet and that mounts to the exterior surface of the energy absorbing layer, wherein the slidable energy diverting layer includes a primary surface and a flange that extends from the primary surface such that the flange extends toward and contacts the ledge or the channel to secure the slidable energy diverting layer to the energy absorbing layer during normal use of the helmet; and a tether assembly that retains the slidable energy diverting layer to the energy absorbing layer during an impact.

9. The helmet of claim 8, wherein the flange releases from the ledge or the channel in response to an impact to the helmet such that the slidable energy diverting layer slides to divert rotational energy that results from the impact.

10. The helmet of claim 8, wherein the flange has a first depth at a front of the slidable energy diverting layer and a second depth at a side of the slidable energy diverting layer, and wherein the first depth is greater than the second depth.

11. The helmet of claim 8, wherein the flange has a first angle relative to the primary surface at a front of the slidable energy diverting layer and a second angle relative to the primary surface at a side of the slidable energy diverting layer.

12. The helmet of claim 8, further comprising a connector base embedded in the energy absorbing layer, wherein the tether assembly includes a cord and a snap fit connector attached to the cord, and wherein the snap fit connector mates with the connector base to secure the cord to the energy absorbing layer.

13. The helmet of claim 12, wherein a loop of the cord connects to the snap fit connector such that two strands of the cord extend between the energy absorbing layer and the slidable energy diverting layer.

14. The helmet of claim 8, wherein the tether assembly includes a cord that extends between the energy absorbing layer and the slidable energy diverting layer, and wherein the cord mounts to a top cap that attaches to the slidable energy diverting layer.

15. The helmet of claim 14, further comprising a friction channel that extends through a body of the top cap, wherein the cord runs through the friction channel to increase resistance on the cord.

16. The helmet of claim 14, further comprising a clip that receives both ends of the cord, wherein the clip secures the ends of the cord to maintain the cord as a loop that extends from the top cap.

17. The helmet of claim 14, further comprising a top cap cover that is sized to receive the top cap, wherein the top cap cover mounts to the slidable energy diverting layer to secure the cord to the slidable energy diverting layer.

18. The helmet of claim 15, wherein the friction channel comprises a first friction channel, and wherein the top cap also includes a second friction channel, and wherein the first friction channel and the second friction channel each receive a portion of the cord.

19. The helmet of claim 18, further comprising an opening positioned between the first friction channel and the second friction channel, wherein a loop of the cord extends through the opening.

20. The helmet of claim 17, wherein the top cap cover mounts to an inner surface of the slidable energy diverting layer such that the tether assembly does not extend through the slidable energy diverting layer.

* * * * *